US012116791B1

(12) United States Patent
El Ariss et al.

(10) Patent No.: US 12,116,791 B1
(45) Date of Patent: Oct. 15, 2024

(54) INTERNAL REINFORCEMENT METHOD OF UPGRADING PROGRESSIVE COLLAPSE RESISTANCE OF REINFORCED CONCRETE FRAMED SYSTEM

(71) Applicant: United Arab Emirates University, Al Ain (AE)

(72) Inventors: Bilal El Ariss, Al Ain (AE); Said Elkholy, Al Ain (AE); Ahmad Shehada, Al Ain (AE)

(73) Assignee: UNITED ARAB EMIRATES UNIVERSITY, Al Ain (AE)

( * ) Notice: Subject to any disclaimer, the term of this patent is extended or adjusted under 35 U.S.C. 154(b) by 0 days.

(21) Appl. No.: 18/128,167

(22) Filed: Mar. 29, 2023

(51) Int. Cl.
*E04G 23/02* (2006.01)
*E04B 1/92* (2006.01)
(Continued)

(52) U.S. Cl.
CPC ..... *E04G 23/0218* (2013.01); *E04B 1/92* (2013.01); *E04B 1/98* (2013.01); *E04H 9/04* (2013.01); *E04H 9/06* (2013.01)

(58) Field of Classification Search
CPC ... E04G 23/0218; E04G 23/0237; E04B 1/92; E04B 1/98; E04H 9/04; E04H 9/06
See application file for complete search history.

(56) References Cited

U.S. PATENT DOCUMENTS 1,075,251 A * 10/1913 Graham ..... E04B 5/43 52/414
8,429,877 B2 * 4/2013 Keller ..... E04G 23/0237 52/252
(Continued)

FOREIGN PATENT DOCUMENTS

CN 1558981 A * 12/2004 ..... E04B 1/24
CN 101260691 A 9/2008
(Continued)

OTHER PUBLICATIONS

K Qain, "Performance of three-dimensional reinforced concrete beam-column substructures under loss of a comer column scenario", Journal, J Struct Eng, 2012, vol. 139, No. 4, 584-594.
(Continued)

*Primary Examiner* — Andrew J Triggs
(74) *Attorney, Agent, or Firm* — MH2 TECHNOLOGY LAW GROUP, LLP

(57) ABSTRACT

The invention discloses a mitigating method comprising a reinforcement scheme for upgrading progressive collapse resistance of a floor system prone to column failure, the method comprising adding a plurality of diagonal steel bars in the vicinity of a potentially failed column, thereby developing a post-tensioning axial compressive force in the floor beams of the floor system. Steel bars or links left over from construction sites as well as used steel bars and structural steel sections from demolition sites are used/reused as the plurality of diagonal steel bars to mitigate progressive collapse of framed structures under potential column failure. Depending on a number and configuration of the added diagonal steel bars, the percentage increases in the beam axial compressive force, catenary action capacity, total dissipated energy, and maximum vertical displacement by the mitigated floor system ranged between 104.5% and 161.3%, 105.1% and 180.5%, 115% and 241.8%, and 106% and 167.4%, respectively.

9 Claims, 38 Drawing Sheets

(51) Int. Cl.

| | |
|---|---|
| ***E04B 1/98*** | (2006.01) |
| ***E04H 9/04*** | (2006.01) |
| ***E04H 9/06*** | (2006.01) |

(56) References Cited

U.S. PATENT DOCUMENTS

| | | | | |
|---|---|---|---|---|
| 10,400,469 | B2 * | 9/2019 | Agha Beigi | E04H 9/028 |
| 2009/0025309 | A1 * | 1/2009 | Deans | E04B 5/12 52/92.2 |
| 2022/0213684 | A1 * | 7/2022 | Besjak | E04C 2/26 |

FOREIGN PATENT DOCUMENTS

| | | | | |
|---|---|---|---|---|
| CN | 106939706 | A * | 7/2017 | E04G 23/0218 |
| CN | 109057391 | A * | 12/2018 | |

OTHER PUBLICATIONS

J Yu, "Structural behavior of RC beam-column subassemblages under a middle column removal scenario", Journal, J Struct Eng, 2012, vol. 139, No. 2, 233-250.

S.B. Kang, "Behaviour of precast concrete beam-column subassemblages subject to column removal", Journal, Eng Struct, 2015, vol. 93, 85-96.

P.X. Dat, "Experimental response of beam-slab substructures subject to penultimate-external column removal", Journal, J Struct Eng, 2014, vol. 141, No. 7, 04014170-1-04014170-12.

K. Alogla, "A new mitigation scheme to resist progressive collapse of RC structures", Journal, Constr Build Mater, 2016, vol. 125, 533-545.

S. Orton, "Carbon fiber-reinforced polymer for continuity in existing reinforced concrete buildings vulnerable to collapse", Journal, ACI Struct J, 2009, vol. 106, No. 5, 1-10.

K. Qian, "Strengthening and retrofitting of RC flat slabs to mitigate progressive collapse by externally bonded CFRP laminates", Journal, J Compos Constr, 2012, vol. 17, No. 4, 554-665.

P. Feng, "Progressive collapse resistance of GFRP-strengthened RC beam-slab subassemblages in a corner column-removal scenario", Journal, J Compos Constr, 2018, vol. 23, No. 1, 04018076-1-04018076-15.

J. Pan, "Strengthening of precast RC frame to mitigate progressive collapse by externally bonded CFRP sheets anchored with HFRP anchors", Article, Adv Civil Eng, 2018, 1-12.

S. Garg, "Case study on strengthening methods for progressive collapse resistance of RC flat slab buildings", Journal, Structures, 2021, vol. 29, 1709-1722.

F.J. Luo, "Progressive collapse analysis and structural robustness of steel-framed modular buildings", Journal, Eng Fail Anal, 2019, vol. 104, 643-656.

M. Alembagheri, "Collapse capacity of modular steel buildings subject to module loss scenarios: The role of inter-module connections", Journal, Eng Struct, 2020, vol. 210, 1-15.

M. Alembagheri, "Anti-collapse resistance mechanisms in cornersupported modular steel buildings", Journal, J Construct Steel Res, 2020, vol. 170, 1-11.

T.M. Chan, "Effect of inter-module connections on progressive collapse behaviour of MiC structures", Journal, J Construct Steel Res, 2021, vol. 185, 1-19.

H.T. Thai, "Progressive collapse and robustness of modular high-rise buildings", Journal, Struct Infrastruct Eng, 2021, 1-13.

Y.S. Chua, "Robustness of inter-module connections and steel modular buildings under column loss scenarios", Journal, J Build Eng, 2022 vol. 47, 1-23.

J. Peng, "Progressive collapse analysis of corner-supported composite modular buildings", Journal, J Build Eng, 2022, vol. 48, 1-20.

W. Zhang, "Progressive collapse of post-tensioned subframes following the removal of an interior column" Journal, Eng Struct, 2022, vol. 254, 1-22.

K. Qian, "Progressive collapse resistance of posttensioned concrete beam-column subassemblages with unbonded posttensioning strands", Journal, J Struct Eng, 2018, vol. 144, No. 1, 1-12.

K. Qian, "Progressive collapse resis.ing mechanisms of planar prestressed concrete frame", Journal, ACI Struct J, 2019, vol. 116, No. 4, 77-90.

Y. Huang, "Numerical investigation on compressive arch action of prestressed concrete beam-column assemblies against progressive collapse", Journal, J Build Eng, 2021, vol. 44, 1-14.

K. Qian, "Robustness of post-tensioned concrete beam-col. subassemblies under various column removal scenarios", Journal, J Struct Eng, 2022, vol. 148, No. 5, 1-46.

B. El-Ariss, "Benchmark Numerical Model for Progressive Collapse Analysis of RC Beam-Column Sub-Assemblages", Article, Buildings, 2022, vol. 12, No. 122, 1-22.

S. Elkholy, "Effects of Floor System on Progressive Collapse Behavior of RC Frame Sub-Assemblages", Article, Buildings, 2022, vol. 12, No. 737, 1-19.

* cited by examiner (a) Numerical and test results of specimen 3D [1]

(b) Numerical and test results of specimen T1 [2]

(c) Numerical and test results of specimen T2 [2]

(d) Numerical and test results of specimen S1 [2]

(e) Numerical and test results of specimen S2 [2]

Reinforced concrete frame building with multi-floors is the type of structures where the mitigating method is applied Plan view, looking up, of reinforced concrete floor system with mitigating method (top and bottom diagonal steel bars within thickness of each reinforced concrete slab panel) around potentially failed reinforced concrete Reinforced concrete frame building with failed interior reinforced concrete column (failed column can be on the reinforced concrete floor shown or on any other reinforced concrete floor of the reinforced concrete frame building)

(a) mitigated floor system: arrangement of added diagonal steel bars around failed column in single link (left) and double links (right)

(c) cross section of link (b) mitigating method: single and double links of added diagonal top and bottom bars around potential failed column e) Vertical load-displacement curves f) Beam axial compressive force-displacement curves g) Link force-displacement curves h) Beam moment-displacement curves q) Vertical load-displacement curves r) Beam axial compressive force-displacement curves a) Vertical load-displacement curves b) Beam axial compressive force-displacement curves c) Link force-displacement curves d) Beam moment-displacement curves

INTERNAL REINFORCEMENT METHOD OF UPGRADING PROGRESSIVE COLLAPSE RESISTANCE OF REINFORCED CONCRETE FRAMED SYSTEM

FIELD OF THE INVENTION

The present invention relates to the field of concrete framed systems, and more particularly to a reinforcement method for concrete framed systems.

BACKGROUND OF THE INVENTION

Background description includes information that will be useful in understanding the present invention. It is not an admission that any of the information provided herein is prior art or relevant to the presently claimed invention, or that any publication specifically or implicitly referenced is prior art.

The serious consequences of progressive collapse of structures caused by the failure of one or more local load-bearing members can lead to large-scale structural collapse. The propagation of such local failure could be devastating, resulting in casualties and extensive property damage. To prevent or mitigate potential progressive collapse, the behavior of structures should be accurately predicted before and after the occurrence of the initial local failure. Currently, structural design codes and standards recommend the use of different load paths to avoid large-scale and disproportionate collapse and suggest few mitigation options. CN1558981 provides a type of post-beam frame system construction, where the center column and beam are connected by the support group and share all lateral loads, and the connected node location of the support group between column and beam is around the column. The individual support group consists of an inner and an outer element, which are tightened together during system construction and then interlocked by gravity, and a short duration drag square is provided for lateral loading. The inner and outer parts of the support group are locked together using tension nuts and bolts to transfer the loads to the beams. CN101260691 discloses a design of the column top sliding part to resist the collapse of the reinforced concrete frame. The invention replaces a part of a regular reinforced concrete frame column with a column top sliding part that can generally be maintained under lateral loads, preventing the system from collapsing due to loss of vertical bearing capacity.

Previously implemented methods have inspected the effects of beam span aspect ratio, stirrup ratio, and seismic detailing on the progressive collapse capacity by testing seven beam-column sub-assemblage specimens. These have reported that progressive collapse resistance could be improved by enhancing the flexural capacity of the beam and the shear capacity of the joint via increasing the ratio of flexural bras and the ratio of transverse stirrups to confine the joint, respectively. Another publication has also investigated the capacity of alternate load path, span to depth ratio of the beam, and longitudinal reinforcement to mitigate progressive collapse, wherein 6 RC beam-column specimens were tested under quasi-static loading. It was concluded that compression arch action was valuable for specimens with a small span to depth ratio and a low reinforcement ratio, while the tensile catenary action was advantageous for specimens with a large span to depth ratio and a high-top reinforcement ratio. Experimental progressive collapse behaviors of five beam-column prestressed RC two-span sub-assemblages were reported by Kang and Tan.

The joint between two spans of the sub-assemblage was filled with cast-in-place concrete and continuous flexural steel bars through the beam-column joint were used to increase progressive collapse resistance of the sub-assemblage. The authors stated that as a result of mainly using continuous flexural bars there was significant improvement in the beam compression arch action and tensile catenary action resistances to progressive collapse.

Another article investigated the progressive collapse capacity of three RC beam-slab specimens being subjected to quasi-static loading. The collapse mechanism observed was typical slab cracking and compressive failure due to concrete crushing resulting in horizontal inward movement of the corner column. It was also found that the load-bearing capacity and ductility of the beam could be improved by the addition of transverse and longitudinal reinforcing bars. Another previous article described a mitigating system to improve the structure progressive collapse capacity by using extra steel bars in the middle layer of the beams. This system significantly enlarged the ductility of the specimens.

Another reference was found to use quasi-static loading to investigate the consequence of using continuous steel and carbon fiber reinforced polymer (CRFP) bars on RC beams for progressive collapse behavior due to column removal. They stated that beams with continuous CFRP bars provided better flexural and tensile catenary actions with reduced deflections, and due to the limited rotation of the beam, continuous steel reinforcement may be ineffective to withstand column removal. Qian and Li proposed a strengthening scheme using CFRP laminates with two arrangements to improve the progressive collapse RC flat slabs subjected to column failure. 6 strengthened RC slabs without drop plates were tested under quasi-static loading to investigate the effectiveness of the strengthening scheme on the progressive collapse resistance of the slab. The two CFRP laminate arrangements consisted of (a) laminates bonded at 45°-135° and crosswise on the top face of the slab and (b) laminates bonded at 0°-90° and orthogonally on the high face of the slab. Both arrangements enhanced the slab resistance to progressive collapse; however, due to its easy application the authors recommended the second arrangement for strengthening such slabs. Another method evaluated the effectiveness of using near surface mounted (NSM) glass fiber reinforced polymer (GFRP) bars and externally bonded GFRP sheets as a strengthening technique on the progressive collapse behavior of four RC beam-slab sub-assembly specimens due to corner column elimination. The strengthened specimens were loaded in a quasi-static mode and the strengthening method used improved the progressive collapse resistance of the specimens. However, the effect of the catenary action was not significant at large displacements. In addition, the presence of the slab increased the flexural and torsional strength of the beam and improved the overall stiffness of the subassembly. In the early stages of the test, crack growth was controlled and contained by the GRP sheets. As the load increased, debonding of the sheets began and the sheets became ineffective. Conversely, the bonded NSM GRP bars showed minimal debonding with smaller crack widths than those of the GRP sheets and showed better load carrying capacity compared to the GRP sheets.

Pan et al. proposed a strengthening method for beams subjected to progressive collapse using CFRP sheets on the beam sides and fixing the sheet in the center with hybrid fiber reinforced polymer (HFRP) fasteners. Two precast RC frames strengthened by this method were tested under quasi-static loading to investigate the efficiency of the proposed strengthening method. The precast members of the frame, beams and columns, were connected by concrete casting. The proposed strengthening demonstrated effective lateral restraint provided by the HFRP anchors and CFRP plates, as well as the ability to generate a catenary effect in the frames. In another case study, the addition of perimeter beams improved the resistance of the structures to progressive collapse due to column removal by reducing the vertical displacement at the point of failure and the demand to capacity ratio of critical columns by up to 81% and 67% respectively.

Modular construction is a new technique used to improve the robustness of structures to progressive collapse. Recent works in this regard have focused mainly of examining several features of modular construction. Nevertheless, the findings of these recent works are very limited and lack knowledge on modes of failure, effects of modular connections, and probable strengthening procedures. In addition, this technique is costly and requires special attention to inter-module connection types as they affect the properties of the beam-column joints. Also, special care is required due to different load distribution mechanisms and level of redundancy.

Based on the above, there is a need to develop a new approach or method to overcome the drawbacks and shortcomings of these traditionally implemented methods with respect to reinforcement of concrete framed systems, and to show better results.

SUMMARY OF THE INVENTION

Aspects of the disclosed embodiments seek to provide a method for upgrading the progressive collapse resistance of reinforced concrete framed systems.

Embodiments of the present invention relates to a mitigating method comprising a reinforcement scheme for upgrading progressive collapse resistance of a floor system prone to column failure, the method comprising installing a plurality of diagonal steel bars in the vicinity of a potentially failed column, thereby developing a self-generated post-tensioning axial compressive force in the floor beams of the floor system.

In accordance with an embodiment of the present invention, the method is applied to at least one or more potential failed columns on the same floor or on different floors.

In accordance with another embodiment of the present invention, the method is applied to all columns on the same floor and on all floors of a framed structure.

In accordance with another embodiment of the present invention, the floor system is a reinforced concrete (RC) floor system.

In accordance with another embodiment of the present invention, the self-generated post-tensioning axial compressive force is an additional horizontal restraining force which increases axial compressive forces within segments of beams bridging over the potentially failed column.

In accordance with another embodiment of the present invention, depending on a number and configuration of the added plurality of diagonal steel bars, the percentage increases in the beam axial compressive force, catenary action capacity, total dissipated energy, and maximum vertical displacement by the mitigated floor system ranged between 104.5% and 161.3%, 105.1% and 180.5%, 115% and 241.8%, and 106% and 167.4%, respectively.

In accordance with another embodiment of the present invention, steel bars or links left over from construction sites as well as used steel bars and structural steel sections from demolition sites are used/reused as the plurality of diagonal steel bars to mitigate progressive collapse of framed structures under potential column failure.

In accordance with another embodiment of the present invention, the proposed method further comprises embedding the plurality of diagonal steel bars within a floor slab thickness of the floor system or framed structure.

In accordance with another embodiment of the present invention, the plurality of diagonal steel bars are installed in each slab panel located in the vicinity of a potentially failed column.

As another aspect of the present invention, a reinforcement system for enhancing progressive collapse resistance of a floor system prone to column failure is proposed, the system comprising a plurality of diagonal steel bars installed in the vicinity of a failed column, wherein the plurality of diagonal steel bars are bars of length not exceeding one-sixth the span of a longitudinal floor beam (span/6) measured from the centerline of the failed column.

In accordance with an embodiment of the present invention, the installed plurality of diagonal steel bars results in developing a self-generated post-tensioning axial compressive force in the floor beams of the floor system.

In accordance with another embodiment of the present invention, the plurality of diagonal steel bars are horizontal diagonal links, each link being made of top and bottom diagonal bars placed within a slab thickness of each of four slab panels around the failed column to connect an orthogonal beam bridging over the failed column.

In accordance with another embodiment of the present invention, the top and bottom diagonal bars provide additional horizontal load paths to increase building redundancy and robustness which prevents building progressive collapse due to column failure.

Additional aspects of the invention will be set forth in part in the description which follows, and in part will be obvious from the description, or may be learned by practice of the invention.

BRIEF DESCRIPTION OF THE DRAWINGS

The manner in which the above-recited features of the present invention is understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
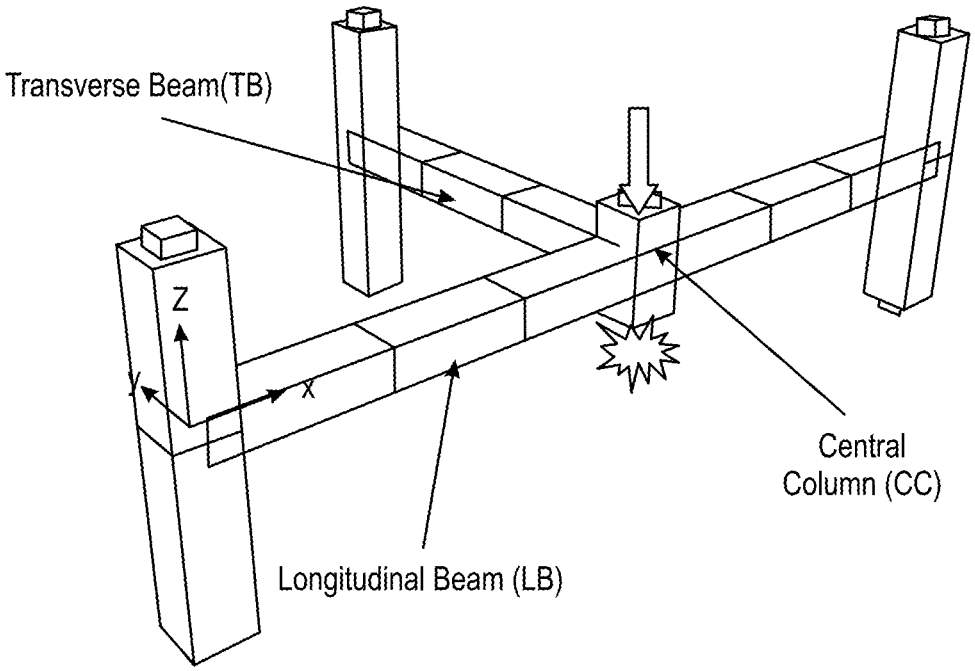
FIG. 1 shows numerical modeling of the test specimen by SeismoStruct, in accordance with the present invention.

Considering load capacities, FIGS. 12A-12N and FIGS. 13A-13N for single and double links, respectively, exhibit percentages of increase in the load strengths ($P_f$, $P_t$, $P_c$, $P_{fa}$) and corresponding vertical displacements (ductility), beam axial compressive force, beam moment at critical section of the mitigated floor systems.

The foregoing and other objects, features and advantages of the present invention, as well as the invention itself, will be more fully understood from the following description of preferred embodiments, when read together with the accompanying drawings.

DETAILED DESCRIPTION OF THE DRAWINGS

The present invention relates to the field of concrete framed systems, and more particularly to a reinforcement method for concrete framed systems.

The principles of the present invention and their advantages are best understood by referring to FIG. 1 to FIG. 13N. In the following detailed description of illustrative or exemplary embodiments of the disclosure, specific embodiments in which the disclosure may be practiced are described in sufficient detail to enable those skilled in the art to practice the disclosed embodiments. The following detailed description is, therefore, not to be taken in a limiting sense, and the scope of the present disclosure is defined by the appended claims and equivalents thereof. References within the specification to "one embodiment," "an embodiment," "embodiments," or "one or more embodiments" are intended to indicate that a particular feature, structure, or characteristic described in connection with the embodiment is included in at least one embodiment of the present disclosure.

The progressive collapse behavior of prestressed structures has not been extensively studied and therefore there is a lack of knowledge in this respect. According to previous studies, the maximum strength of post-tensioned structures could be greater than those of RC structures, and prestressing cables with a bigger diameter can increase the ultimate strength more than those with lesser diameter. The present invention proposes a mitigating method with a simple and practical reinforcement scheme for improving the progressive collapse resistance of RC floor systems prone to column failure. The method can be applied to one or more potentially failed columns on the same floor or on different floors, as well as to all columns on the same floor and on all floors of the framed structure.

The concept of the proposed invention is to add diagonal steel bars (reinforcing steel bars/rebar), links, in the vicinity around the potential failed column to develop self-generated "post-tensioning" axial compressive forces in the floor beams. A useful feature of the present invention is that it requires minimum amount of material, does not require skilled labors, and does not contradict with existing architectural requirements. Another key feature is its responsive accommodation of large vertical displacements.

To achieve this goal, the proposed method is comprised of adding diagonal top and bottom reinforcing bars within the floor slab panels in the vicinity around the potential failed column. Various configurations of the added diagonal bars are considered for analysis. To examine the efficiency of the proposed method, three-dimensional (3D) nonlinear fiber element-based finite element model is developed for the analysis of RC floor systems subjected to progressive collapse because of a column removal. The accuracy of the developed 3D numerical model is validated against benchmark test results from literature. The resulting numerical findings show that the mitigated floor system of the frame considered experienced improved progressive collapse behavior. Depending on the added bar configurations, the percentage increases in the beam axial compressive force, catenary action capacity, total dissipated energy, and maximum vertical displacement by the mitigated floors ranged between 104.5% and 161.3%, 105.1% and 180.5%, 115% and 241.8%, and 106% and 167.4%, respectively. The study results also demonstrate that by implementing the proposed mitigating method, efficient floor systems can be attained that better resist progressive collapse due to potential column failure.

In an embodiment of the present invention, this method applies primarily to the floor system of the RC framed structures. The proposed mitigating method is based on the concept of developing self-generated "post-tensioning" axial compressive forces within segments of the beams that bridge over potential failed column. The method is comprised of adding diagonal top and bottom reinforcing bars within the floor slab panels in the vicinity around the potential failed column.

The self-generated 'post-tensioning' compressive force can also be viewed as an additional horizontal 'restraining' force that increases the axial compressive forces within the segments of the beams bridging the failed column. This method can be applied to one or more potentially failed columns on the same floor or on different floors. It can also be applied to all columns on the same floor and on all floors of the framed structure. To simulate the removal of the failed column and predict the progressive collapse of the 3D specimens described above, a displacement-controlled nonlinear static push-down was applied at the location of the removed column. The load was applied incrementally and the calculated stresses and strains in each element were compared to a set of predefined material performance criteria to track the damage sequence in the frame. The sum of all column support reactions in the 3D floor system due to the applied downward displacement is equal to the applied load at the position of the removed column. The role of the added diagonal bars is to connect the orthogonal floor beams around the potential failed column and to act as links/ties between the beams when the column fails. The development length is maintained to ensure adequate anchorage between the added bars and the floor beams. Since the structural system in the vicinity of the failed column will receive the greatest deformations, the added top and bottom diagonal bars should be located close to and around the failed column to be effective.

Due to the relative vertical displacement between the orthogonal floor beams and hence between the two ends of the diagonal bars connected to these beams, the diagonal bars in each slab panel behave as links/ties that push on the floor beams at the point of connection, causing the generation of axial compressive forces within the beam segments confined by the diagonal bars placed around the failed column. In the proposed method, steel bars left over from construction sites as well as used steel bars and structural steel sections from demolition sites can be used/reused in the links to mitigate progressive collapse of RC framed structures under column(s) failure. This saves the energy required to produce new steel bars and steel sections, reduces carbon dioxide emissions and serves as a sustainable solution to mitigate progressive collapse of RC framed structures subjected to column(s) collapse.

The present invention describes a reliable method to mitigate progressive collapse of reinforced concrete framed structures in the event of failed column(s). This invention includes adding diagonal top and bottom steel bars (reinforcing steel bars/rebar), or diagonal steel sections, around potential failed column(s) and embedded within the floor slab to act as links connecting orthogonal floor beams that bridge over the potential failed column(s). Various link configurations are provided to connect orthogonal floor beams bridging over the failed column(s). The diagonal links can also be installed around all non-potential failed columns on the same floors and on all floors of the framed structure, above and below the potential failed column(s). Upon failure of the column(s), the diagonal links generate axial compressive forces within segments of the floor beams bridging the failed column(s) and resist further vertical downward displacements at failed column location(s). This invention serves as a mitigating method for improving the capacity of reinforced concrete framed structures to resist progressive collapse due to column loss.

The purpose of this invention is to improve the resistance of reinforced concrete (RC) floor systems to progressive collapse because of a potential column failure. The invention applies to RC floor systems in framed structures. In an embodiment, the proposed method of improving the resistance of RC floor systems comprises adding diagonal links connecting the orthogonal floor beams around and within the vicinity of the potential failed column. The diagonal links are embedded within the floor slab thickness of framed structure. The links have two sets of diagonal links parallel to each other. The diagonal links include top and bottom steel bars as well as structural steel sections embedded within the floor slab thickness. The diagonal links are easily constructed with a variety of versatile arrangements. Left over reinforcing bars from construction site and demolition sites as well as reusing steel bars and structural steel sections from demolition sites may be used in the diagonal links.

This invention requires minimum amount of material and does not require skilled labors and does not contradict with exiting architectural requirements. The proposed method applies to and around all columns on the same floor and connect orthogonal floor beams spanning over columns. The method applies to and around all columns in all floors of the frame structure. The diagonal links can include steel sections within the floor slab thickness. The links augment the axial compressive force in the floor beams of mitigated floor system and enhance the ductility and capacity of catenary action of the floor beams of mitigated floor system. The links enhance the floor beam energy dissipation in mitigated floor system.

In another embodiment, the reinforced concrete columns having longest dimension provides support to the framed structure. The reinforced concrete floor beam has the longest dimension horizontal and intersects with the columns providing supports to the beam in their longest direction and comprise beams that support floor systems. The floor beams and columns frame in and intersect into moment-resisting joints. A pair of aligned longitudinal floor beams exist on opposite sides of and intersecting with the columns. The beam-column intersections are moment resisting joints in the longitudinal direction of the structure. The building structure comprises beam-to-column joint connections with the columns having longest dimension providing support to floor beams and floor beams with the longest dimension providing support to the reinforced concrete floor systems. The floor slab comprises of reinforced concrete slab with steel reinforcement in longitudinal and transversal directions with continuity of top bars on opposite sides of floor beams. The floor system transfer gravity loads to the supporting longitudinal and transversal floor beams, and the longitudinal and transversal floor beams transfer gravity loads to the supporting columns.

This invention describes a method for considering structure progressive collapse mitigation of reinforced concrete framed structures from a structural system perspective, which can increase the ductility and energy dissipation capability of structural system and improve its overall progressive collapse resistance due to column loss. The invention is characterized by the concept of developing internally self-generated "post-tensioning" axial compressive forces within segments of the floor beams that bridge over potential failed column. This invention will augment the catenary action in the floor beams resulting in more ductility and increase in energy dissipation. Another unique feature is that this invention requires minimum amount of material, does not require skilled labors, and does not contradict with existing architectural requirements.

In this invention, steel bars left over from construction sites as well as used steel bars and structural steel sections from demolition sites can be used/reused in the links to mitigate progressive collapse of reinforced concrete (RC) framed structures under column(s) failure. Hence, it requires minimum amount of material. This invention saves the energy required to produce new steel bars and new structural steel sections, reduce carbon dioxide $CO_2$ emission, and serve as a sustainability solution to mitigate progressive collapse of RC framed structures subjected to column(s) collapse. This invention offers a mitigated structure that not only improves the capacity of the structure but also increases its energy dissipation and overall ductility. Optimizing the location, orientation, and area of steel of the links can maximize the structure energy dissipation by 114% and its overall ductility by 67%. This invention accounts for material and geometric nonlinearities, which are crucial in the analysis of structures undergoing large deformations such as in progressive collapse scenario. This invention does not require skilled labors and does not contradict with existing architectural requirements. Optimization process can be performed using any structural analysis software that accounts for material and geometric nonlinearities. This invention applies to RC framed structures with floor beam-supported slabs.

Considering numerical analysis in accordance with the present invention, 3D nonlinear fiber element-based finite element model is developed for RC floor systems. To numerically examine the influence of floor slabs and transverse beams on progressive collapse resistance of 3D RC framed structures, an efficient and validated 2D fiber element-based finite element nonlinear model developed (using SeismoStruct software) is expanded to develop a 3D nonlinear numerical model to perform 3D analysis on progressive collapse of spatial RC frames. The developed 3D nonlinear numerical model is then validated by simulating and comparing the numerical findings with various benchmark experimental test data. The developed 3D fiber element-based finite element nonlinear model is based on fiber element approach using SeismoStruct software. The model optimal key parameters and material modeling arrived at in the 2D numerical model is adopted in the 3D model for this invention. To include the effect of the floor slabs in the 3D nonlinear analysis, the beams in both directions were modeled as T-beams and the floor system was modeled as fiber-based frame members. The frame members were segmented based on their section dimensions and reinforcement ratios. A single nonlinear force-based plastic-hinge frame element (infrmFBPH) from the software library is used to model each segment of the segmented frame member. The cross-section of each member is broken into at least 150 fibers, and a plastic hinge length of half the segment length is used. To simulate the removal of the failed column and predict the progressive collapse of the 3D frame structure, displacement-controlled nonlinear static push-down is applied at the position of removed column.

The developed 3D nonlinear numerical model is validated by simulating various benchmark experimental test data.

Figure 2A:
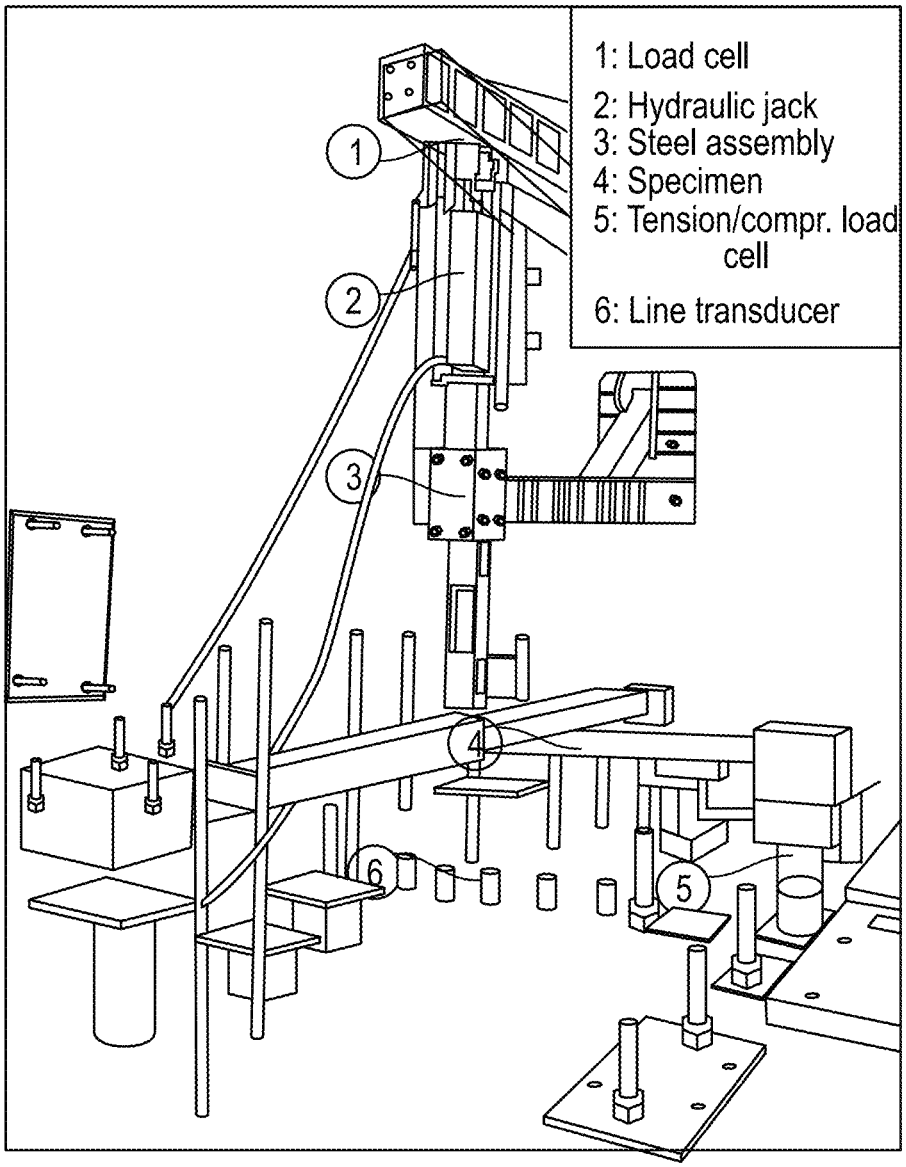
FIGS. 2A and 2B show test set-up specimens T1 and T2 had similar beams as those of specimens S1 and S2 (but had no RC slab). Specimens T1 and T2 had same test setup but different beam dimensions and reinforcements. Likewise, specimens S1 and S2 had also same test setup but different slab and beam dimensions and reinforcements. To account for the effect of the slabs of specimens S1 and S2 in the developed 3D numerical analysis, the beams in both directions were modeled as T-beams with effective flange widths.
Figure 2B:
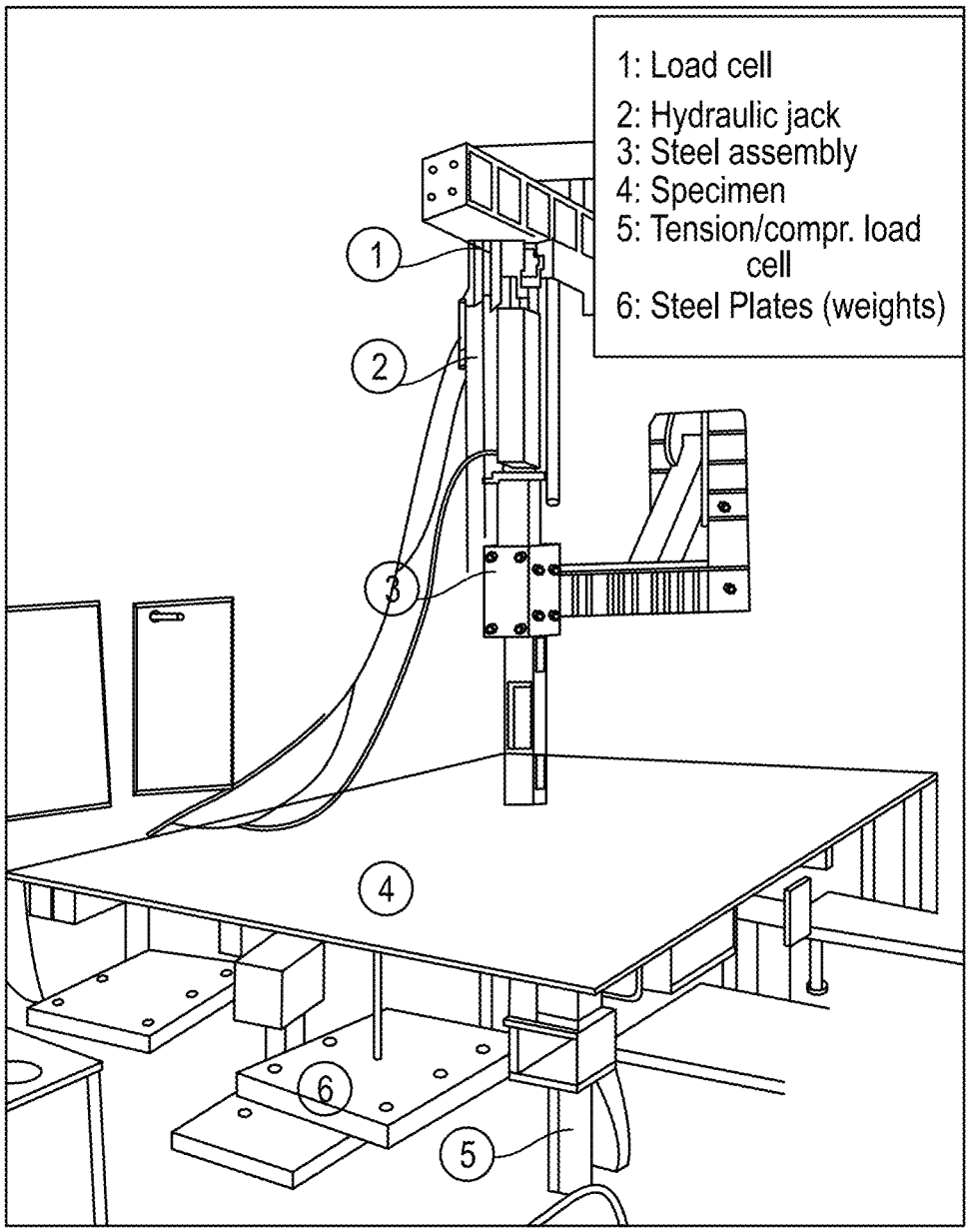
Figure 2C:
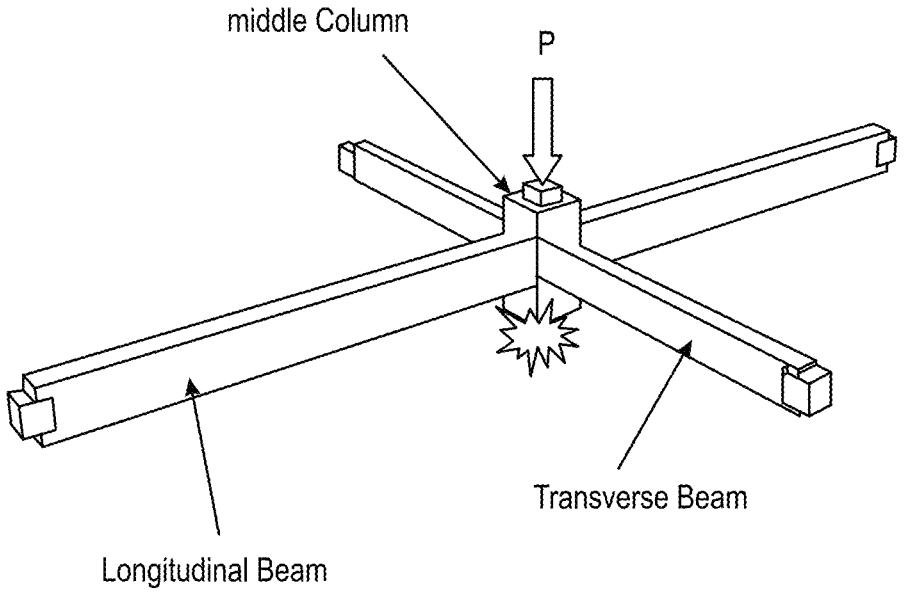
FIGS. 2C and 2D show the 3D numerical models by SeismoStruct of the test specimens T1, T2, S1, and S2.
Figure 2D:
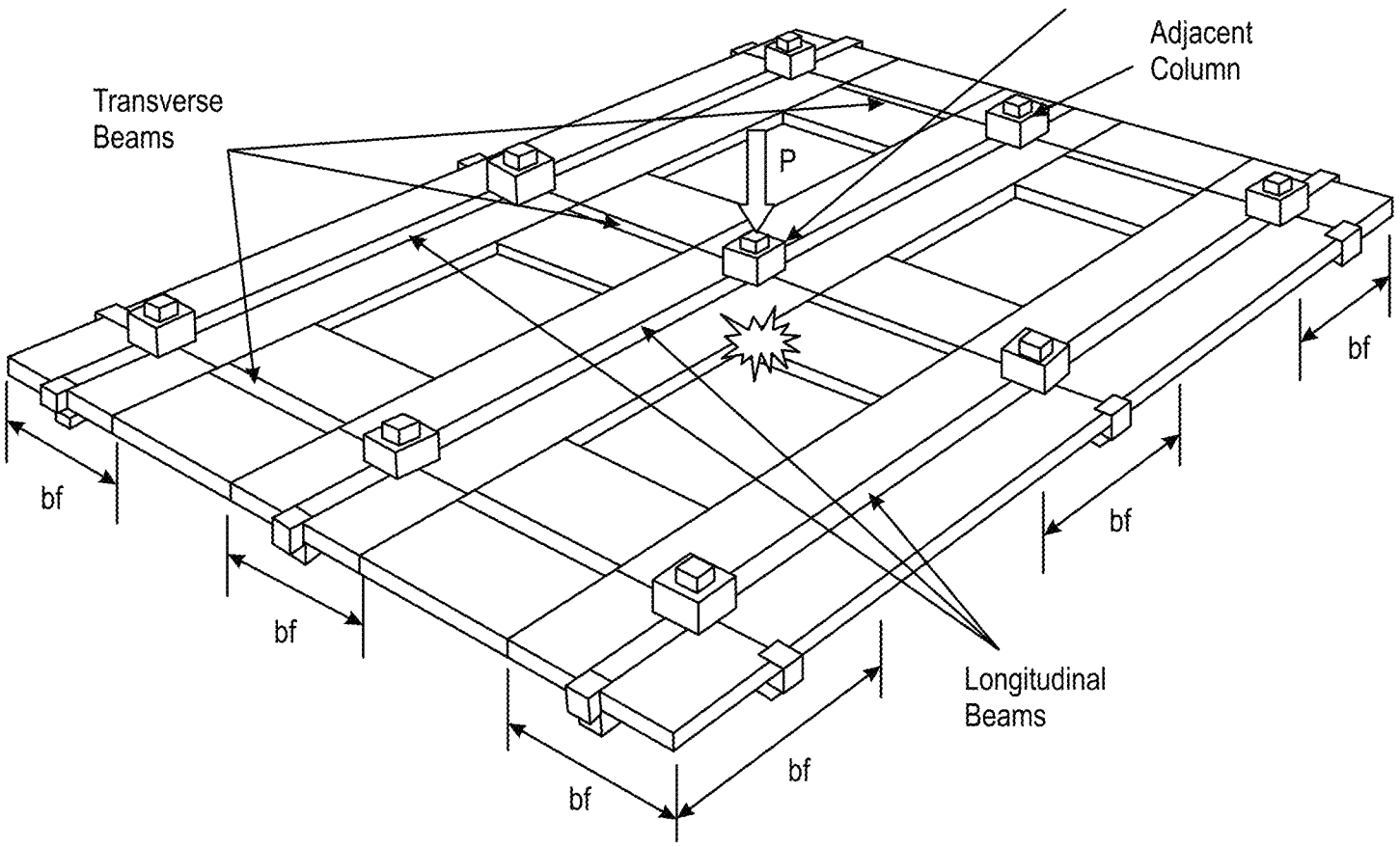

A previously conducted experimental work for investigating the role of transverse beams on the progressive collapse behavior of 3D RC sub-assemblage was considered in the validation of the developed 3D numerical model. The test 3D RC sub-assemblage, specimen 3D, comprised of three beams, intermediate column stub, and three edge columns. The numerical modeling of the test specimen by SeismoStruct is displayed in FIG. 1. In addition, four 3D specimens T1, T2, S1, and S2 previously tested to evaluate the impact of transverse beams and slabs on progressive collapse of buildings were considered in this study to further validate the 3D model. Specimens T1 and T2 had similar beams as those of specimens S1 and S2 but had no RC slab as shown in FIG. 2A and FIG. 2B. Specimens T1 and T2 had same test setup but different beam dimensions and reinforcements. Likewise, specimens S1 and S2 had also same test setup but different slab and beam dimensions and reinforcements. To account for the effect of the slabs of specimens S1 and S2 in the developed 3D numerical analysis, the beams in both directions were modeled as T-beams with effective flange widths. The 3D numerical models by SeismoStruct of the test specimens T1, T2, S1, and S2 are displayed in FIG. 2C and FIG. 2D.

In an embodiment of the present invention, to simulate the removal of the failed column and to predict the progressive collapse of the 3D specimens in accordance with the present invention, a displacement-controlled non-linear static push-down was applied at the position of the removed column. The load was applied incrementally and the calculated stresses and strains in each element were compared to a set of predefined material performance criteria to track the damage sequence in the frame. The sum of all column support reactions in the 3D floor system as a result of the applied downward displacement is equal to the applied load at the position of the removed column.

Figure 3:
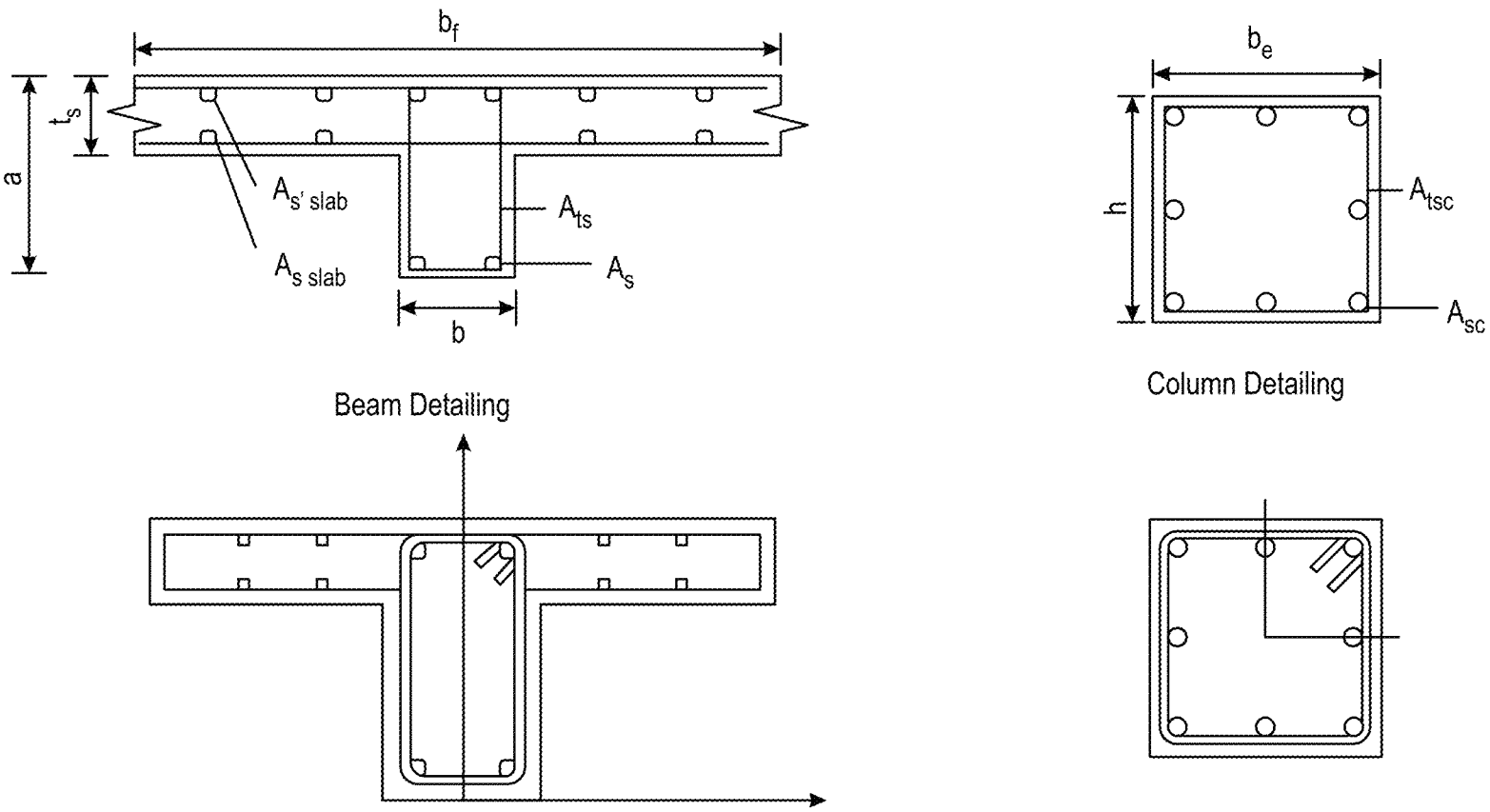
FIG. 3 shows typical beam and column cross-sections (top) and their SeismoStruct models (bottom) to include the effect of slab, the beams are modeled as T-Beams with flange width $b_f$; for specimens with no slab $b_f$=b.

As seen in FIG. 3, the developed 3D fiber element-based nonlinear finite element model appropriately predicted the test vertical load-displacement behaviors of the specimens 3D, T1, T2, S1, and S2 with the vertical load and displacement being measured at the location of the removed column. The numerically predicted behaviors also identified the sequence of damages in the specimens, as displayed in FIG. 3. The good comparison with acceptable difference between the numerically predicted and benchmark experimental results validated the accuracy of the numerical simulations by the developed 3D model and presented it as a viable 3D numerical model that can be employed to examine the efficiency of a practical method proposed in this study to mitigate the progressive collapse of floor systems under removed column. In addition, compared with the test vertical load-displacement behaviors, the numerically predicted curves showed good consistency, in both the compressive arch action and tensile catenary action zones, which demonstrates a noticeable accuracy of the developed 3D model to simulate the behavior of the test systems with and without slabs. Moreover, regarding specimen 3D in FIG. 4A the test peak load and its numerical counterpart in the arch action zone, and the ultimate load at failure and its numerical counterpart in the catenary action zone are 37.5 and 36.6 kN, and 52.2 and 55.4 kN, respectively, evidencing a discrepancy of 2.4% and 6.1%, respectively. The maximum test and numerical vertical displacements are 339.7 and 325.5 mm, respectively, demonstrating an error of 4.2%.

Figure 4A:
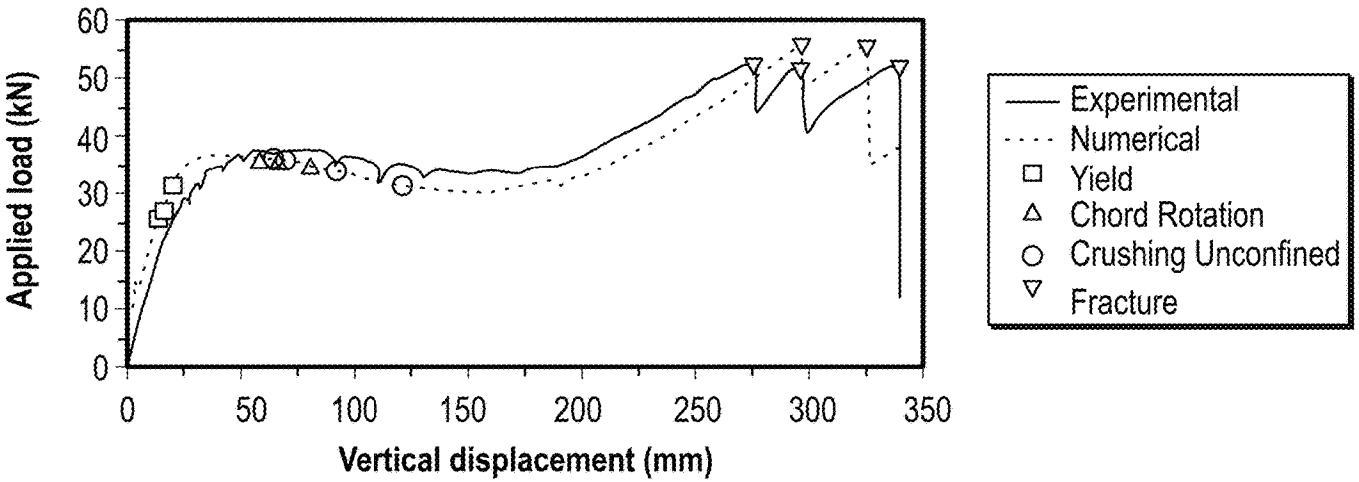
FIGS. 4A-4E shows graphical representations of validation of the 3D numerical simulations with test results, in accordance with the present invention.
Figure 4B:
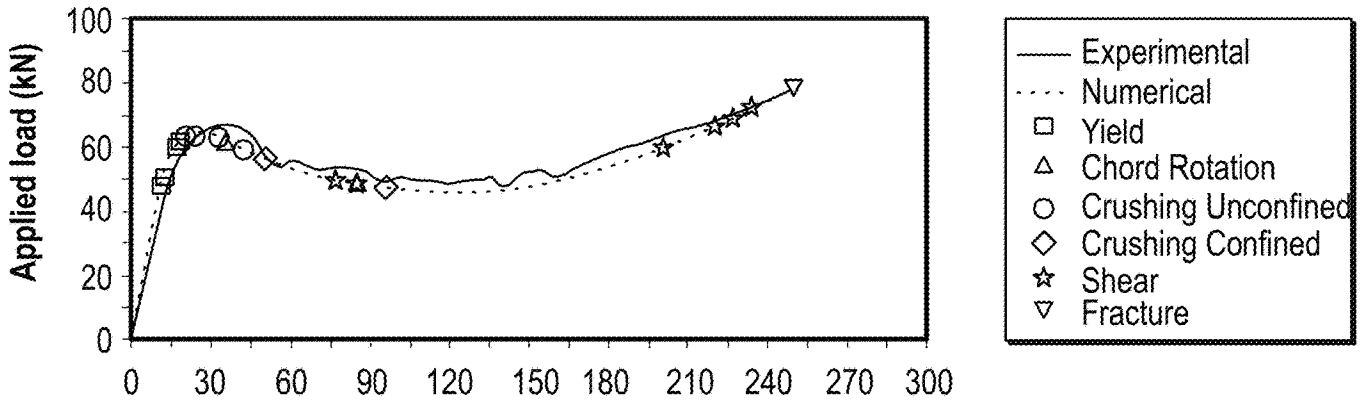
Figure 4C:
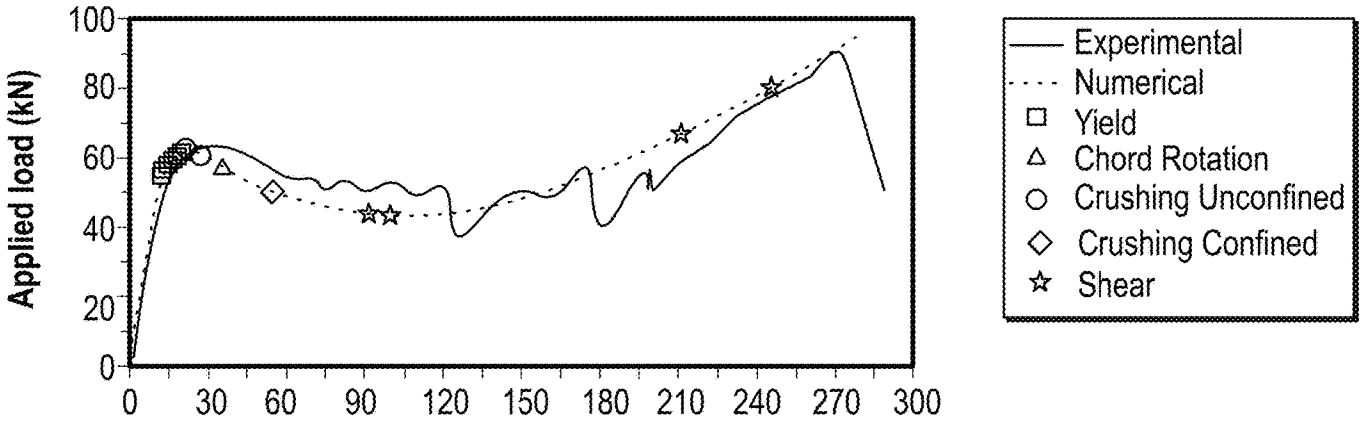
Figure 4D:
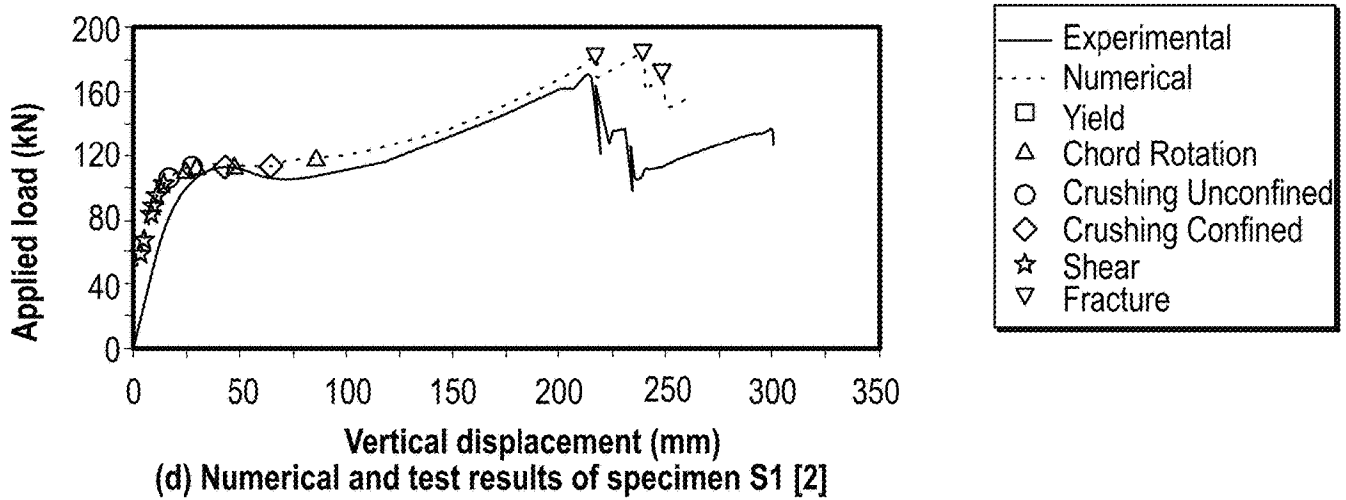
Figure 4E:
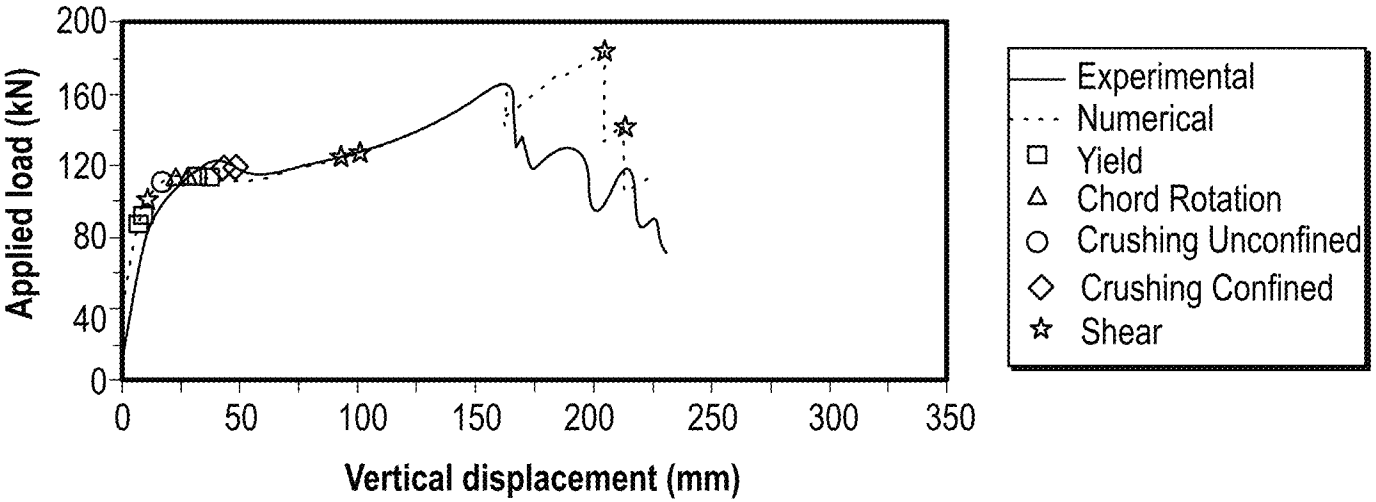

Concerning specimen T1 in FIG. 4B the peak load and its numerical counterpart of the compression arch action zone, and the ultimate load at failure and its numerical counterpart in the tension catenary action are 66.2 and 64.3 kN, and 78 and 78 kN, respectively, evidencing a discrepancy of 2.9% and 0%, respectively. The maximum test and numerical vertical displacements are the same with a value of 249.6 mm, with zero error. Similarly, specimen T2 in FIG. 4C reveals test and numerical peak loads in the arch action zone of 63.5 and 62.5 kN, respectively, showing 1.6% discrepancy while the test and numerical ultimate loads at failure in the arch action zone are 91.6 and 93.8 kN, respectively, demonstrating an error of 2.4%. The corresponding maximum test and numerical vertical displacements are 270.3 and 275.4 mm, respectively, with a difference of 1.9%. FIGS. 4D and 4E clearly show the effect of slab on the load-displacement behavior as it enhanced the capacities of the arch action and catenary action and reduced the maximum vertical displacements at failure of the systems with floor slabs as opposed to those with no slabs-FIGS. 4A-4C.

The enhancement in capacities and the reduction in maximum displacement are attributed to the tensile membrane action in the floor slab. FIGS. 4D and 4E also indicate that modeling the beams, as T-beams to include the effect of slab on the progressive collapse behavior of floor system is a viable model and suitably simulate the progressive collapse behavior. In FIG. 4D, specimen S1 established test and numerical peak loads in the arch action zone of 113.6 and 113.2 kN, respectively, showing 0.35% discrepancy while the test and numerical maximum/ultimate loads in the arch action zone are 168.0 and 184.9 kN, respectively, demonstrating an error of 10.1%. The maximum test and numerical vertical displacements at failure are 300.0 and 259.3 mm, respectively, with a difference of 13.6%. Equally, specimen S2 in FIG. 4E achieved test and numerical peak loads in the arch action zone of 123.1 and 114.1 kN, respectively, showing 7.3% change while the test and numerical maximum/ultimate loads the arch action zone are 166.6 and 183.6 kN, respectively, representing an error of 10.2%. The maximum test and numerical vertical displacements at failure are 228.9 and 223.3 mm, respectively, with a difference of 2.5%.

Overall, the developed 3D nonlinear numerical model effectively captures the important capacity parameters (peak load in the arch action zone and ultimate load in the catenary action zone) and the maximum vertical displacement at the location of the failed column of the considered 3D benchmark test specimens. Furthermore, the 3D model correctly simulates the behaviour and trend of the test vertical load-displacement curves of the 3D test specimens and shows good consistency, both in the compressive arch action zone and in the tensile catenary action zone. However, at transitional vertical displacement values, the test behaviour curves show significantly more pronounced drops in strength, whereas their numerically predicted counterparts show smoother behaviour curves. This could be attributed to the adopted uniaxial nonlinear material models, which cannot capture material scattering and changeability at these displacement values.

Figure 5A:
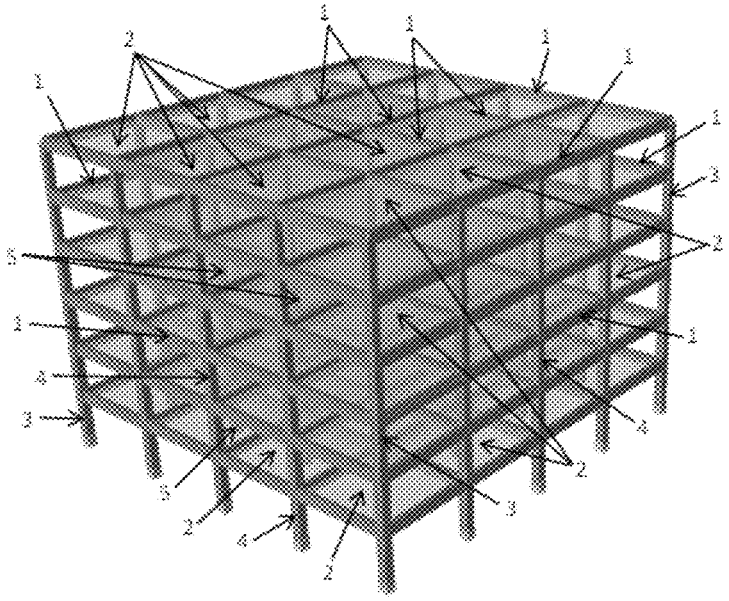
FIG. 5A illustrates a prospective view of a reinforced concrete frame building with multi-floors where the mitigating method is applied, along with a reinforced concrete frame building with failed interior reinforced concrete column (failed column may be on the reinforced concrete floor shown or on any other reinforced concrete floor of the reinforced concrete frame building).
Figure 5B:
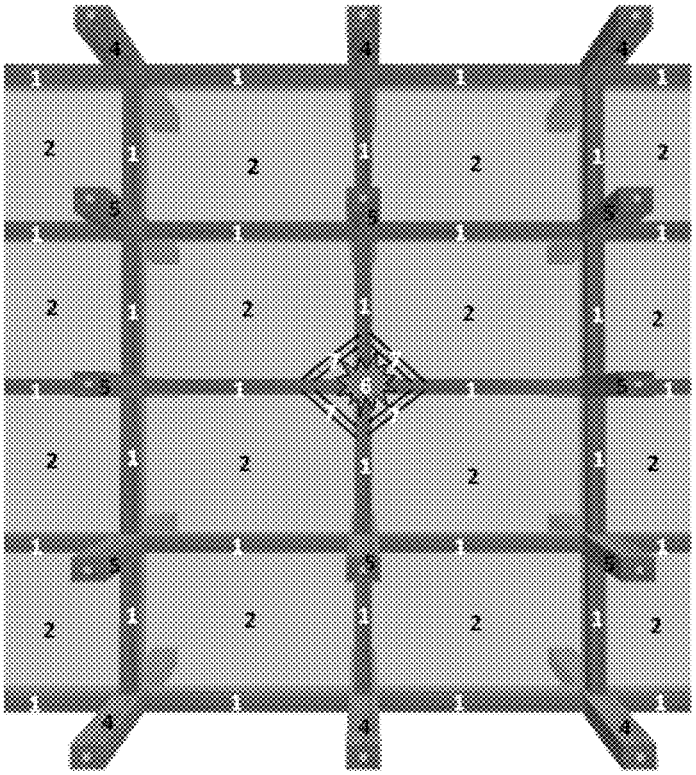
FIG. 5B shows a bottom plan view of reinforced concrete floor system with mitigating method (top and bottom diagonal steel bars within thickness of each reinforced concrete slab panel) around potentially failed reinforced concrete column.
Figure 5C:
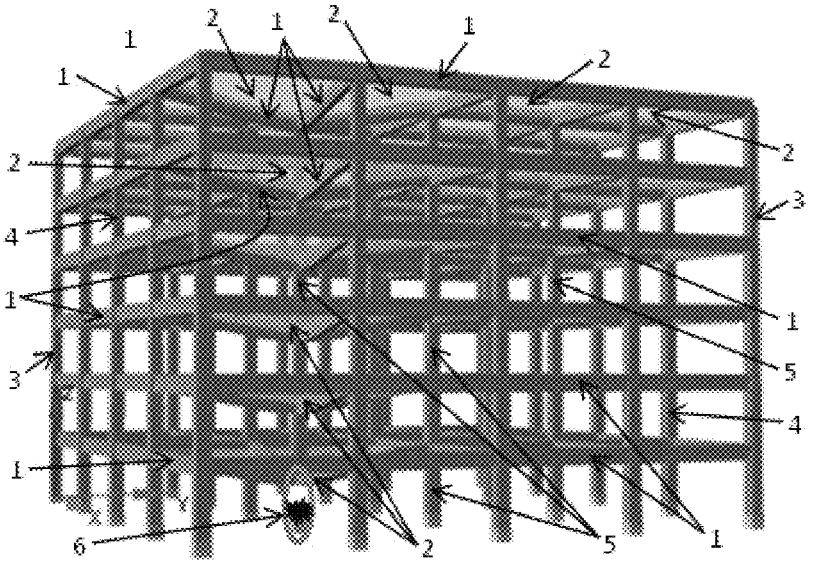
FIG. 5C illustrates a perspective view of the reinforced concrete frame building as in FIG. 5A.

The method proposed in accordance with the present invention is to mitigate progressive collapse potential of 3D RC framed structure due to column removal. This method applies primarily to the floor system of the RC framed structures. A typical framed structure and its floor system with location of a potential failed column are shown in FIGS. 5A-5C before the application of the proposed mitigation method. One key feature of the proposed mitigating method is that it requires minimum amount of material, does not require skilled labors, and does not contradict with existing architectural requirements. A second key feature is its responsive accommodation of large vertical displacements.

FIG. 5A shows a reinforced concrete frame building with multi-floors where the mitigating method is applied, along with a reinforced concrete frame building with failed interior reinforced concrete column (failed column may be on the reinforced concrete floor shown or on any other reinforced concrete floor of the reinforced concrete frame building).

FIG. 5B shows a plan view, looking up, of reinforced concrete floor system with mitigating method (top and bottom diagonal steel bars within thickness of each reinforced concrete slab panel) around potentially failed reinforced concrete column. The numeric denotations (1-7) represent the following:

1—Floor beam (reinforced concrete); also known as orthogonal beams

2—Slab panel (reinforced concrete)

3—Corner column (reinforced concrete)

4—Edge column (reinforced concrete)

5—Interior column (reinforced concrete)

6—Potentially failed column (reinforced concrete); could be on any floor in the building

7—Mitigating method: links-additional top and bottom diagonal steel bars placed during construction within reinforced concrete slab thickness in each reinforced concrete slab panel around potentially failed reinforced concrete interior column (could be any interior column).

Figure 6A:
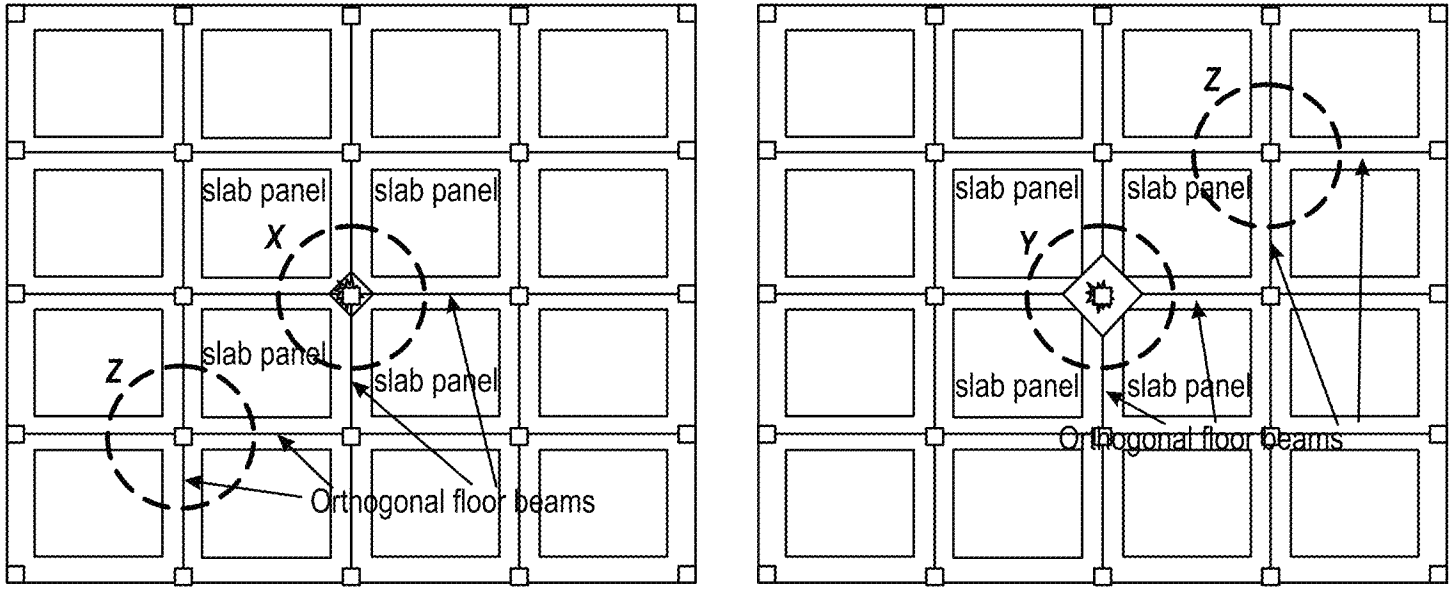
FIG. 6 shows the proposed method comprised of adding diagonal top and bottom reinforcing bars in the floor slab panels around the potential failed column. Two arrangements for adding the diagonal top and bottom bars around the potential failed column are considered, single links and double links as shown in FIGS. 6A-6B and 6E.
Figure 6C:
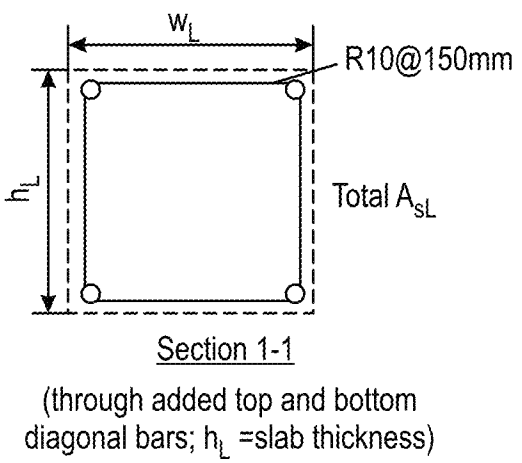
Figure 6B:
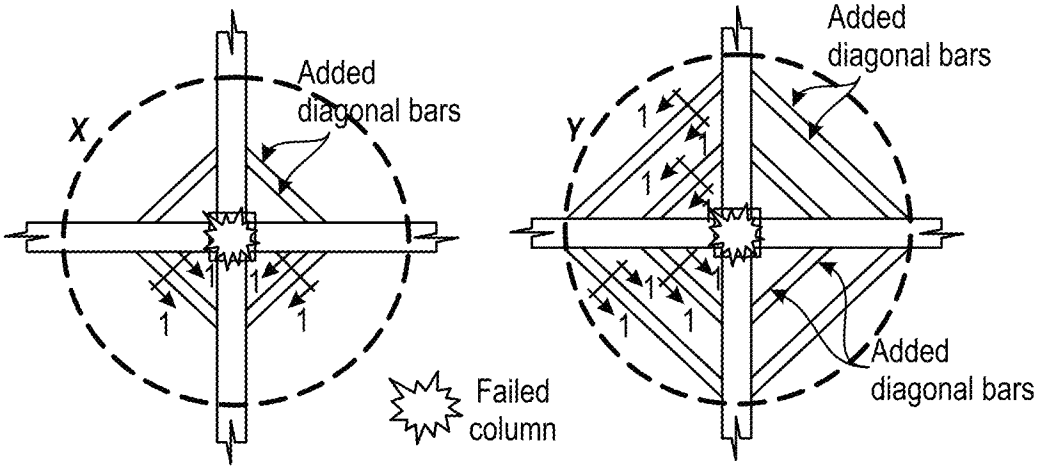
Figures 6D, 6E:
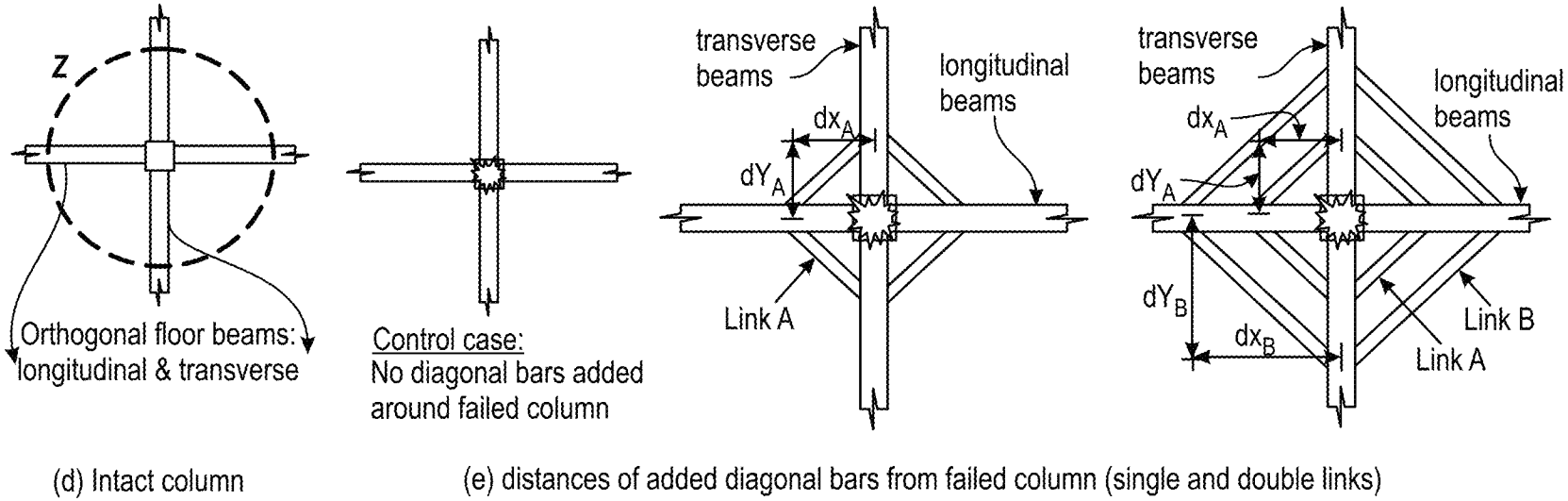

The proposed mitigating method is based on the concept of developing self-generated "post-tensioning" compressive force within segments of the beams that bridge over the column when it fails. The self-generated "post-tensioning" compressive force may also be regarded as an additional horizontal "restraining" force that increases the axial compressive forces within the segments of beams bridging over the failed column. This method may be applied to one or more potential failed columns on the same floor or on different floors. It and can also be applied to all columns on the same floor and on all floors of the framed structure. To achieve this goal of developing self-generated "post-tensioning" compressive force in the beams, the proposed method is comprised of adding diagonal top and bottom reinforcing bars in the floor slab panels around the potential failed column as shown in FIGS. 6A-6E (depicting the proposed mitigating method and arrangement of the added diagonal steel bars in the floor around the failed column). The role of the added diagonal bars is to connect the orthogonal floor beams around the potential failed column together and to act as links/ties between the beams when the column fails. Development length is maintained to ensure adequate anchorage between the added bars and floor beams. Since the structural system in the vicinity of the failed column houses the largest deformations, the added diagonal top and bottom steel bars should be located close to and around the failed column to be effective. Two arrangements for adding the diagonal top and bottom bars around the potential failed column are considered, single links and double links as shown in FIGS. 6A-6Bb and 6E. Due to relative vertical displacement between the orthogonal floor beams between the two ends of the diagonal bars connected to these beams, the diagonal bars in each slab panel behave as links/ties that push on the floor beams at the location of the connection causing generation of axial compressive forces within the beam segments confined by the diagonal steel bars placed around the failed column.

The proposed mitigating method applies to floor systems in framed structures. To examine the efficiency of the proposed mitigating method, a 6-story 3-D RC framed structure is considered, with the middle/central column being the potential failed column, and various configurations of the added steel bars around the failed column were accounted for. The structure is made up of four longitudinal bays measuring 6 m center-to-center and four transverse bays measuring 5 m center-to-center. The height of each floor is 3 m and the floors are made up of two-way slab systems.

The effective flange widths of the transversal/cross and longitudinal beams are 1250 and 1500 respectively. All columns of the frame structure are 400×400 mm square sections. The thickness of the floor slabs is 150 mm and all beams have an overall depth and web width of 600 and 250 mm respectively. In addition to the self-weight of the slabs, beams and columns used in the design, the gravity loads included a superimposed dead load of 2 kN/m2, a wall load of 7.2 kN/m and a live load of 1.92 kN/m2 for residential buildings according to ASCE 7-22. The column size and reinforcement were kept identical on all floors, and similarly all the beams had the same size and reinforcement, in order to eliminate the column and beam effects on the progressive collapse behaviour of the mitigated floor system when investigating the efficiency of the proposed mitigation method.

To numerically investigate the efficiency of the proposed mitigating method, the developed and validated 3D nonlinear numerical model using SeismoStruct software was used. Each link of added diagonal reinforcing bars in the floor around the failed column was modeled as RC frame element with a section height (hL) equals to the slab thickness while the width (wL) of the element was initially taken equal to the slab thickness and slightly increased, when needed, to keep the ratio of the added reinforcing steel less than 4%, as shown in FIG. 6C. The following various configurations were considered in the investigation of the efficiency of the proposed mitigating method. Total area of the added diagonal reinforcing bars in the link, $A_{sL}$, FIG. 6C, distances from removed column to ends of each link of diagonal added bars, FIG. 6E, orientation of diagonal links, i.e. $dx_A \neq dy_A$ and dxB≠dyB and arrangement of added bars, single and double links, FIGS. 6A-6B and 6E.

| | | | Link Position (FIG. 5E) | | | | Link(s) Cross-sectional Dimension (FIG. 5C) | | |
|---|---|---|---|---|---|---|---|---|---|
| | | | Link A | | Link B | | | | Area of Steel, $A_{sL}$ in |
| # | Links * (FIG. 5e) | Link | $dx_A$ (m) | $dy_A$ (m) | $dx_B$ (m) | $dy_B$ (m) | Width, $W_L$ mm) | Height, $h_L$ mm) | $mm^2$ - (ratio of gross area) - number of bars |
| 1 | SL 0.75-0.75-284 | SL | 0.75 | 0.75 | — | — | 150 | 150 | 284-(1.3%)-4#10 |
| 2 | SL 0.75-0.75-516 | SL | 0.75 | 0.75 | — | — | 150 | 150 | 516-(2.3%)-4#13 |
| 3 | SL 0.75-0.75-774 | SL | 0.75 | 0.75 | — | — | 300 | 150 | 774-(1.7%)-6#13 |
| 4 | SL 0.75-0.75-1136 | SL | 0.75 | 0.75 | — | — | 150 | 150 | 1136-(5.0%)-4#19 |
| 5 | SL 0.75-0.75-1704 | SL | 0.75 | 0.75 | — | — | 300 | 150 | 1704-(3.8%)-6#19 |
| 6 | SL 0.75-0.75-2322 | SL | 0.75 | 0.75 | — | — | 300 | 150 | 2322-(5.2%)-6#22 |
| 7 | SL 1.00-1.00-284 | SL | 1.00 | 1.00 | — | — | 150 | 150 | 284-(1.3%)-4#10 |
| 8 | SL 1.00-1.00-516 | SL | 1.00 | 1.00 | — | — | 150 | 150 | 516-(2.3%)-4#13 |
| 9 | SL 1.00-1.00-774 | SL | 1.00 | 1.00 | — | — | 300 | 150 | 774-(1.7%)-6#13 |
| 10 | SL 1.00-1.00-1136 | SL | 1.00 | 1.00 | — | — | 150 | 150 | 1136-(5.0%)-4#19 |
| 11 | SL 1.00-1.00-1704 | SL | 1.00 | 1.00 | — | — | 300 | 150 | 1704-(3.8%)-6#19 |
| 12 | SL 1.00-1.00-2322 | SL | 1.00 | 1.00 | — | — | 300 | 150 | 2322-(5.2%)-6#22 |
| 13 | SL 1.25-1.25-284 | SL | 1.25 | 1.25 | — | — | 150 | 150 | 284-(1.3%)-4#10 |
| 14 | SL 1.25-1.25-516 | SL | 1.25 | 1.25 | — | — | 150 | 150 | 516-(2.3%)-4#13 |
| 15 | SL 1.25-1.25-774 | SL | 1.25 | 1.25 | — | — | 300 | 150 | 774-(1.7%)-6#13 |
| 16 | SL 1.25-1.25-1136 | SL | 1.25 | 1.25 | — | — | 150 | 150 | 1136-(5.0%)-4#19 |
| 17 | SL 1.25-1.25-1704 | SL | 1.25 | 1.25 | — | — | 300 | 150 | 1704-(3.8%)-6#19 |
| 18 | SL 1.25-1.25-2322 | SL | 1.25 | 1.25 | — | — | 300 | 150 | 2322-(5.2%)-6#22 |
| 19 | SL 0.75-1.25-284 | SL | 0.75 | 1.25 | — | — | 150 | 150 | 284-(1.3%)-4#10 |
| 20 | SL 0.75-1.25-516 | SL | 0.75 | 1.25 | — | — | 150 | 150 | 516-(2.3%)-4#13 |
| 21 | SL 0.75-1.25-774 | SL | 0.75 | 1.25 | — | — | 300 | 150 | 774-(1.7%)-6#13 |
| 22 | SL 0.75-1.25-1136 | SL | 0.75 | 1.25 | — | — | 150 | 150 | 1136-(5.0%)-4#19 |
| 23 | SL 0.75-1.25-1704 | SL | 0.75 | 1.25 | — | — | 300 | 150 | 1704-(3.8%)-6#19 |
| 24 | SL 0.75-1.25-2322 | SL | 0.75 | 1.25 | — | — | 300 | 150 | 2322-(5.2%)-6#22 |
| 25 | SL 1.25-0.75-284 | SL | 1.25 | 0.75 | — | — | 150 | 150 | 284-(1.3%)-4#10 |
| 26 | SL 1.25-0.75-516 | SL | 1.25 | 0.75 | — | — | 150 | 150 | 516-(2.3%)-4#13 |
| 27 | SL 1.25-0.75-774 | SL | 1.25 | 0.75 | — | — | 300 | 150 | 774-(1.7%)-6#13 |
| 28 | SL 1.25-0.75-1136 | SL | 1.25 | 0.75 | — | — | 150 | 150 | 1136-(5.0%)-4#19 |
| 29 | SL 1.25-0.75-1704 | SL | 1.25 | 0.75 | — | — | 300 | 150 | 1704-(3.8%)-6#19 |
| 30 | SL 1.25-0.75-2322 | SL | 1.25 | 0.75 | — | — | 300 | 150 | 2322-(5.2%)-6#22 |
| 31 | DL 0.75&1.25-284 | DL | 0.75 | 0.75 | 1.25 | 1.25 | 150 | 150 | 284-(1.3%)-4#10 |
| 32 | DL 0.75&1.25-516 | DL | 0.75 | 0.75 | 1.25 | 1.25 | 150 | 150 | 516-(2.3%)-4#13 |
| 33 | DL 0.75&1.25-774 | DL | 0.75 | 0.75 | 1.25 | 1.25 | 300 | 150 | 774-(1.7%)-6#13 |
| 34 | DL 0.75&1.25-1136 | DL | 0.75 | 0.75 | 1.25 | 1.25 | 150 | 150 | 1136-(5.0%)-4#19 |
| 35 | DL 0.75&1.25-1704 | DL | 0.75 | 0.75 | 1.25 | 1.25 | 300 | 150 | 1704-(3.8%)-6#19 |
| 36 | DL 0.75&1.25-2322 | DL | 0.75 | 0.75 | 1.25 | 1.25 | 300 | 150 | 2322-(5.2%)-6#22 |
| 37 | DL 1.00&1.50-284 | DL | 1.00 | 1.00 | 1.50 | 1.50 | 150 | 150 | 284-(1.3%)-4310 |
| 38 | DL 1.00&1.50-516 | DL | 1.00 | 1.00 | 1.50 | 1.50 | 150 | 150 | 516-(2.3%)-4#13 |
| 39 | DL 1.00&1.50-774 | DL | 1.00 | 1.00 | 1.50 | 1.50 | 300 | 150 | 774-(1.7%)-6#13 |
| 40 | DL 1.00&1.50-1136 | DL | 1.00 | 1.00 | 1.50 | 1.50 | 150 | 150 | 1136-(5.0%)-4#19 |
| 41 | DL 1.00&1.50-1704 | DL | 1.00 | 1.00 | 1.50 | 1.50 | 300 | 150 | 1704-(3.8%)-6#19 |
| 42 | DL 1.00&1.50-2322 | DL | 1.00 | 1.00 | 1.50 | 1.50 | 300 | 150 | 2322-(5.2%)-6#22 |
| 43 | DL 1.25&1.75-284 | DL | 1.25 | 1.25 | 1.75 | 1.75 | 150 | 150 | 284-(1.3%)-4#10 |
| 44 | DL 1.25&1.75-516 | DL | 1.25 | 1.25 | 1.75 | 1.75 | 150 | 150 | 516-(2.3%)-4#13 |
| 45 | DL 1.25&1.75-774 | DL | 1.25 | 1.25 | 1.75 | 1.75 | 300 | 150 | 774-(1.7%)-6#13 |
| 46 | DL 1.25&1.75-1136 | DL | 1.25 | 1.25 | 1.75 | 1.75 | 150 | 150 | 1136-(5.0%)-4#19 |
| 47 | DL 1.25&1.75-1704 | DL | 1.25 | 1.25 | 1.75 | 1.75 | 300 | 150 | 1704-(3.8%)-6#19 |
| 48 | DL 1.25&1.75-2322 | DL | 1.25 | 1.25 | 1.75 | 1.75 | 300 | 150 | 2322-(5.2%)-6#22 |

* Single link (SL) A: SL dxA-dyA-AsL

Double links (DL) A and B: DL dxA-dyA-AsL and DL dxB-dyB-AsL

Table 1: Different Configurations of the Proposed Mitigating Method

Figure 7:
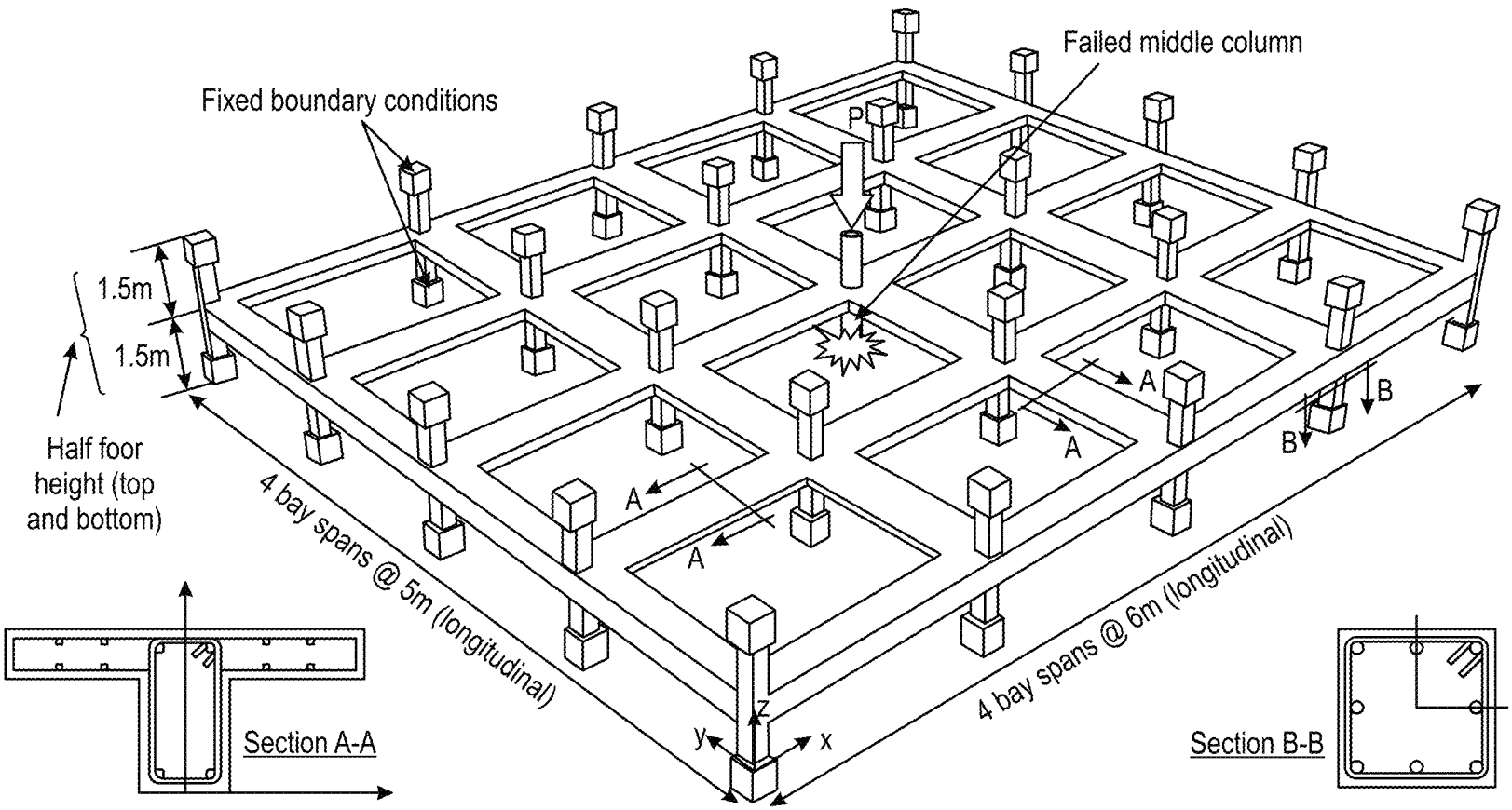
FIGS. 7 and 8A-8B show the 3D model of the floor system without mitigation (control floor) as well as the 3D models of the mitigated floor system with diagonal bar links.
Figure 8A:
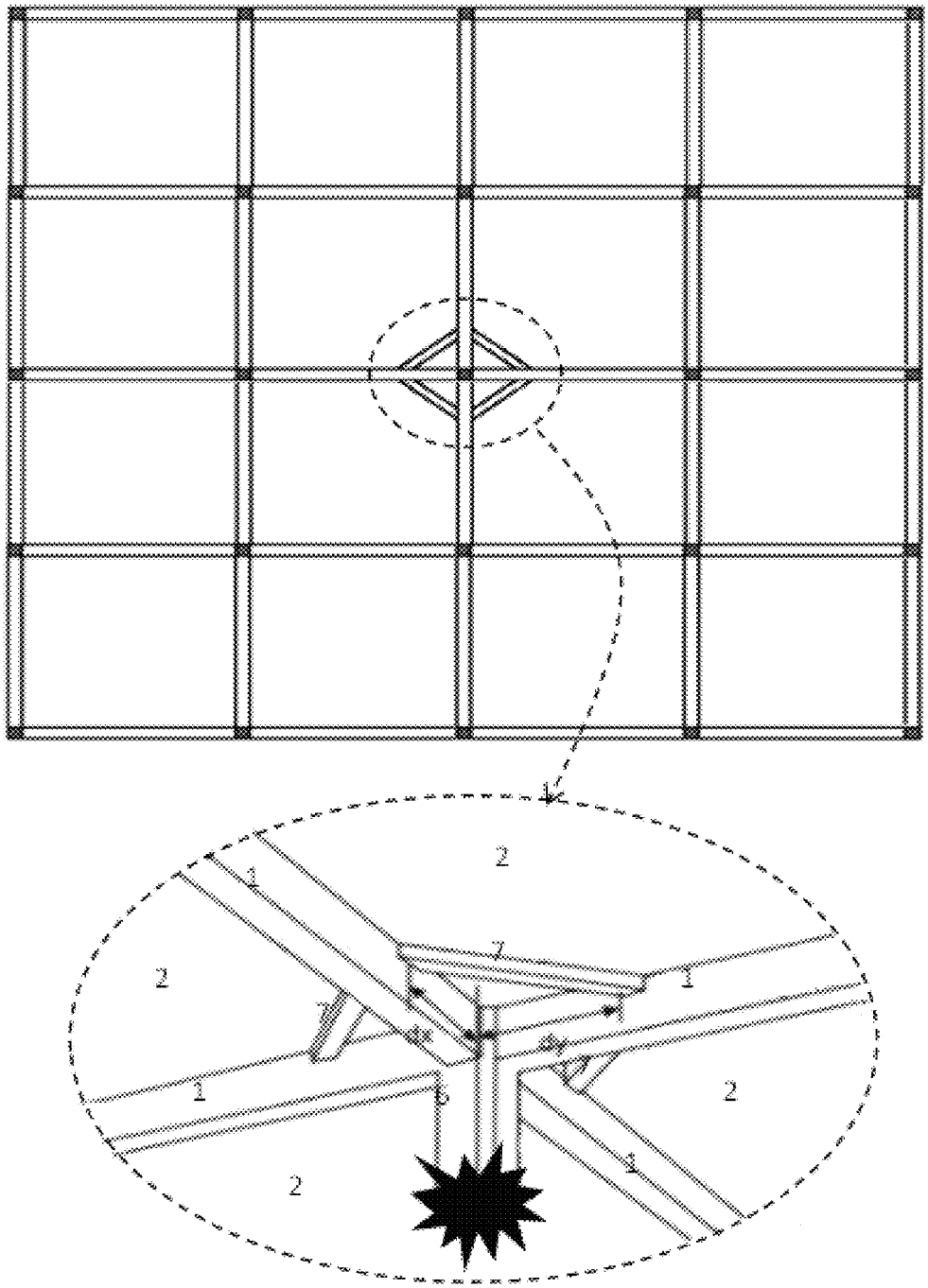
Figure 8B:
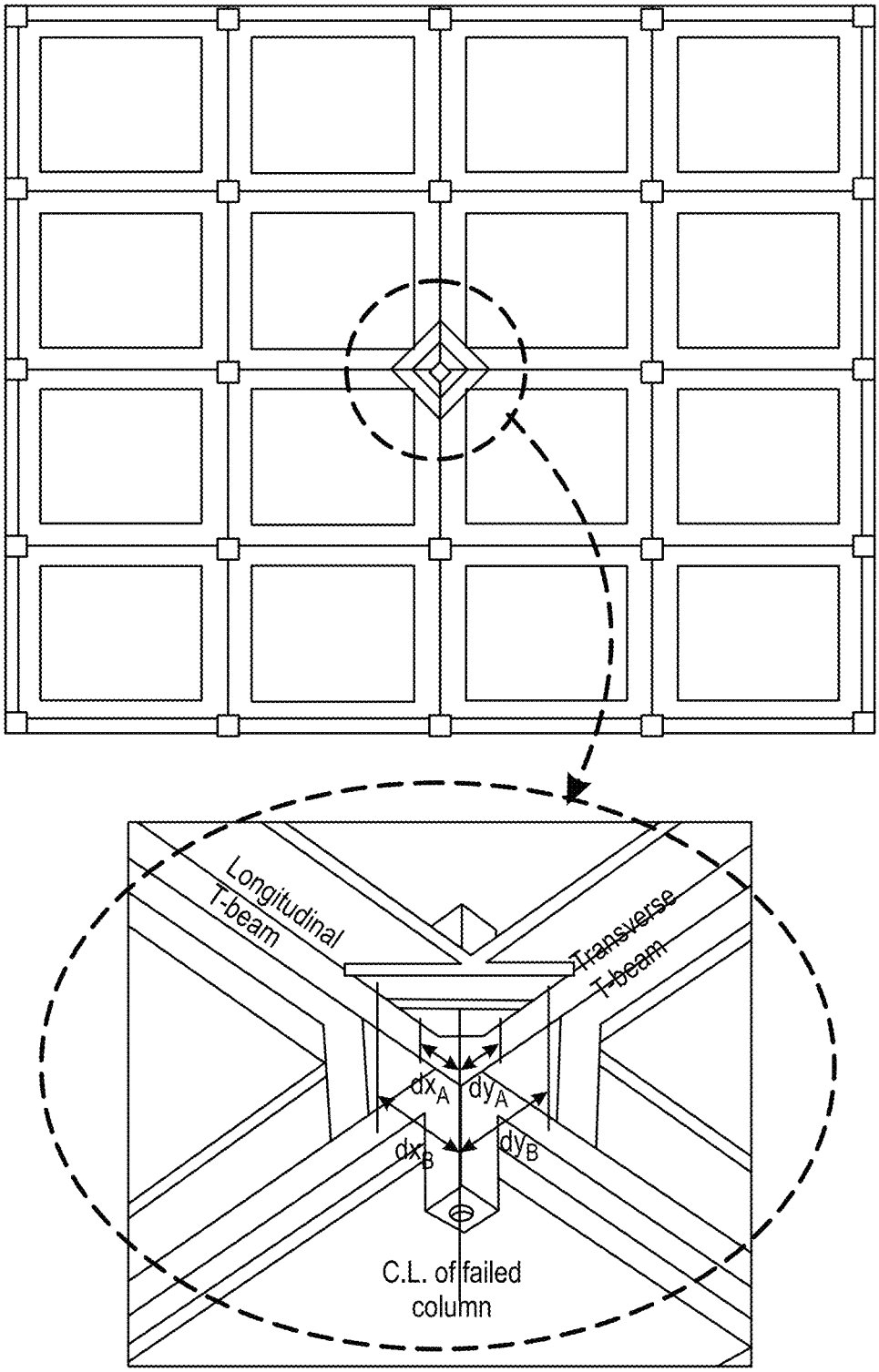

Since the thickness of the element is equal to the thickness of the slab, the link flexure stiffness is in turn small as opposed to its axial stiffness therefore, the link behaves as a tie. The 3D model of the floor system without mitigation (control floor) as well as the 3D models of the mitigated floor system with diagonal bar links are shown in FIG. 7 and FIGS. 8A-8B, respectively. The validated 3D numerical model was used to investigate the efficiency of the proposed mitigating method. Findings from analyses of control and mitigated floor systems in accordance with the present invention considered framed structures subjected to progressive collapse as a result of a middle/central column failure. For the examination of the numerical results, few key points on the vertical load-displacement curve and key areas under the curve are identified in FIG. 9.

FIGS. 10A-10H and FIGS. 11A-11D show various relationships relating to the control and mitigated floors generated by the 3D model using all mitigating member configurations (single and double members, location of members from the failed column and area of diagonal bars). The numerically developed vertical load-displacement curves at the failed column location for the control and mitigated floor systems are shown in FIGS. 10A-10H and FIGS. 11A-11D. The axial force in the longitudinal beam segment above the failed column is plotted against the vertical displacement at the column location for the control and mitigated floors in the same figures. Similarly, the axial force generated in the diagonally added members is plotted against the vertical displacement at the location of the failed column in these figures. The bending moment in the longitudinal member at the critical section above the failed column versus the vertical displacement relationships are also shown in FIGS. 9 and 10A-10H for both control and mitigated floors of the considered frame structure.

Overall, the vertical load-displacement curves in FIGS. 10A-10H and FIGS. 11A-11D for single and double links, respectively, clearly demonstrate that the proposed mitigating method improved the floor system behavior in terms of ductility and resistance to progressive collapse and confirms the efficiency of the proposed mitigating method. Depending on the configuration of the added diagonal steel bars, different improvements to the behavior of the mitigated floor system were achieved. The first peak load (flexure action), $P_f$, and low peak load (at bottom of softening curve of the arch action), $P_t$, of the mitigated floor system displayed moderate increase as the steel area in the diagonal links increased, while more pronounced improvement to the catenary action maximum capacity, $P_c$, was observed. The sudden drops in the load capacity with the softening curve are due to tension bar fractures. Depending on the mitigating link configuration, capacity of some mitigated floor systems at failure, $P_{fa}$, was less than the maximum catenary action capacity. Overall, the mitigated floors showed a good extension of ductility.

Figure 9:
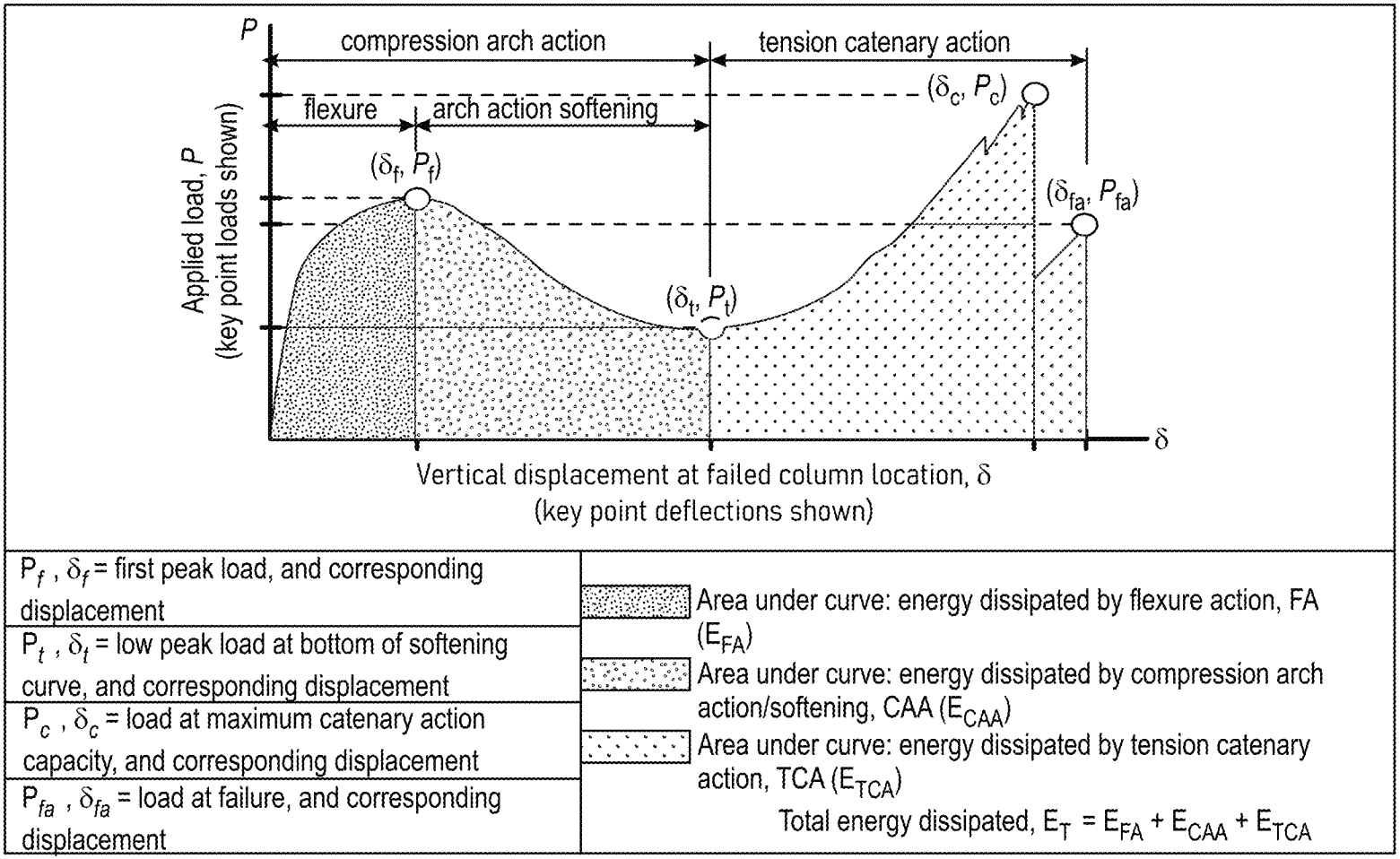
FIG. 9 graphically displays key points on a general vertical load-displacement curve and key areas under the curve, in accordance with the present invention.
Figure 10A:
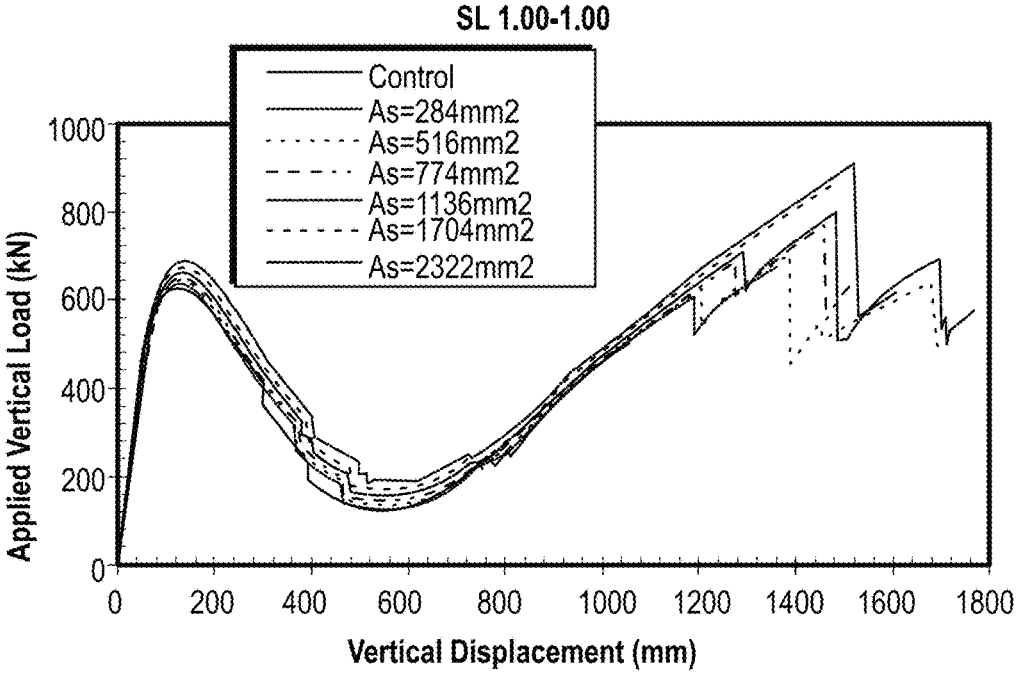
FIGS. 10A-10H and FIGS. 11A-11D show various relations related to the control and mitigated floors produced by the 3D model using all mitigating link configurations (single and double links, location of links from failed column, and area of diagonal steel bars).
Figure 10B:
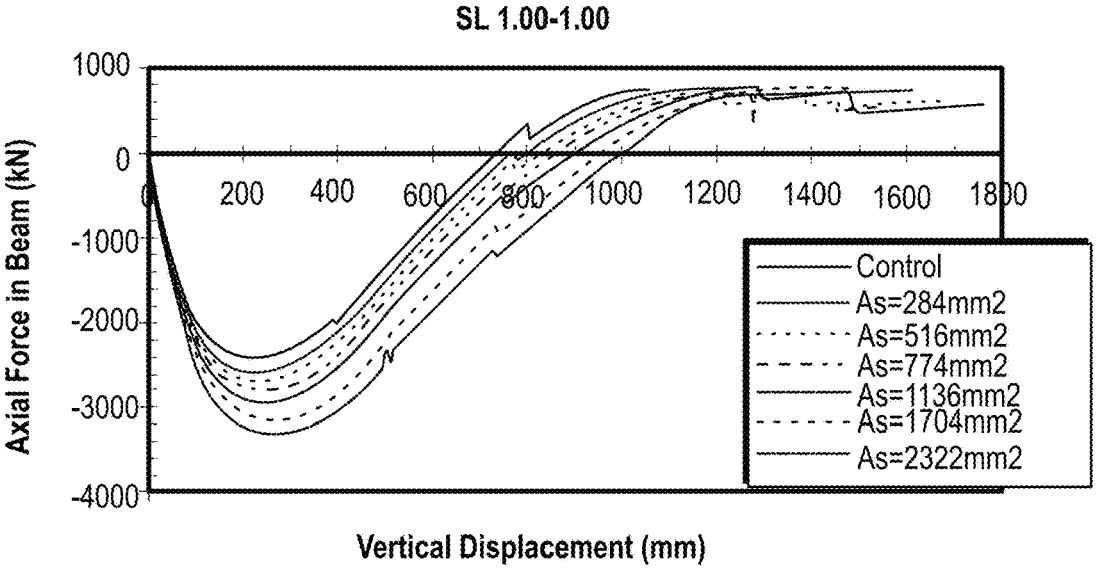
Figure 10C:
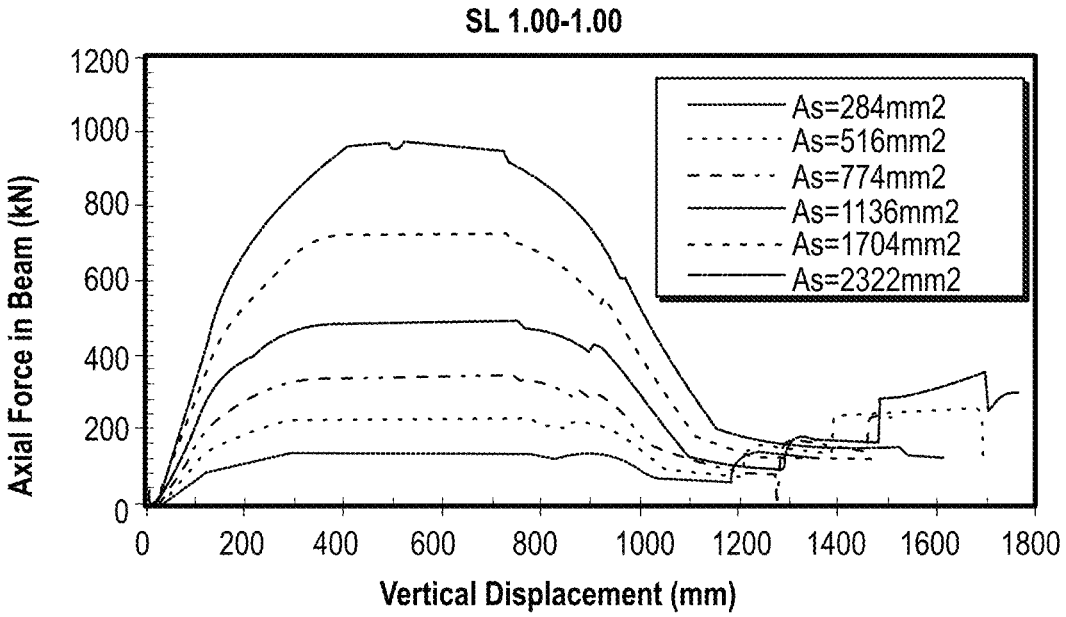
Figure 10D:
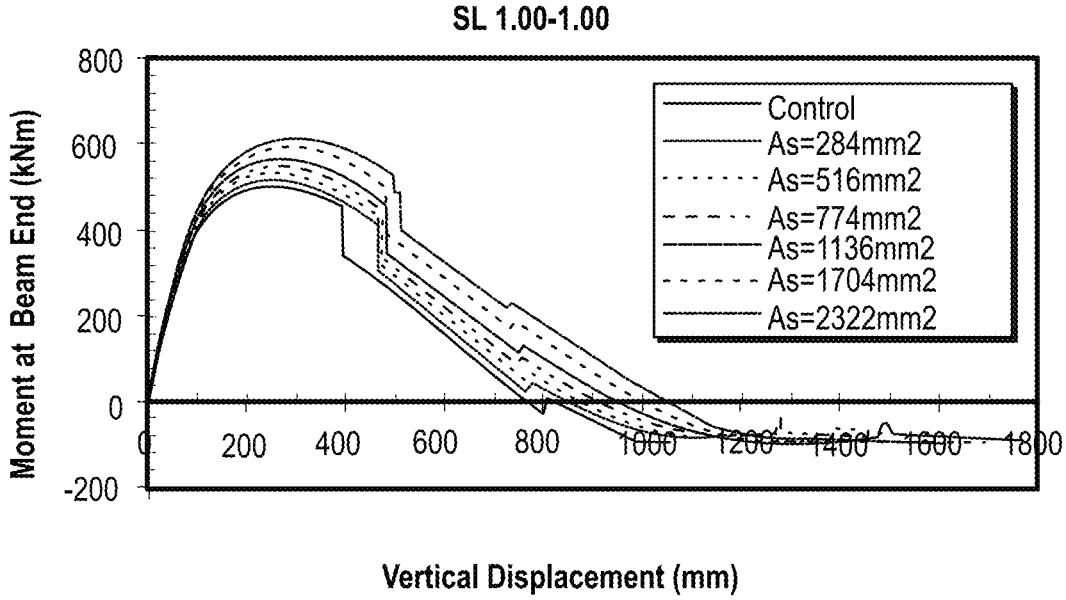
Figure 10E:
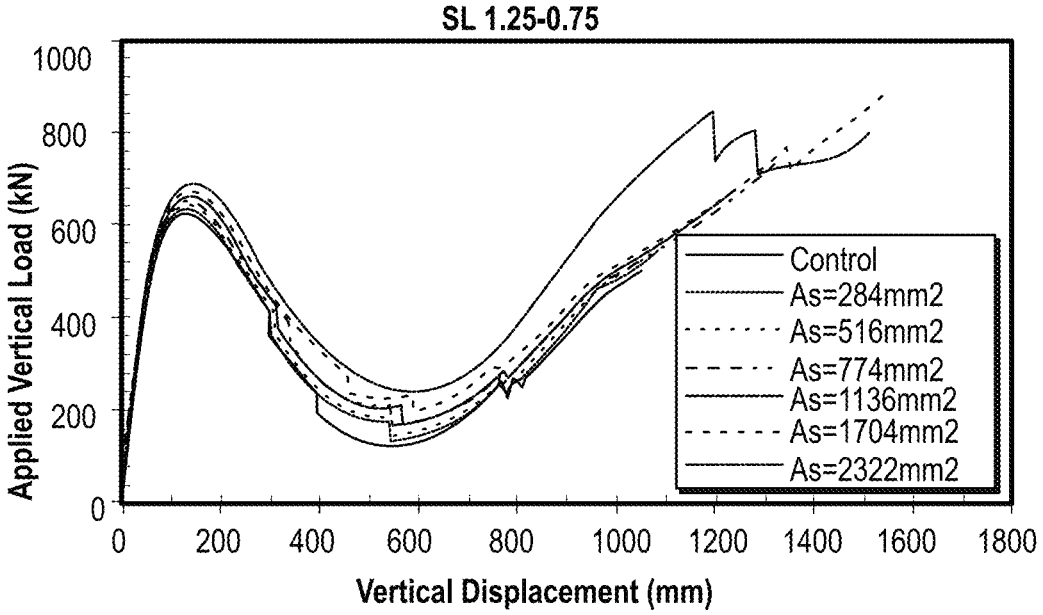
Figure 10F:
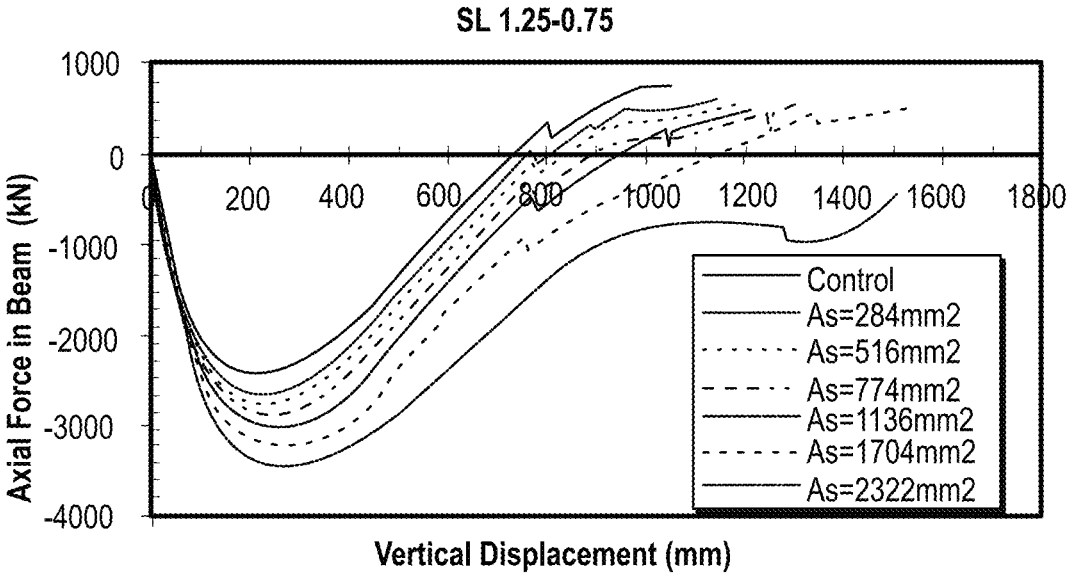
Figure 10G:
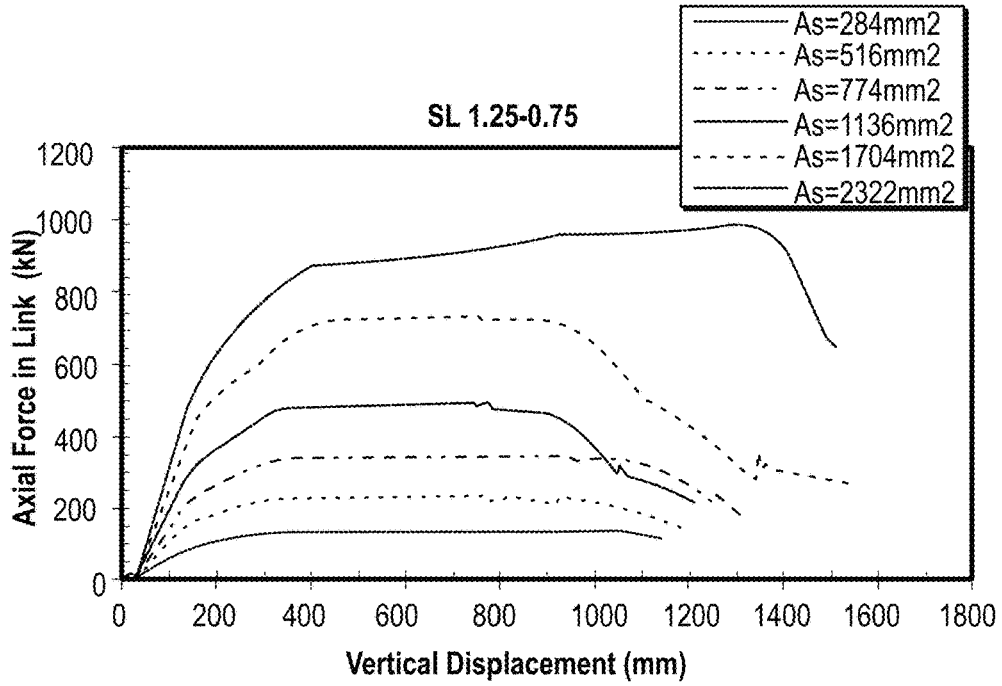
Figure 10H:
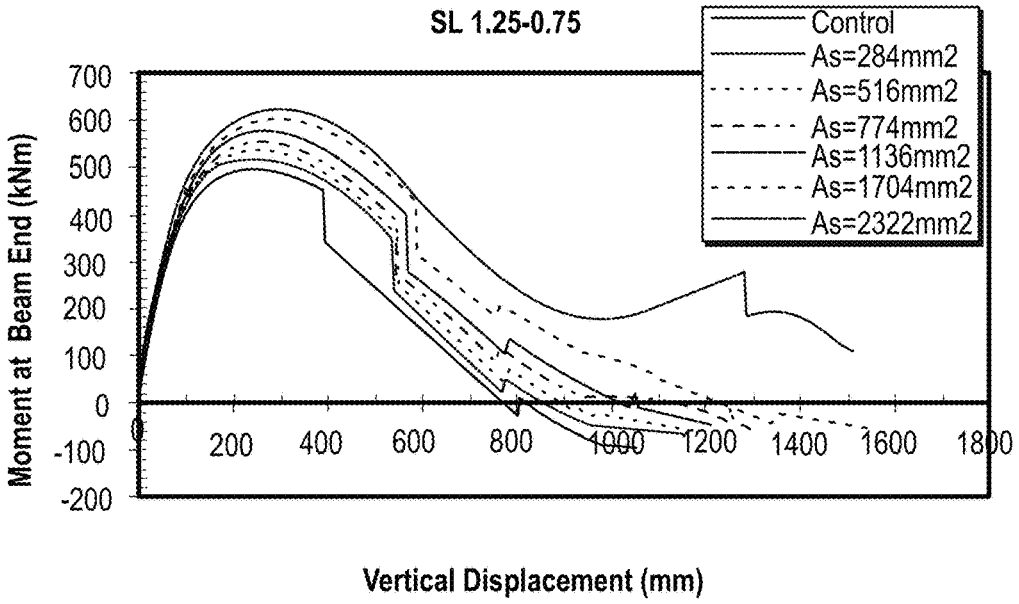
Figure 11A:
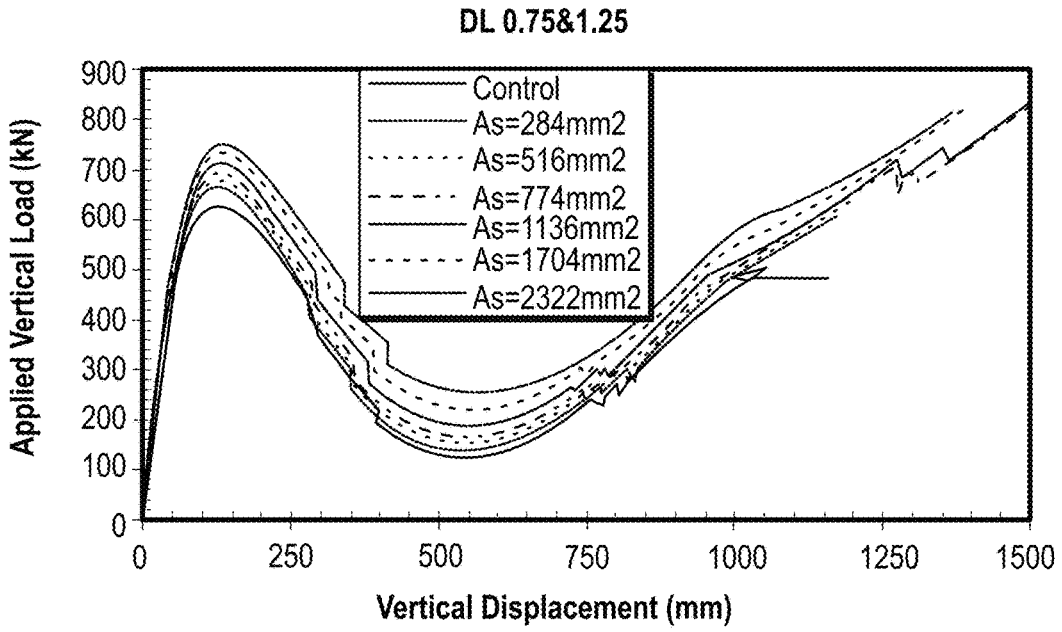
Figure 11B:
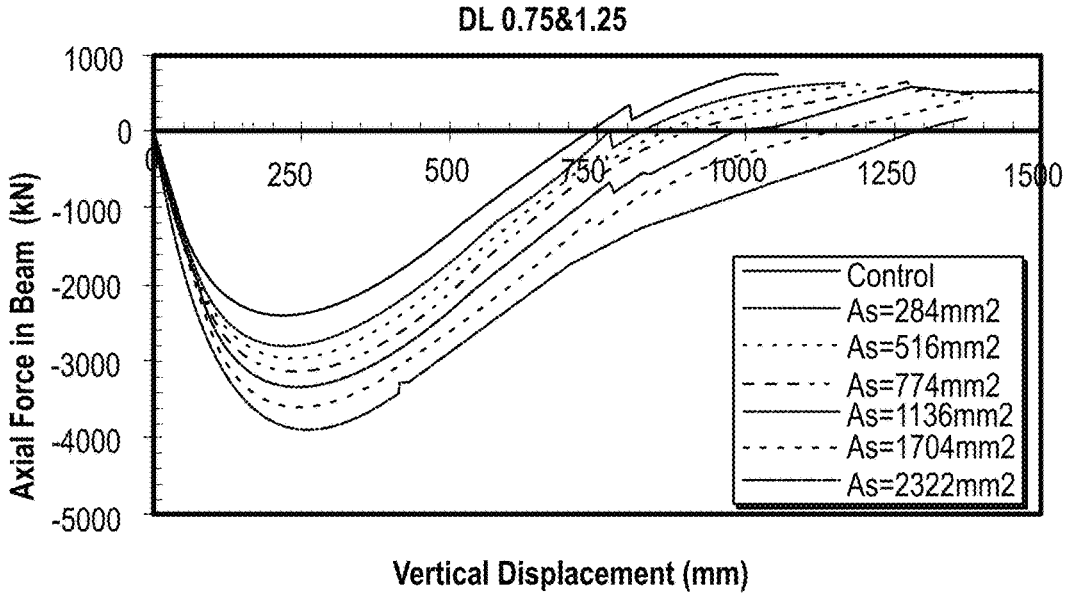
Figure 11C:
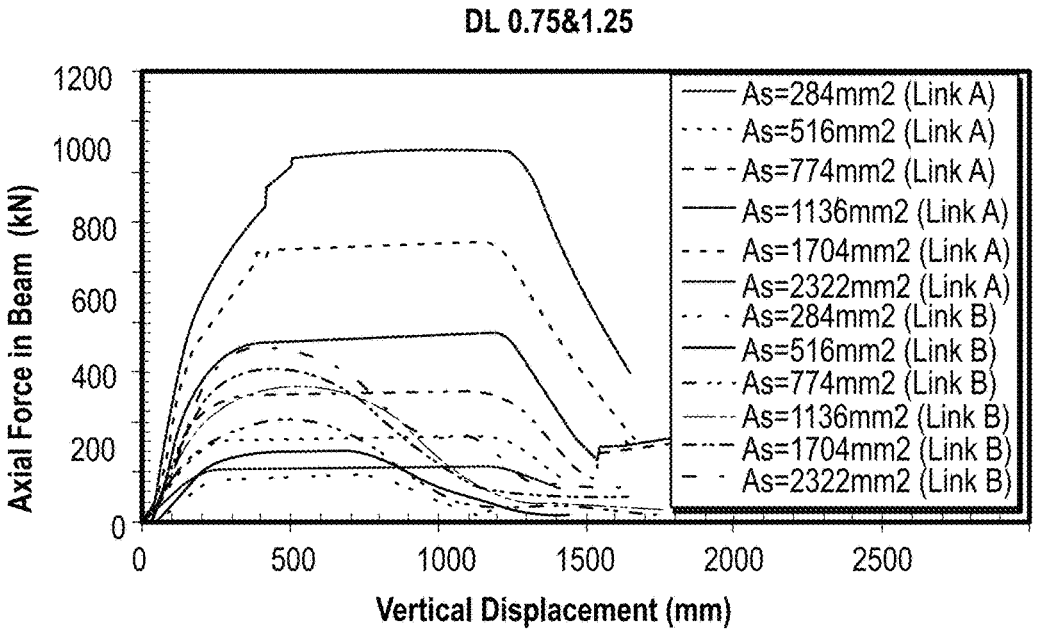
Figure 11D:
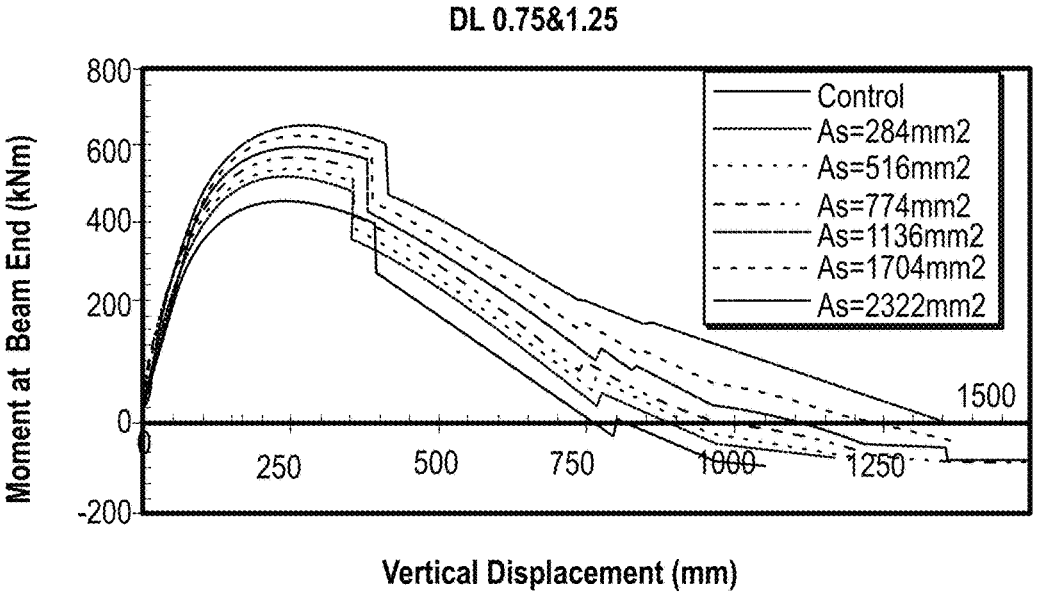

In FIGS. 10A-10H and FIGS. 11A-11D, the axial compressive force-displacement curves of the beams clearly show that the addition of the diagonal steel bar links, in any of the configurations considered, around the potentially failed column, increased the axial compressive forces of the beams at small displacements, which in turn affected the flexural strength of the beams. The increase in beam compressive forces in the mitigated floors is primarily attributed to the relative vertical displacement between the beams, which induced self-generated axial tensile forces in the links. Accordingly, the links can be considered as providing additional restraint to the horizontal movements of the beams. As shown in FIG. 9, the axial compressive force of the beams increased as the area of the diagonally added steel bars increased. The beam with the higher axial compression force had a higher first peak load and a higher low peak load (at the bottom of the curve of softening of the bow action). This is mainly due to the load-moment interaction. In addition, the axial compressive force-displacement curves show that a significant increase in vertical displacement was associated with the increase in axial compressive force of the beam. This increase resulted in a greater vertical displacement of the beam, which is a prerequisite for the development of the catenary action. Therefore, the beam with the higher axial compression force had a higher catenary action capacity. As the vertical displacement increased, the axial compressive force gradually decreased and the beam length increased until a change in geometry required a longer beam length to maintain compatibility; therefore, the axial compressive force of the beam changed to tensile force and the beam became a catenary. Therefore, it can be concluded that the increase in the beam's additional self-generated axial compressive force caused by the addition of diagonal bars around the failed column improved the overall progressive collapse resistance of the mitigated floor systems, however, its pronounced effect was manifested in increased ductility and higher catenary action capacity in the beams bridging the failed column.

The axial tensile force in the added diagonal member increased at low displacements as shown in FIGS. 10A-10H and FIGS. 11A-11D. This increase was due to the relative vertical displacement between the beams. As the displacement at the location of the failed column increased, the relative displacement between the beams was restrained by the beam axial compressive forces generated by the diagonally added links and eventually reduced to zero, at which point the force in the link became constant/flat, as shown by the flat stage of the link force-displacement curves. The length of the flat stage of the curves represents the vertical displacement that the critical section moved while the relative displacement between the beams remained at zero. This flat stage decreased as the area of diagonal added steel increased. As the vertical displacement continued to increase, the axial compressive forces on the beams changed to tensile forces, turning the beams into anchors and reducing the tensile forces in the members as they were no longer able to exert compressive forces on the beams. The beam length tends to increase as the column is removed. The constraints provided by the structure attempt to limit the beam elongation by an axial compressive force in the beam. In addition, the proposed mitigation method further moderately increases the axial compressive force of the beam under small vertical displacements at the critical section of the failed column, as shown in FIGS. 10A-10H and FIGS. 11A-11D.

This further increase in the beam axial compressive force had a pronounced effect on the beam bending moment at the critical section, as shown in FIGS. 10A-10H and FIGS. 11A-11D. The figures show general gradual trends of improvement in the mitigated beam bending moment capacity at the critical section for small vertical displacements, regardless of the mitigating member configurations. This is mainly due to the improvement in the beam axial compression force-moment interaction as the beam axial compression increases due to the addition of diagonal members. Therefore, mitigated beams with higher axial compression force showed higher moment capacity at the critical section. On the other hand, as the axial force decreased with increasing vertical displacement, the mitigated bending moment gradually decreased and generally changed to a small positive moment at large vertical displacements. The decrease in moment within the gradual decrease was due to the fracture of the tie rod with increasing displacements.

Figure 12A:
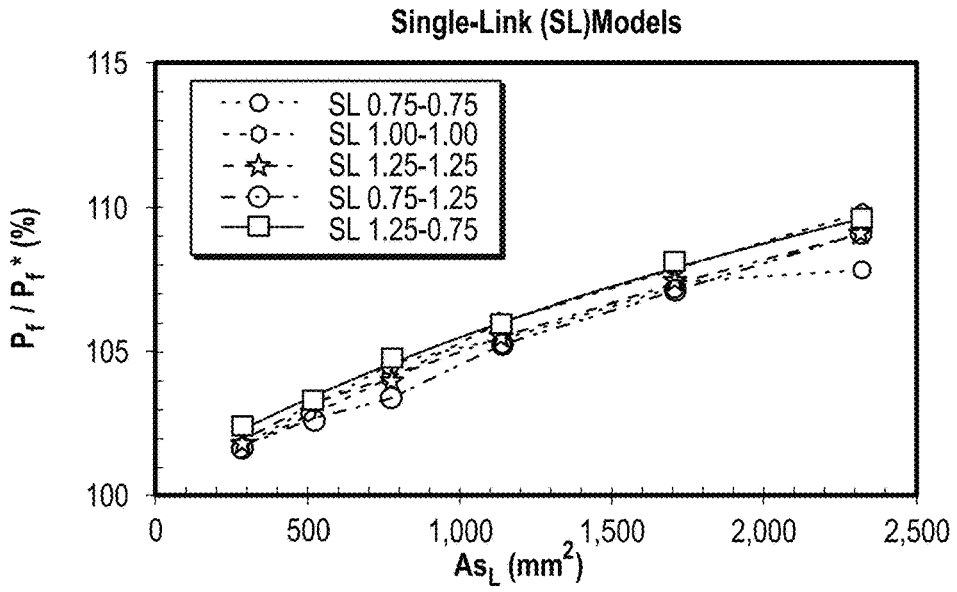
Figure 12B:
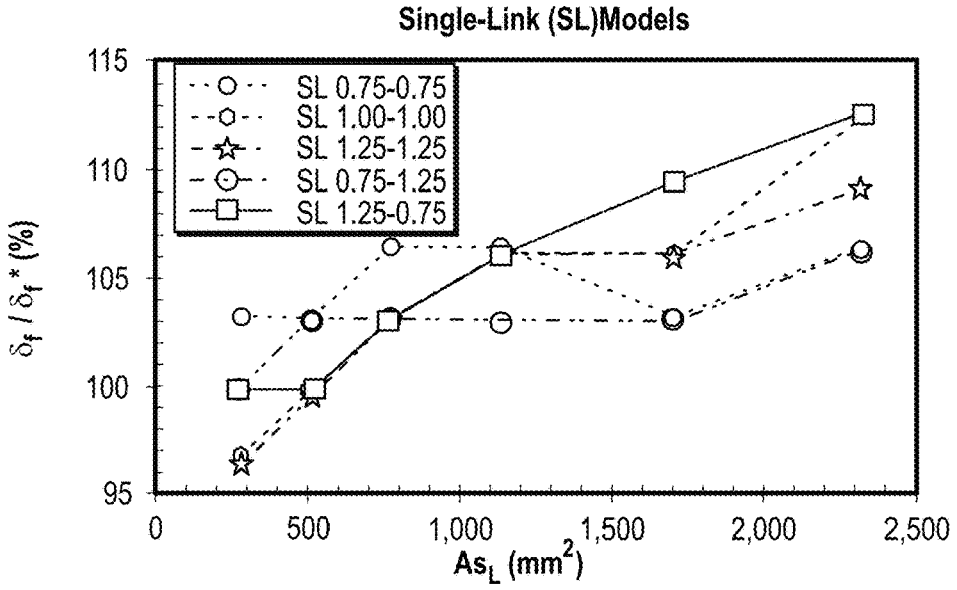
Figure 12C:
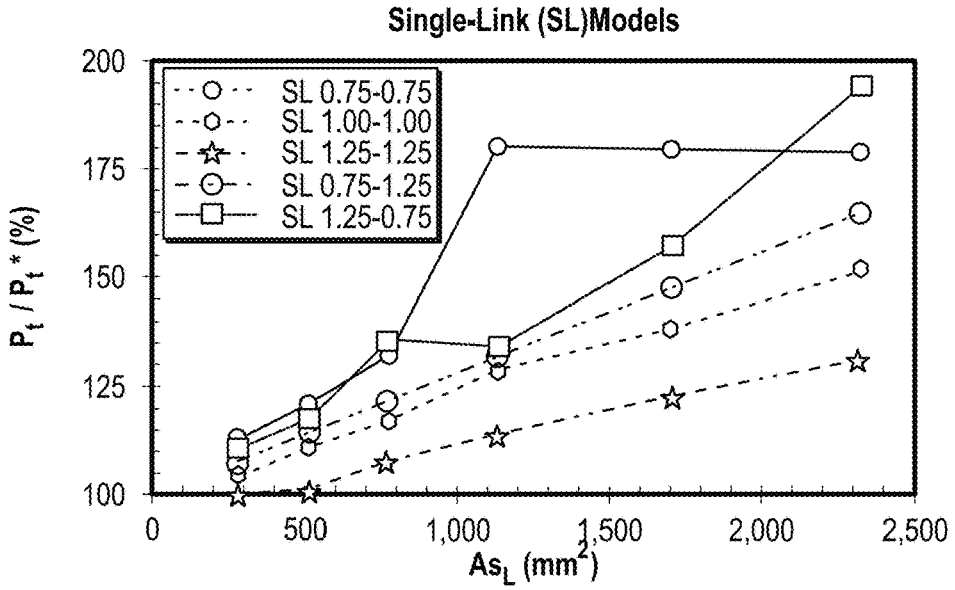
Figure 12D:
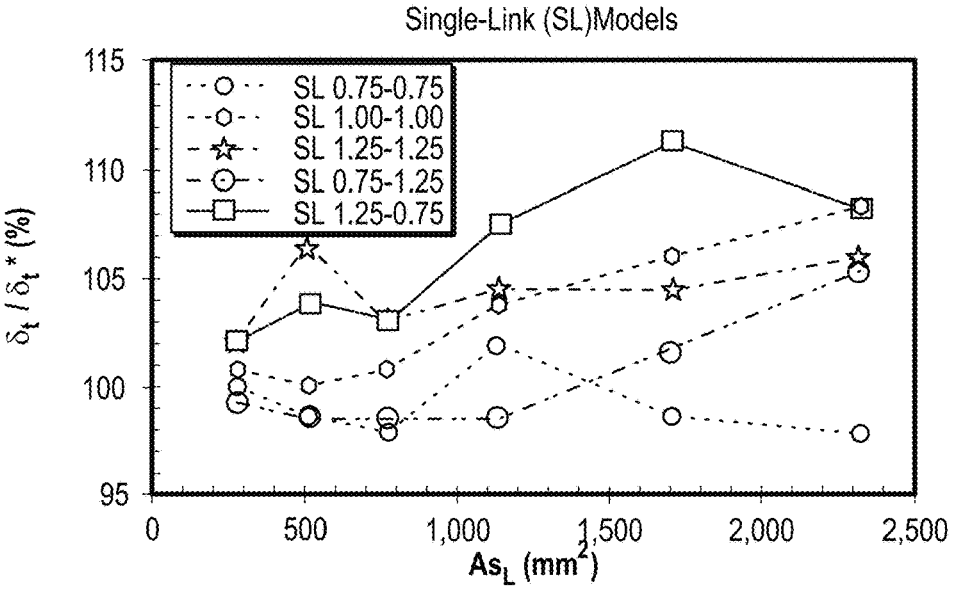
Figure 12E:
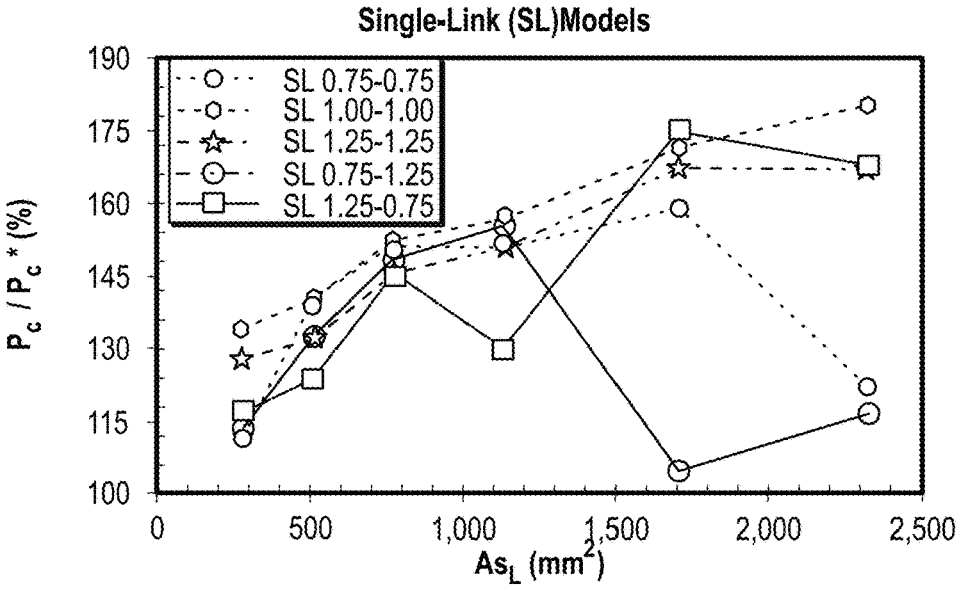
Figure 12F:
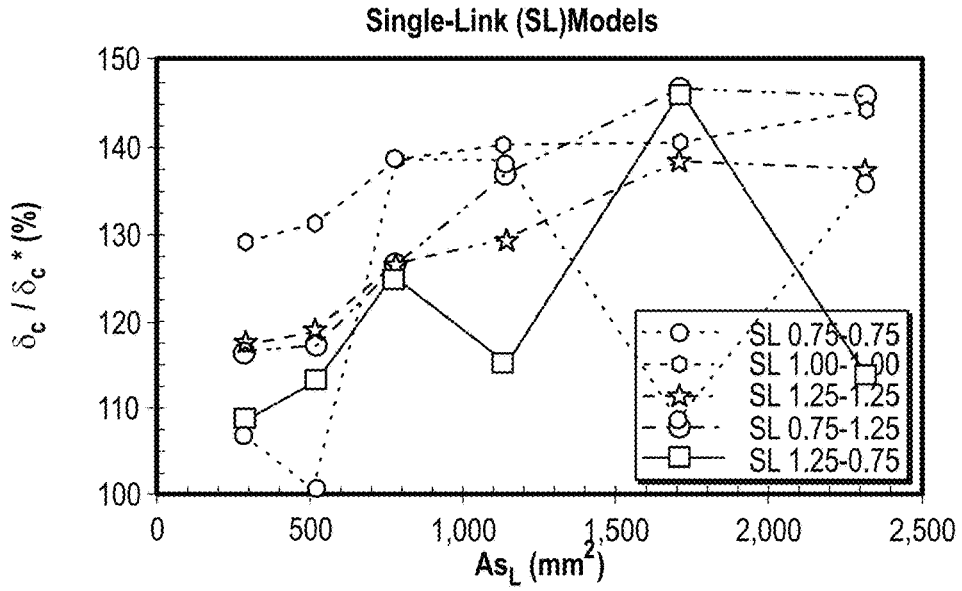
Figure 12G:
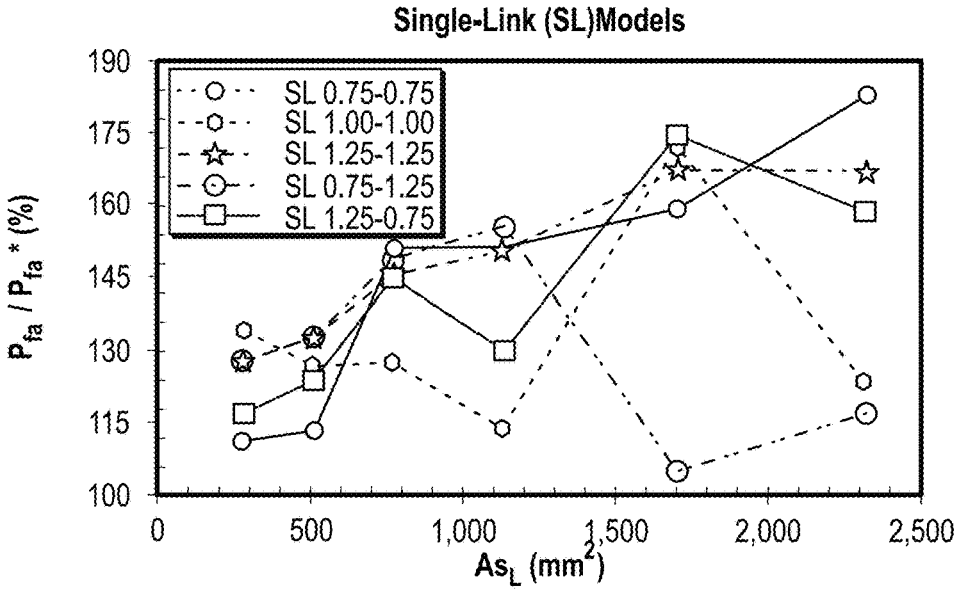
Figure 12H:
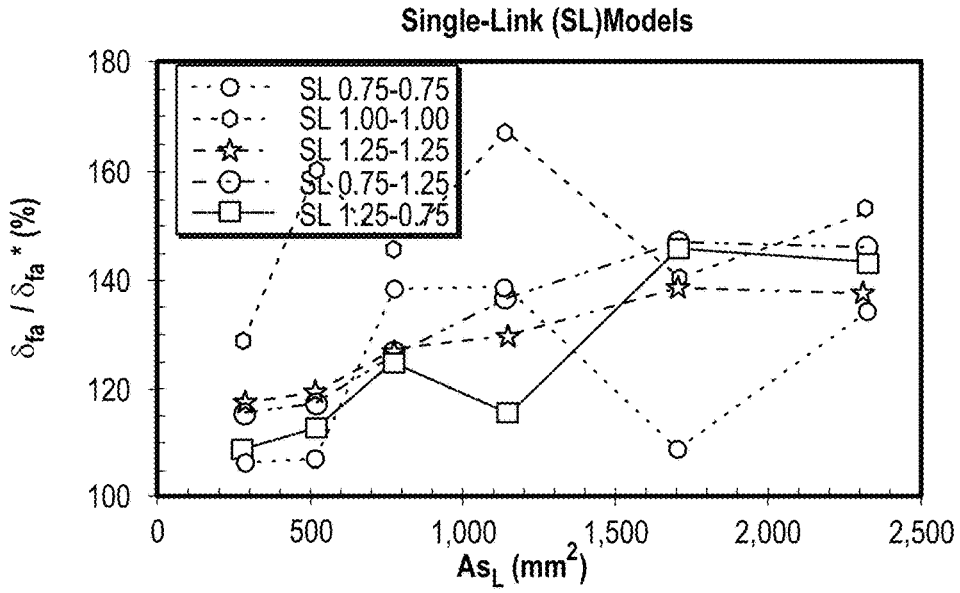
Figure 12I:
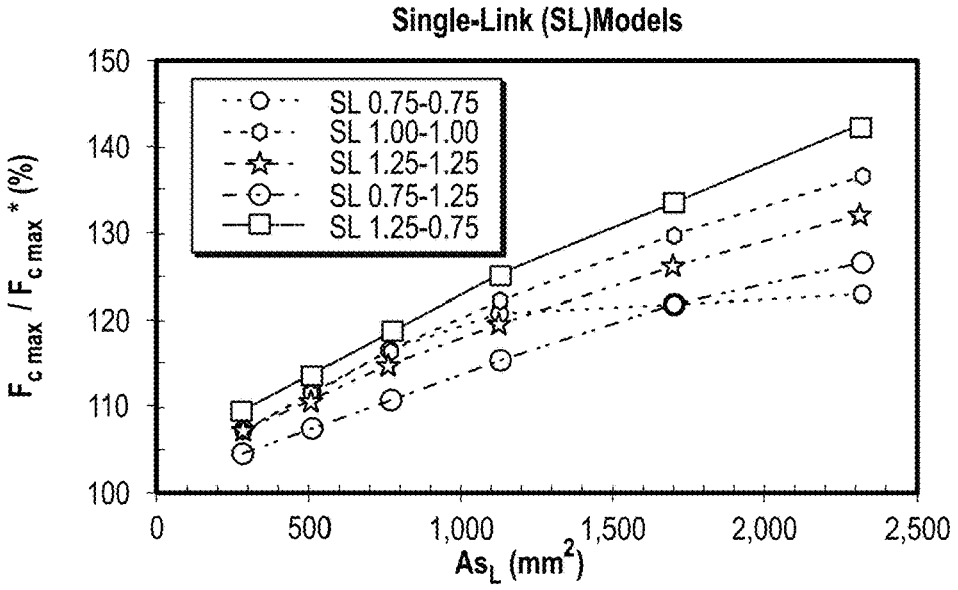
Figure 12J:
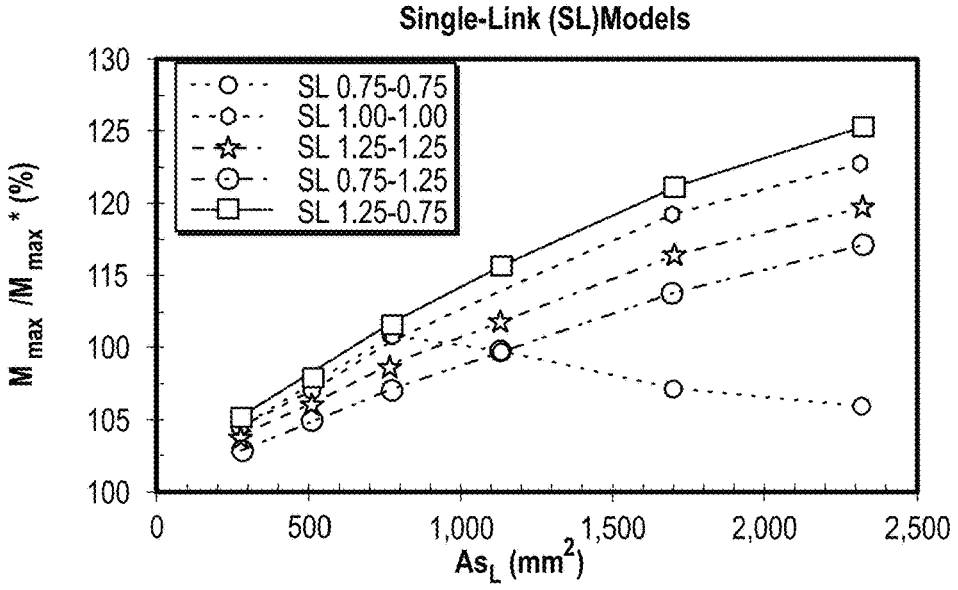
Figure 12K:
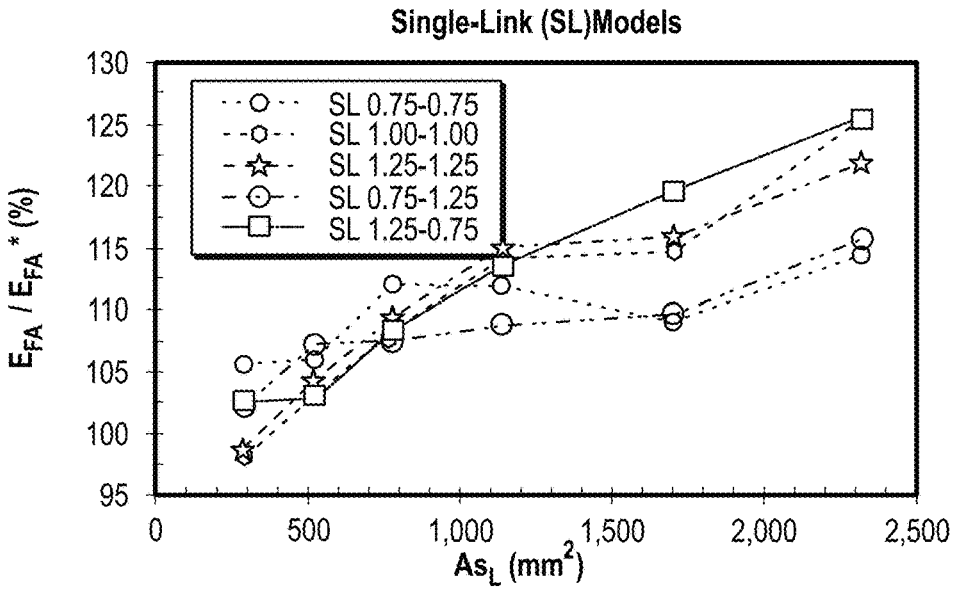
Figure 12L:
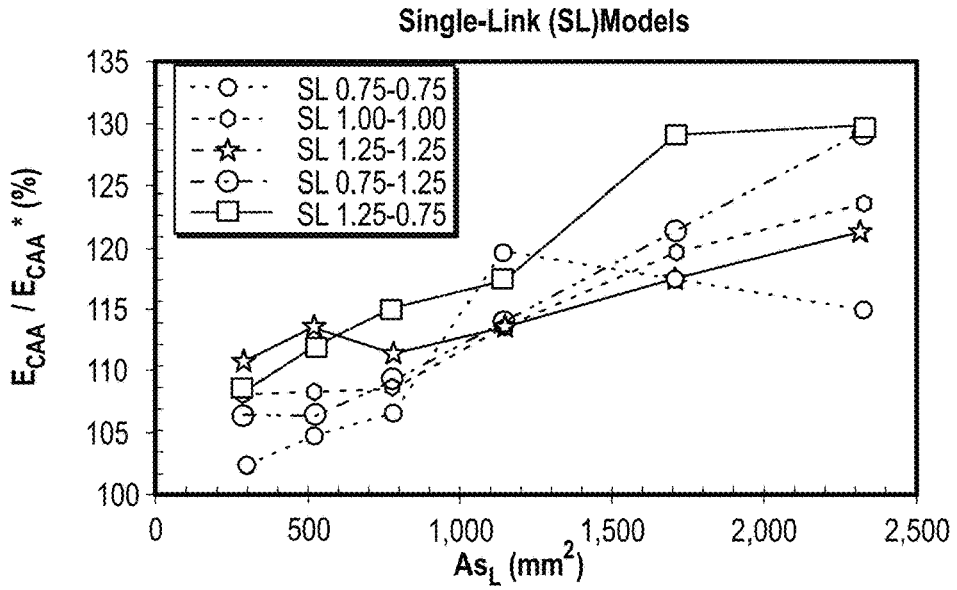
Figure 12M:
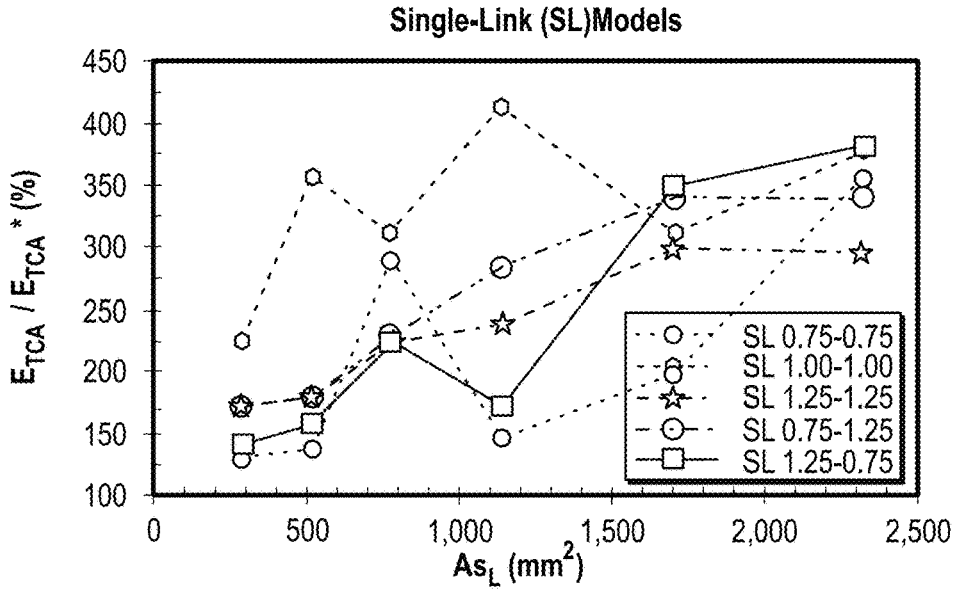
Figure 12N:
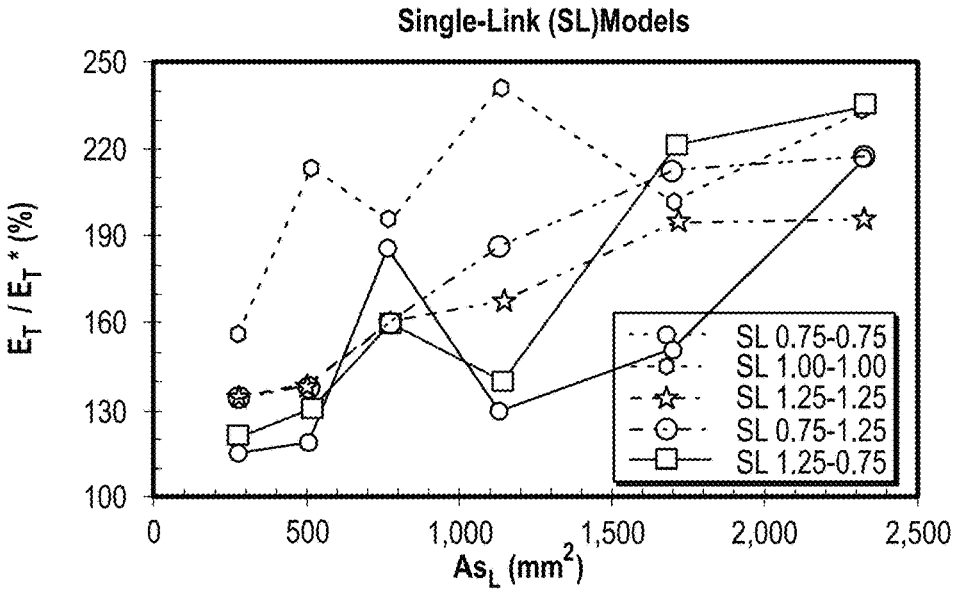

Considering load capacities (floor capacities, ductility and dissipated energy), FIGS. 12A-12N and FIGS. 13A-13N for single and double links, respectively, exhibit percentages of increase in the load strengths ($P_f$, $P_t$, $P_c$, $P_{fa}$) and corresponding vertical displacements (ductility), beam axial compressive force, beam moment at critical section, and dissipated energy (FA, CAA, TCA (FIG. 9), and total) of the mitigated floor systems. It should be noted that in some cases, the catenary action maximum capacity, $P_c$, is the failure load, $P_{fa}$ ($P_c$=$P_{fa}$). The percentage of increase was computed as a ratio of mitigated load to control load (i.e. $P_f/P_f$*%, $P_t/P_t$*%, $P_c/P_c$*%, $P_{fa}/P_{fa}$*% where the asterisk indicates parameter values of the control floor). Same applies to the percentages of increase in vertical displacement ($\delta_f/\delta_f$*%, $\delta_t/\delta_t$*%, $\delta_c/\delta_c$*%, $\beta_{fa}/\delta_{fa}$*%), beam axial compressive force ($F_{c\ max}/F_{c\ max}$*%), beam moment at critical section ($M_{max}/M_{max}$*%), and dissipated energy ($E_{FA}/E_{FA}$*%, $E_{CAA}/E_{CAA}$*%, $E_{CTA}/E_{CTA}$*%, $E_T/E_T$*%). The asterisk indicates parameter values of the control floor and those with no asterisk indicate parameter values of the mitigated floors. Following the column removal, FIG. 12A shows small percentages of increase in the first peak load, $P_f/P_f$*%, of the mitigated floors ranging between 101.7% for floor with single links SL 0.75-1.25-284 configuration and 109.8% for floor with SL 1.00-1.00-2322 configuration. Slightly higher percentages, $P_f/P_f$*%, were achieved in mitigated floors with double links, FIG. 13A, ranging from 105.6% for floor using DL 1.25&1.75-284 configuration and 119.7% for floor through DL 0.75&1.25-2322 configuration. For load at bottom of softening curve, FIG. 12C shows that the percentage of increase, $P_t/P_t$*%, varied between 100% for floor with single links SL 1.25-1.25-284 configuration and 194.2% for floor with SL 1.25-0.75-2322 configuration. On the other hand, for the double link configurations $P_t/P_t$*% increase altered between 101% for floor using DL 1.25&1.75-284 configuration and 204% for floor with DL 0.75&1.25-2322 configuration, as seen in FIG. 13C.

These percentages reveal that double links are slightly more significant regarding load capacity at the bottom of softening curve. FIGS. 12E and 13E, likewise, demonstrate the increase in the percentages of catenary action maximum capacity, $P_c/P_c$*%. The increase ranged from 105.1% for floor mitigated with SL 0.75-1.25-1704 and 180.5% for floor with SL 1.00-1.00-2322, FIG. 12E. For floors mitigated with double link configurations, the increase in $P_c/P_c$*% varied from 121.7% using DL 0.75&1.25-284 to 165% with DL 0.75&1.25-1136, FIG. 13E. These percentages indicate both single and double link configurations are equally significant regarding the catenary capacity, depending on the specific configuration. As for the percentage increase of load capacity at failure, $P_{fa}$, FIG. 12G demonstrates percentages of increase, $P_{fa}/P_{fa}$*%, ranging from 105.1% for floor mitigated with SL 0.75-1.25-1704 to 182.2% for floor with SL 0.75-0.75-2322, while FIG. 13G shows the same $P_{fa}/P_{fa}$* percentage increases as those of $P_c/P_c$* in FIG. 13E for all double link configurations.

Figure 13A:
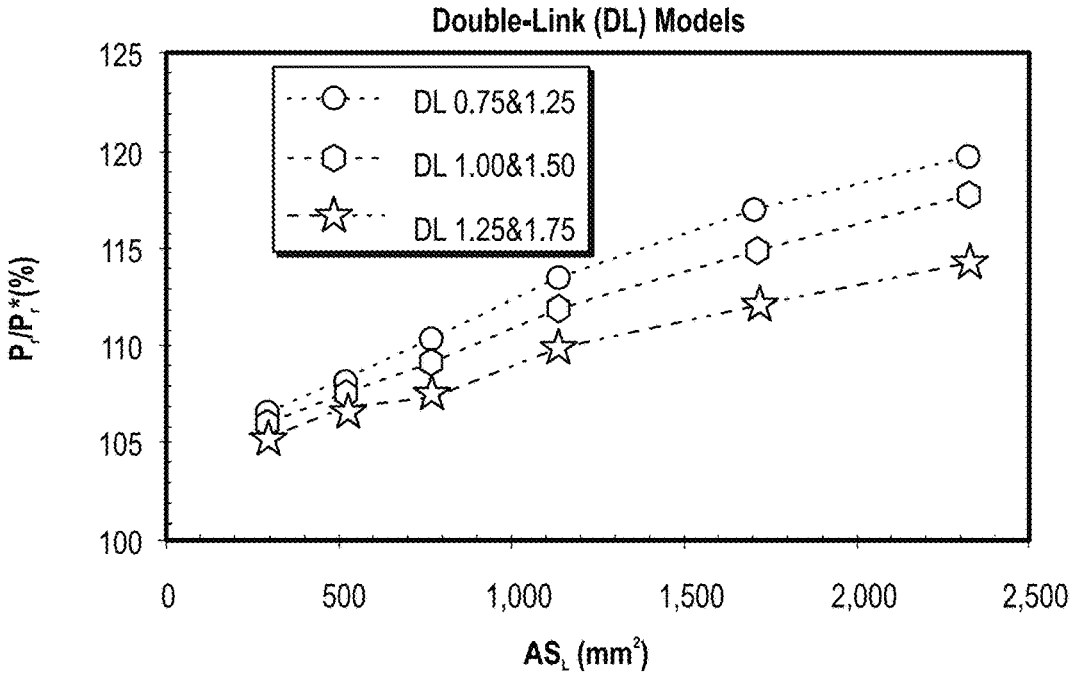
Figure 13B:
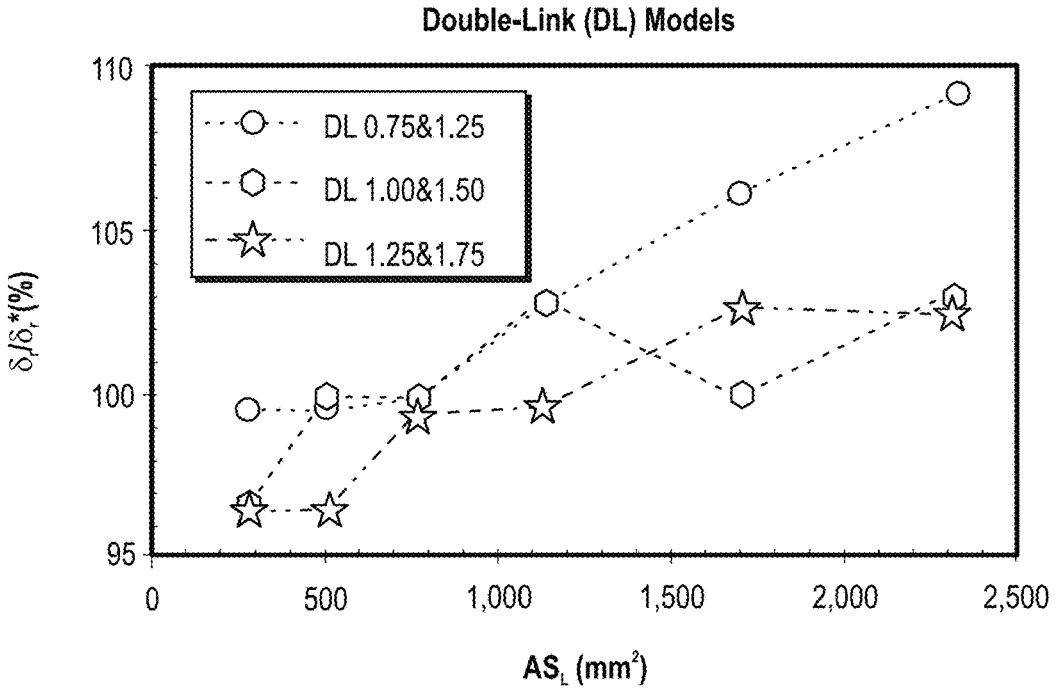
Figure 13C:
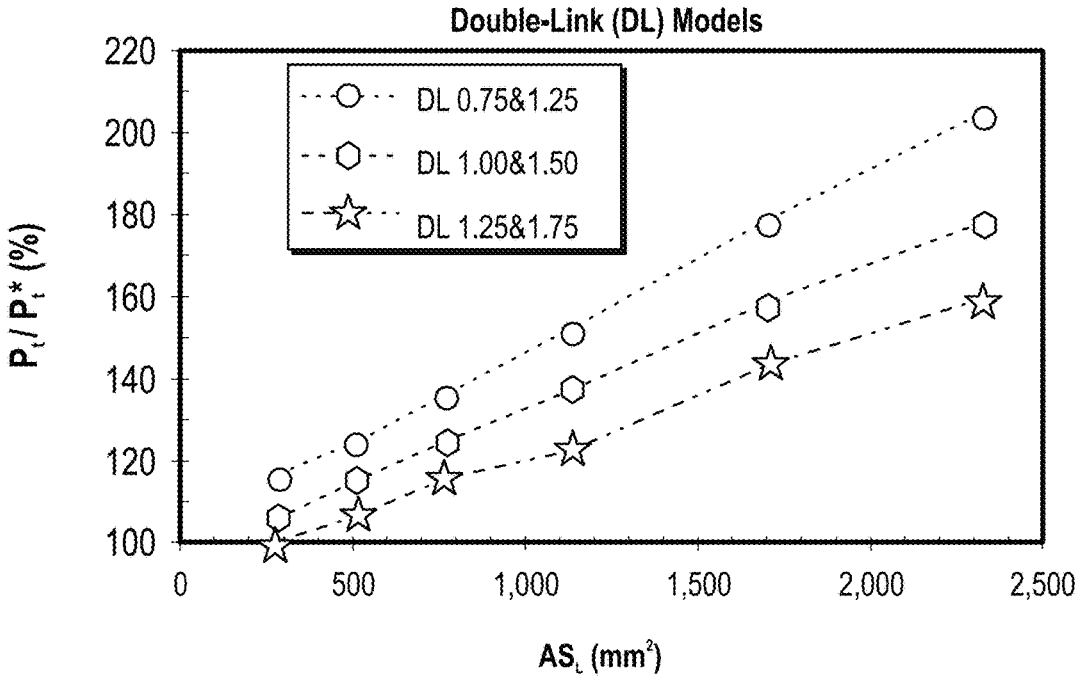
Figure 13D:
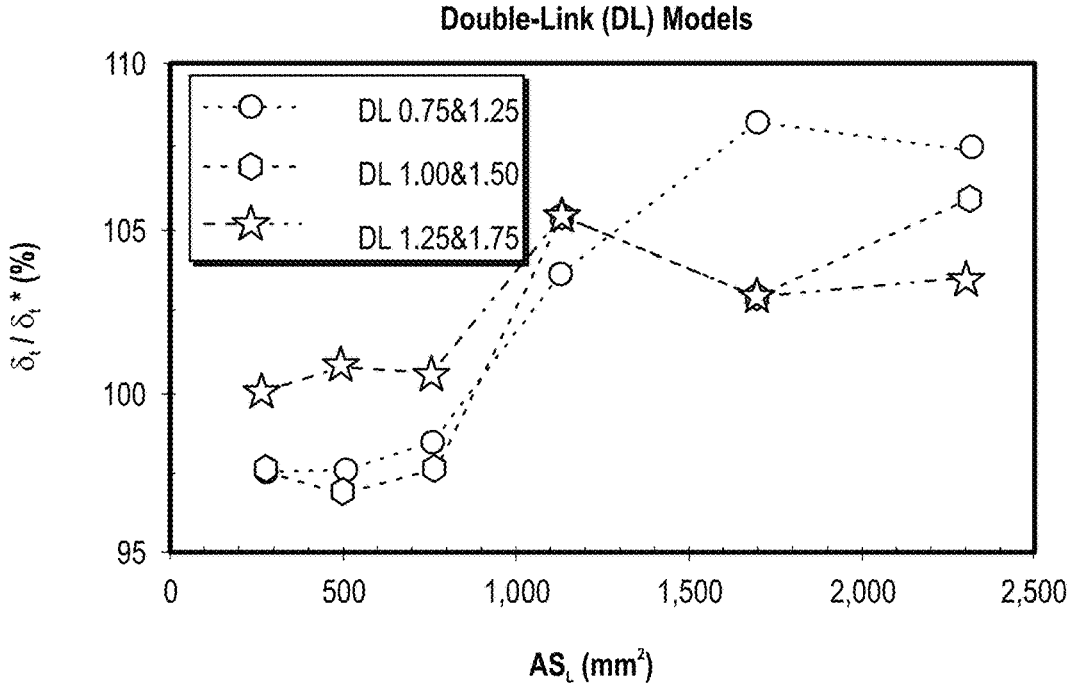
Figure 13E:
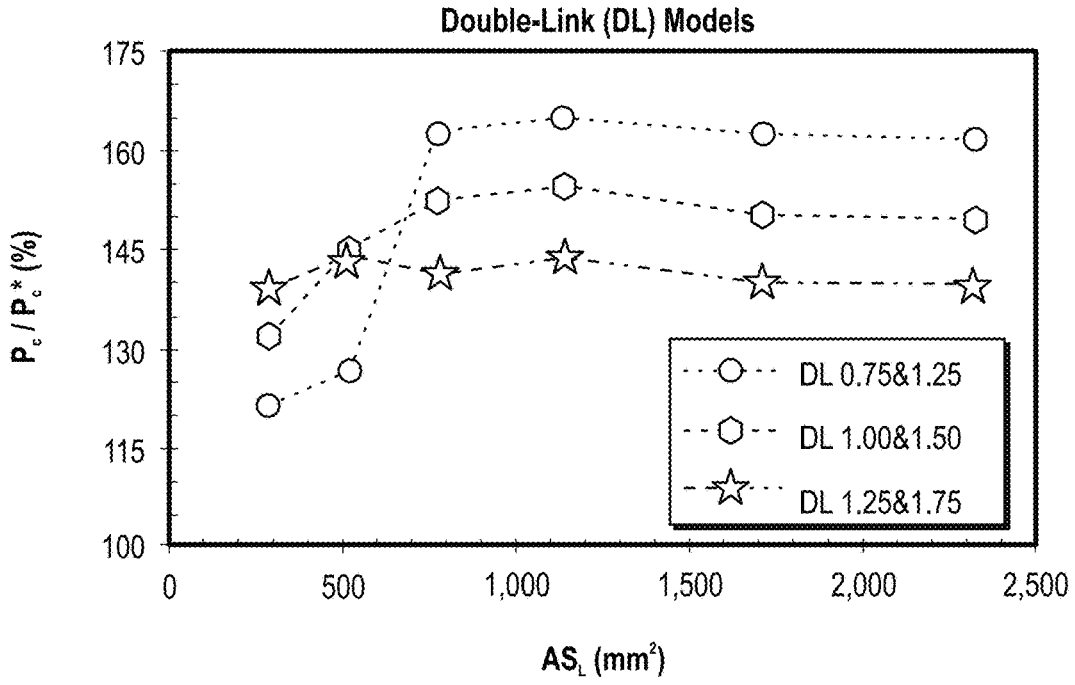

Considering displacement/ductility—the percentages of increase in vertical displacement $\delta_f/\delta_f$*% at first peak load is depicted in FIGS. 12B and 13B. According to FIG. 12B, $\delta_f/\delta_f$* percentage was between 96.6% for floor with single links SL 1.25-1.25-284 configuration and 112.5% for floor with SL 1.25-0.75-2322 configuration. As for the double links, the $\delta_f/\delta_f$* percentage was between 96.6% with DL 1.25&1.75-284 and 109.1% with DL 0.75&1.25-2322, FIG. 13B. These percentages demonstrate that the single links are slightly more dominant with regard to ductility at first peak load. For the $\delta_t/\delta_t$* ratio at bottom of softening curve, FIG. 12D shows that the percentage varied between 97.8% for floor with SL 0.75-0.75-2322 configuration and 111.3% for floor with SL 1.25-0.75-1704 configuration. Equally, for the double link configurations the $\delta_t/\delta_t$*% changed between 97.1% for floor using DL 1.00&1.50-516 configuration and 108.2% for floor with DL 0.75&1.25-1704 configuration, as shown in FIG. 13D. These percentages demonstrate that the double links are less controlling in terms of ductility at bottom of softening curve load.

Figure 13F:
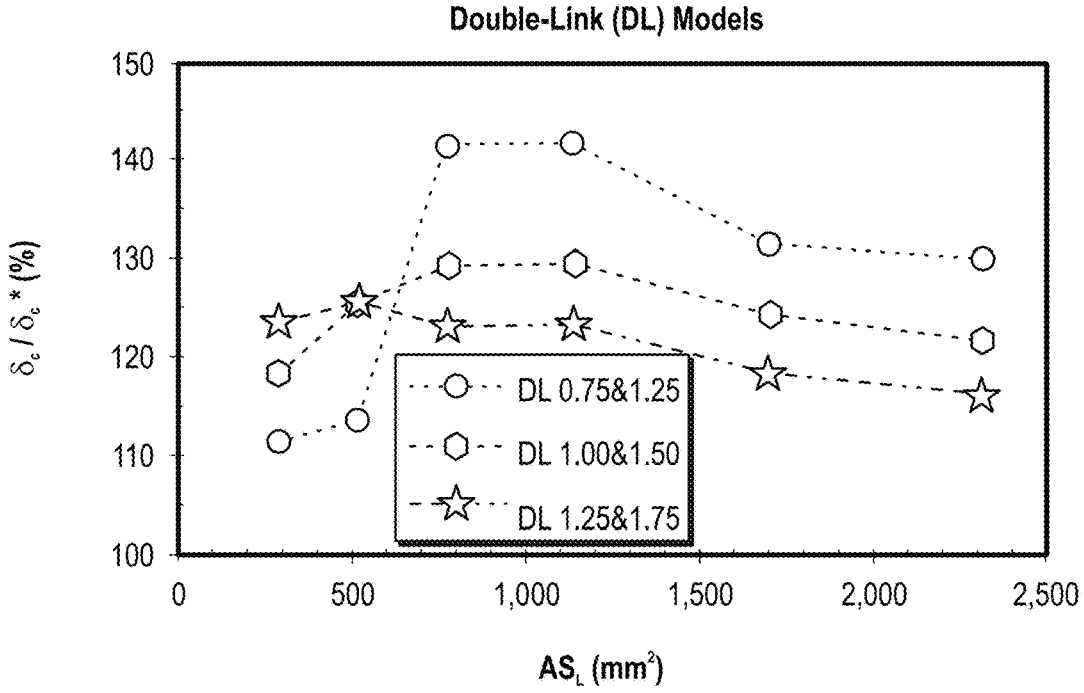
Figure 13G:
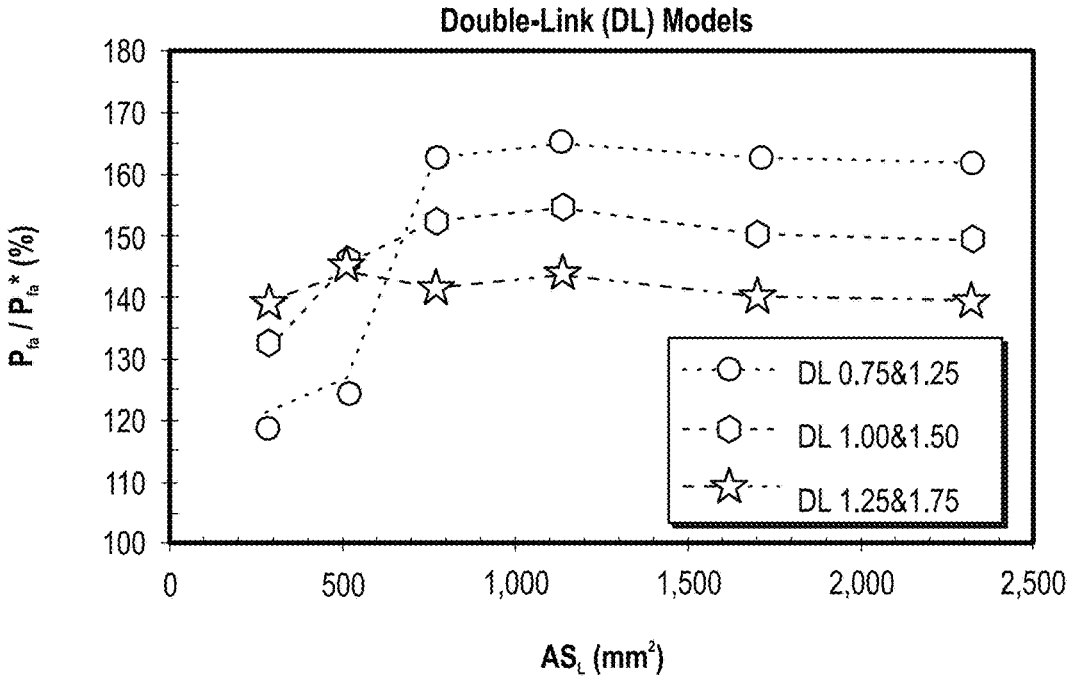
Figure 13H:
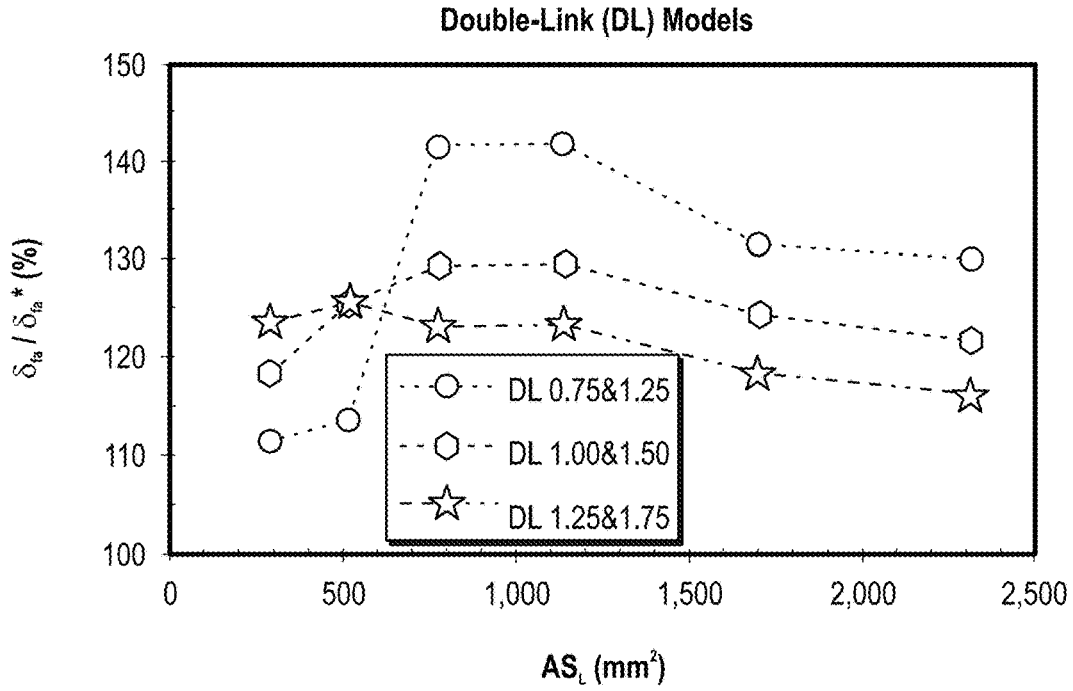
Figure 13I:
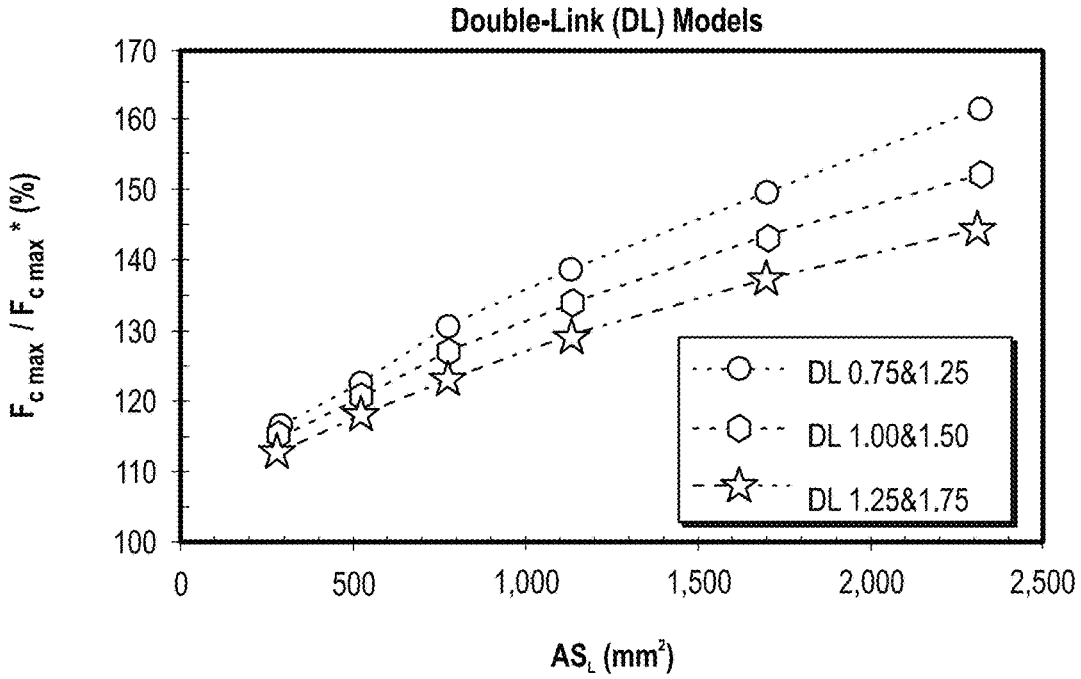
Figure 13J:
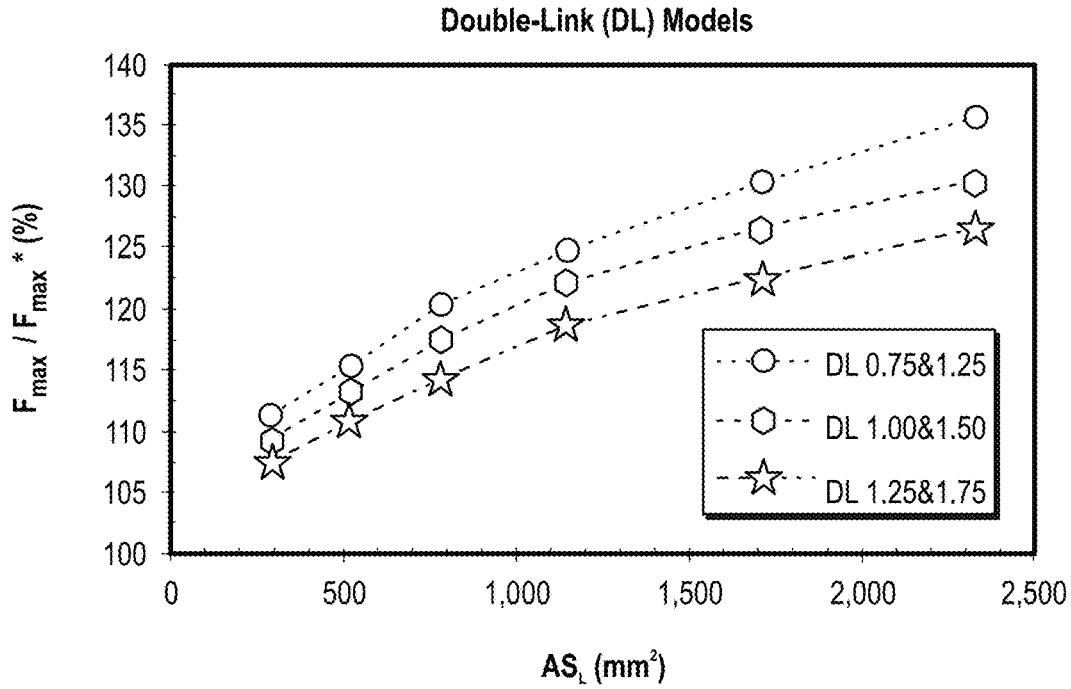

Similarly, the percentage increase in $\delta_c/\delta_c$*% at maximum catenary action capacity is between 100.8% floor with SL 0.75-0.75-516 and 146.6% for floor with SL 0.75-1.25-1704 as shown in FIG. 12F, and between 111.3% for floor using DL 0.75&1.25-284 and 141.2% for floor with DL 0.75&1.25-774 as depicted in FIG. 13F. These percentages demonstrate that, mostly, the single links are a somewhat more governing concerning ductility at maximum catenary action capacity. Also, for the displacement, $\delta_{fa}/\delta_{fa}$*, at failure, the percentages of increase in the mitigated floor displacements with single links are between 106.8% with SL 0.75-0.75-284 and 167.4% with SL 1.00-1.00-1136, as presented in FIG. 12H. The percentages of increase in the mitigated floor displacements with double links shown in FIG. 13H are the same as those for $\delta_c/\delta_c$*% listed in the previous paragraph and shown in FIG. 13F. Considering the beam axial compressive force, FIG. 12I shows percentages of increase in the beam axial force, $F_{c\ max}/F_{c\ max}$*%, of the mitigated floors ranging between 104.5% for floor with single link configuration of SL 0.75-0.75-284 and 142.2% for floor with SL 1.25-0.75-2322 configuration. Higher increase percentages of $F_{c\ max}/F_{c\ max}$*% were attained in mitigated floors with double links, as shown FIG. 13I, ranging from 113.2% for floor using DL 1.25&1.75-284 configuration and 161.3% for floor with DL 0.75&1.25-2322 configuration. These percentages establish that the double links are more commanding with regard to beam axial compressive force.

Figure 13K:
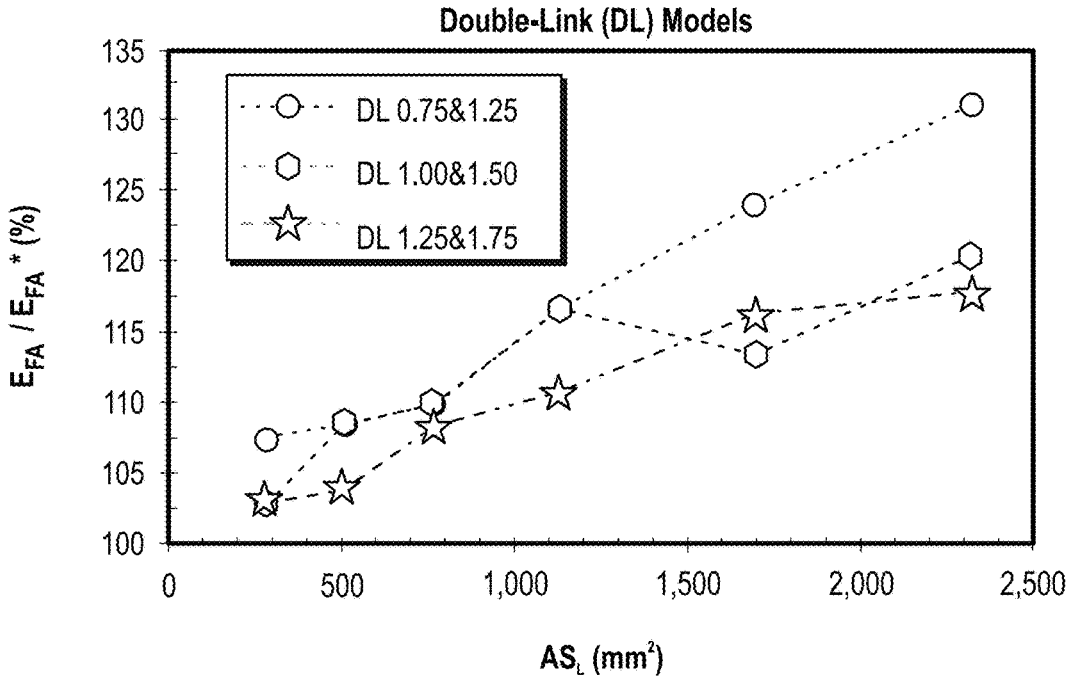
Figure 13L:
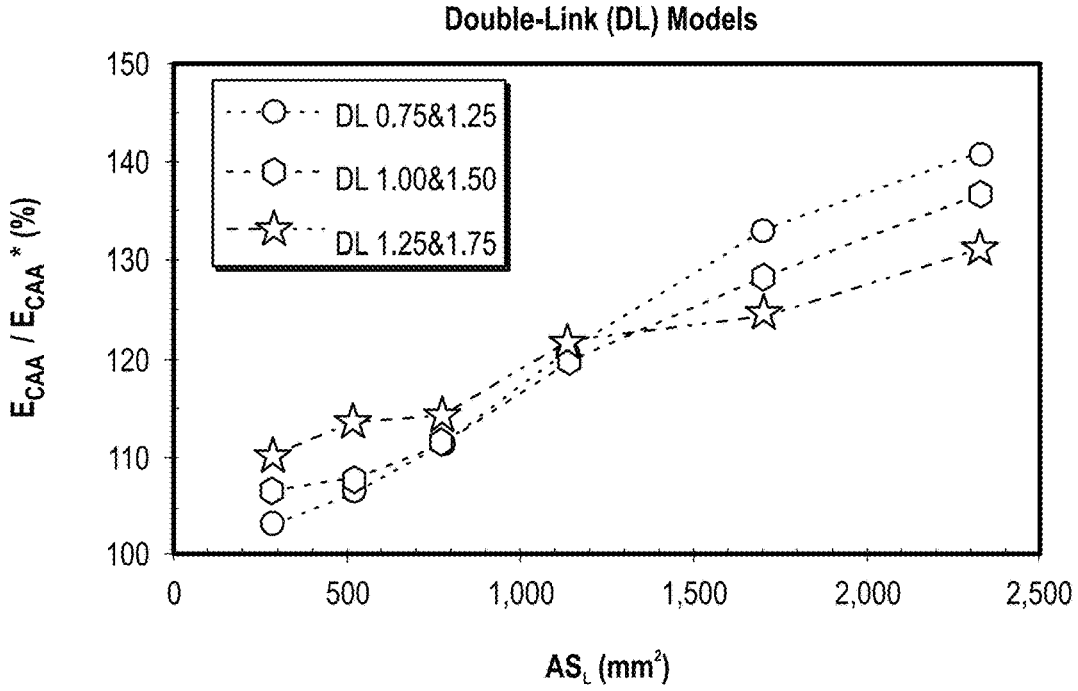

Considering the bending moment at critical section of beam (over failed column location), as for the $M_{max}/M_{max}$*%, the percentage of increase varied between 102.9% for floor mitigated with SL 0.75-1.25-284 configuration and 125.2% for floor with SL 1.25-0.75-2322 configuration, as displayed in FIG. 12J. Larger increase percentages of $M_{max}/M_{max}$*% were reached when floors were mitigated with double link configurations with percentages ranging from 107.7% for floor using DL 1.25&1.75-284 and 135.5% for floor with DL 0.75&1.25-2322, as shown FIG. 13J. Same as for the axial compressive force, these percentages present that the double links are more significant with regard to beam bending moment. Further, considering the energy dissipated by flexure action, equally for the ratio of energy dissipated by flexure action, $E_{FA}/E_{FA}$*%, FIG. 12K indicates that the percentage changed from 98.1% for floor mitigated with SL 1.00-1.00-284 to 125.4% for floor with SL 1.25-0.75-2322. Likewise, FIG. 13K shows a variation in the $E_{FA}/E_{FA}$* percentage increase from 102.9% using DL 1.00&1.50-284 to 131.2% using DL 0.75&1.25-2322. Hence, these percentages show that the double links are more influential with regard to energy dissipated by flexure action. Considering the energy dissipated by compression arch action/softening, FIG. 12L displays the variation in the percentage increase in the $E_{CAA}/E_{CAA}$* ratio from 102.4% for floor mitigated with SL 0.75-0.75-284 and 129.8% for floor with SL 1.25-0.75-2322. Likewise, FIG. 13L exhibits a variation in the increase of $E_{CAA}/E_{CAA}$*from 103.3% using DL 0.75&1.25-284 to 140.7% using DL 0.75&1.25-2322. The percentages demonstrate that the double links are somewhat more superior with respect to energy dissipated by compression arch action/softening.

Figure 13M:
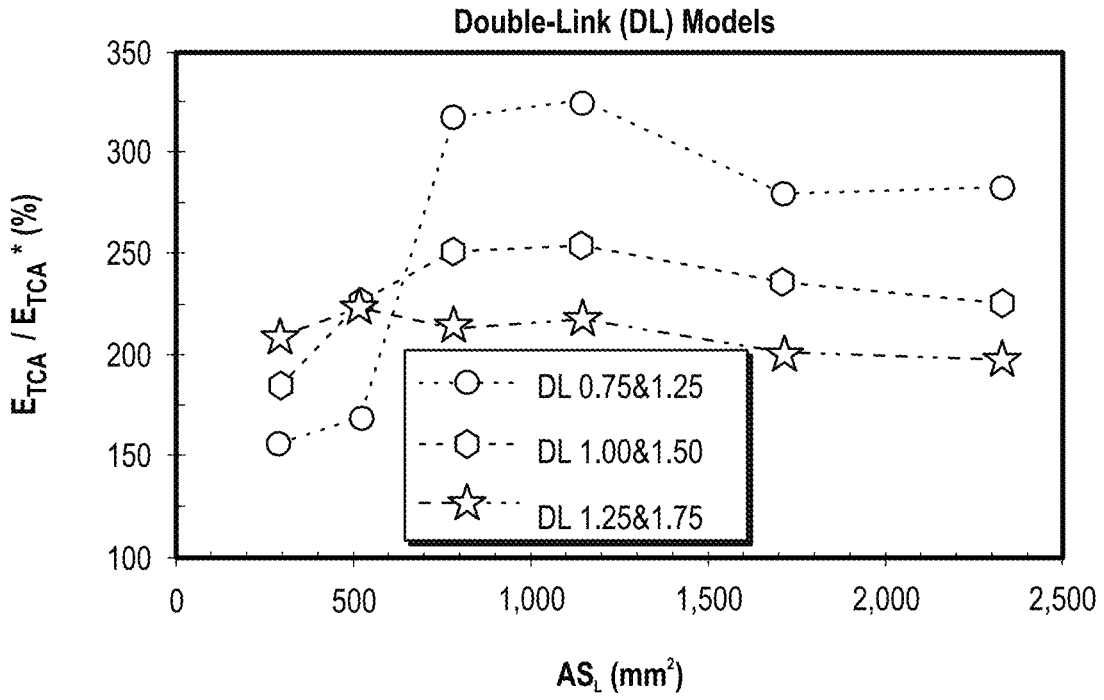
Figure 13N:
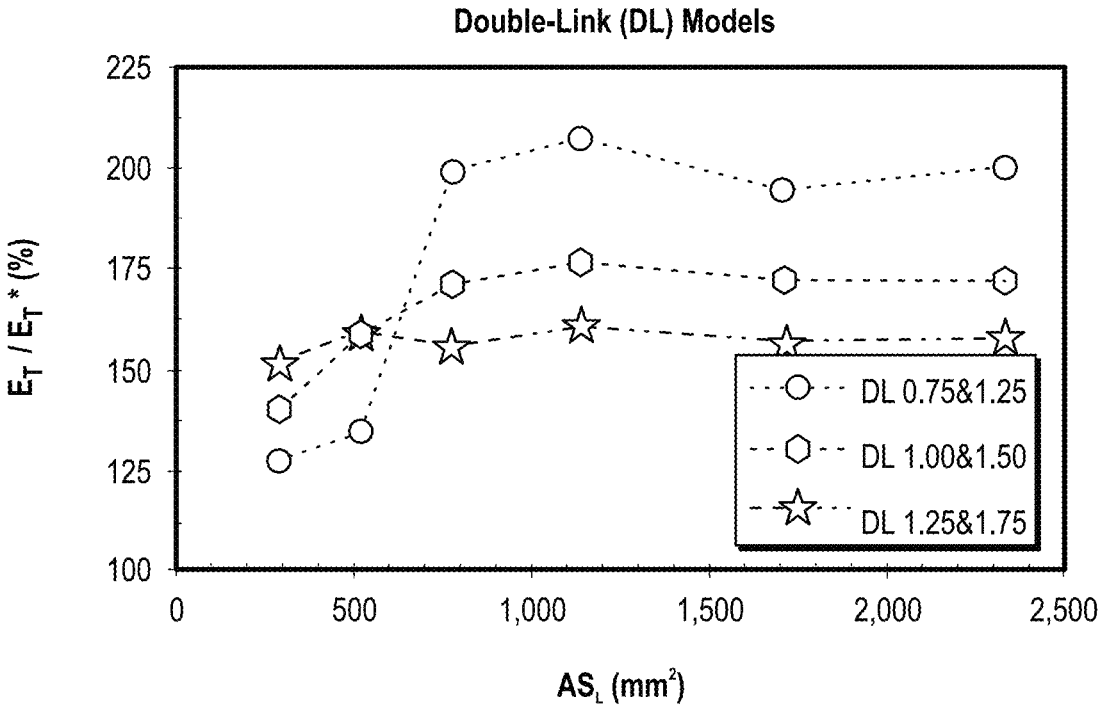

Considering energy dissipated by tension catenary action, FIG. 12M presents the variation in the percentage increase in the $E_{CTA}/E_{CTA}$* ratio from 131.2% for floor mitigated with SL 0.75-0.75-284 and 414.3% for floor with SL 1.00-1.00-1136. Likewise, FIG. 13M shows a variation in the increase of $E_{CTA}/E_{CTA}$*% from 155.2% using DL 0.75&1.25-284 to 324.4% using DL 0.75&1.25-1136. These percentages indicate that both single and double links are equally governing concerning energy dissipated by tension catenary action. Considering the total energy dissipated $E_T/E_T$*%, FIG. 12N indicates that the percentage increase changed from 115.2% for floor mitigated with SL 0.75-0.75-284 to 241.8% for floor with SL 1.00-1.00-1136. Likewise, FIG. 13N shows a variation in the $E_T/E_T$* percentage increase from 126.1% using DL 0.75 &1.25-284 to 206.9% using DL 0.75&1.25-1136. Therefore, these percentages indicate that both single and double links are equally significant concerning total dissipated energy.

A mitigation method with an innovative, simple and practical reinforcement scheme is proposed for RC floor systems subject to progressive collapse and prone to column failure. The concept of the proposed method is to add diagonal top and bottom reinforcing bars within the floor slab panels in the vicinity of the potential failed column. Different configurations of the added diagonal bars were considered. In order to investigate the efficiency of the proposed mitigation method, a simplified but accurate 3D nonlinear fiber element-based finite element model for RC floor systems was developed for the analysis of RC floor systems subjected to progressive collapse as a result of column removal. The accuracy of the developed 3D numerical model was validated against benchmark test results from the literature. The numerical results show that the mitigated floor system of the frame considered in accordance with the present invention experienced improved progressive collapse behavior. Depending on the added beam configurations, the percentage increases in beam axial compressive forces of the mitigated floors ranged from 104.5% to 161.3%. As a result of increasing the axial force, the beam bending moment at critical section over the failed column varied between 102.9% and 135.5%. The beam internal force enhancements led to an overall improvement in the mitigated floor behaviors. Percentages of increase in the first peak load capacity of flexure action, load capacity at bottom of softening curve of arch action, maximum catenary action capacity, and load capacity at failure altered from 101.7% to 119.7%, from 100% to 194.2%, from 105.1% to 180.5%, and from 105.1% to 180.5% (similar to catenary capacity), respectively. Likewise, percentages of increase in the vertical displacement at first peak load capacity, displacement at load capacity at bottom of softening curve, displacement ate maximum catenary action capacity, and maximum displacement ranged between 96.6% and 112.5%, 97.1% and 111.3%, 100.8% and 146.6%, and 106.8% and 167.4%, respectively. As for the dissipated energy by the mitigated floors, the percentages of increase in energy dissipated by flexure action, compression arch action/softening, tension catenary action, and total dissipated energy varied from 98.1% to 131.2%, from 102.4% to 140.7%, from 131.2% to 414.3%, and from 115.2% and 241.8%, respectively. Therefore, the study results demonstrate that by implementing the proposed mitigating method, efficient floor systems can be attained that better resist progressive collapse that may result from column failure.

In order to identify the optimal mitigating configuration, the feasible and practical application of the diagonal link configuration and its corresponding total dissipated energy were considered as indices to select the best resistance to progressive collapse of the mitigated floors. Therefore, the numerical results obtained clearly showed that among the different mitigating configurations considered in this study, the optimal mitigating link configuration is the single link (SL), which has a square section with depth and width equal to the floor slab thickness, a practical reinforcement ratio of 2.3% to avoid congestion of reinforcement at the joints between links and beams during concreting, and a length equal to one sixth (⅙) of the span of the longitudinal floor beam measured from the centreline of the failed column. Accordingly, the optimal mitigating configuration is mitigating link SL 1.00-1.00-516 (section 150 mm×150 mm, length 1 m, reinforcement ratio 2.3%), which had a percentage increase in the total dissipated energy equal to 214.8%, as shown in FIG. 12N. Even tough single links SL 1.00-1.00-1136, SL 1.00-1.00-2322, SL 1.25-0.75-1704, and SL 1.25-0.75-2322 had more percentage increase in their total dissipated energy with 241.8%, 232.2%, 221.6% and 235.7%, respectively, as shown in FIG. 13N, these were not considered optimal configurations mainly because of their high reinforcement ratios that would cause congestion of reinforcement at connections links and beams while concreting and hinder the applicability of the mitigating method.

It is worth noting that the proposed mitigation method can be applied to one or more potentially failed columns on the same floor or on different floors. It can also be applied to all columns on the same floor and on all floors of the framed structure. It is recommended to investigate the progressive collapse resistance of floor systems where all columns in the floor are weakened using the proposed weakening method. In this proposed method, steel bars left over from construction sites as well as used steel bars and structural steel sections from demolition sites can be used/reused in the connections to mitigate progressive collapse of RC framed structures under column(s) failure. It can save energy required to produce new steel bars and new steel sections, reduce carbon dioxide emissions and serve as a sustainable solution to mitigate progressive collapse of RC framed structures subjected to column(s) collapse.

In accordance with the present invention, a mitigating method with a practical reinforcement scheme is proposed to improve the resistance of RC floor systems to progressive collapse that results from a column failure. This method applies primarily to the floor system of the RC framed structures. The present invention is executed during construction and is embedded and hidden within the slab horizontally. It is simple, practical, and no fabrications are needed. It uses horizontal diagonal links where each link is made of top and bottom diagonal bars placed within the slab thickness of each of the four slab panels around the potential column to connect the orthogonal beam bridging over the failed column. These diagonal top and bottom steel bars provide additional horizontal load paths to increase the building redundancy and robustness that can prevent the building progressive collapse due to column failure. This invention does not have any additional cost as steel bars left over from the same construction sites can be used.

It uses horizontal diagonal links where each link is made of top and bottom diagonal bars placed within the slab thickness of each of the four-slab panel around the potential column. These diagonal links (top and bottom diagonal steel bars) connect the orthogonal beams bridging over the failed column. Single or double links can be installed in each slab panel around the failed column. The diagonal steel bars in each the link are short bars of length not exceeding one-sixth the span of the longitudinal beam (span/6) and they do not affect the building design. These links with diagonal top and bottom steel bars in each slab panel around the failed column provide additional horizontal load paths to increase the building redundancy and robustness that can prevent the building progressive collapse due to column failure. The execution of this invention does not require skilled labor. It does not contradict with architectural requirements. There is no need to protect it or cover it due to architectural requirements because it is installed within the slab thickness. It does not have any additional cost as steel bars left over from the same construction sites can be used. Also, used steel bars and small structural steel sections from demolition sites can be reused in this invention with no addition cost, or minimal cost. In addition, in this invention no additional external vertical cables are used, no steel seating bases for beams are required, no fabrication of beam steel seating bases is prerequisite, no skilled labor is needed, and no additional costs are incurred in this invention. Moreover, in the proposed invention there are no drillings to the building and therefore, there are no damages caused to the building since this invention is installed and placed during the construction. This invention is embedded in the slab around the potential failed column to provide horizontal additional load paths and it is executed during construction. This invention may be applied around all columns in all bays above and below the failed column (may be applied around all columns in the whole structure). The proposed mitigating method is based on the concept of developing self-generated "post-tensioning" axial compressive forces within segments of the beams that bridge over potential failed column.

The proposed method is comprised of adding diagonal top and bottom reinforcing bars within the floor slab panels in the vicinity around the potential failed column and is based on an innovative concept of developing self-generated "post-tensioning" axial compressive forces within segments of the beams that bridge over potential failed column. In addition, this invention uses fiber element-based finite element software, SeismoStreut, that accounts for large deformations such as progressive collapse and which is easy to use with a friendly interface that facilitates and expedites the development of the numerical model of the building.

In this invention the link used is a structural member made of diagonal top and bottom bars installed within the concrete slab thickness and connecting orthogonal floor beams. The link in this invention is numerically modeled as a tie element (line element), whereas the beams are numerically modeled as three-dimensional nonlinear force-based plastic-hinge frame element (infrmFBPH) using the software, SeismoStreut, library. A cross-section area and steel bar ratio are required to define the tie element. The cross-section dimensions and the longitudinal and transverse steel reinforcement ratios are required to define the element (infrmFBPH)—the area of element (infrmFBPH) is then broken into at least 150 fibers, with a plastic hinge length equals to half the element length. In addition, for all the elements used, the elastic modulus, yield strength, fracture strain (%), and ultimate strength of longitudinal and transvers steel reinforcements are defined as well as the compressive strength, mean tensile strength, and modulus of elasticity of concrete.

These diagonals added bars, links, provide additional horizontal load paths bridging over the failed column to increase the building redundancy and robustness that can prevent the building progressive collapse due to column failure. The concrete slab panels and the added diagonal bars are designed using ASCE (2022) and ACI318 (2019). This proposed invention does not use external cables but uses added diagonal steel bars in the each of the four slab panels around the failed column. Depending on the added diagonal bar configurations, the percentage increases in the beam axial compressive force, catenary action capacity, total dissipated energy, and maximum vertical displacement by the mitigated floors ranged between 104.5% and 161.3%, 105.1% and 180.5%, 115% and 241.8%, and 106% and 167.4%, respectively. As for the dissipated energy by the mitigated floors, the percentages of increase in energy dissipated by flexure action, compression arch action/softening, tension catenary action, and total dissipated energy varied from 98.1% to 131.2%, from 102.4% to 140.7%, from 131.2% to 414.3%, and from 115.2% and 241.8%, respectively.

The role of the added diagonal bars is to connect the orthogonal floor beams around the potential failed column together and to act as links/ties between the beams when the column fails. Development length is maintained to ensure adequate anchorage between the added bars and floor beams. Since the structural system in the vicinity of the failed column houses the largest deformations, the added diagonal top and bottom steel bars should be located close to and around the failed column to be effective.

This invention places additional top and bottom diagonal steel bars within the slab thickness in the four slab panels around the failed column to connect both longitudinal and transverse beams bridging over the failed column in a three-dimensional concrete structure. The addition of the diagonal steel bars in each slab panel around the failed column provides additional horizontal load paths to increase the building redundancy and robustness that can prevent the building progressive collapse due to column failure. This proposed invention analyzes three-dimensional (3D) floor systems in 3D reinforced concrete framed structure. Under normal use of gravity (vertical) load such as self-weight of structure and live load as per ASCE (2022), this invention demonstrated that mitigated floor showed beams with higher axial compression force leading higher moment capacity at the critical section where the potential failed column is. On the other hand, as the beam axial force decreased with the increase in the vertical displacement, the mitigated bending moment decreased gradually and, in general, switched to minor positive moment at very large vertical displacements. The moment drops within their gradual decrease was due to tension bar fracture as vertical displacements increased.

This invention uses straight bars and does not have any additional cost as steel bars left over from the same construction sites can be used (and does not use steel strands, or sleeves, wave-forming reinforcement, or unbonded steel strands). Also, used steel bars and small structural steel sections from demolition sites can be reused in this invention with no addition cost, or minimal cost. These bars are placed simply and easily within the thickness of the slab in a diagonal manner around the failed column. As the vertical displacement increase these diagonal bars act as ties that generate additional axial compressive forces in the orthogonal beams leading to enhancement in the beam bending capacities, catenary action capacities, and energy absorption. This invention further uses diagonal steel bars placed within the thickness of slab around the failed column to connect the orthogonal beams bridging over the failed column of 3-Dimensional structure.

This invention deals with cast-in-place concrete or cast-in-situ concrete where slabs and beams of the buildings are cast at the site in formwork, and with a framed structure with regular shape in height. This invention also deals with cast-in-place concrete or cast-in-situ concrete where slabs, beams, and columns of the buildings are cast at the site in formwork. In addition, horizontal diagonal links are used made of top and bottom diagonal bars embedded within the slab thickness of each of the four-slab panel around the potential column. These top and bottom diagonal steel bars connect the orthogonal beams bridging over the failed column and are short and very light. There is no requirement to shield or cover the structure. This invention evaluates the effects of slabs and beams on the progressive collapse resistance of concrete structures with concrete floor system and investigates the performance and resistance of reinforced concrete multi-story space framed structures subjected to progressive collapse due to column failure.

In the proposed invention, due to relative vertical displacement between the orthogonal floor beams in the 3-dimensional structure, between the two ends of the diagonal bars connected to these beams, the diagonal bars in each slab panel behave as links/ties that push on the floor beams at the location of the connection causing generation of axial compressive forces within the beam segments confined by the diagonal steel bars placed around the failed column. The increase in the beam compressive forces in the mitigated floors is credited primarily to the relative vertical displacement between the beams. Accordingly, the links can be regarded as providing additional restraints to the horizontal movements of the beams and offer additional horizontal load paths to increase the building redundancy and robustness that can prevent the building progressive collapse due to column failure. This invention analyzes 3-dimensional space floor systems. Since the structural system in the vicinity of the failed column houses the largest deformations, the added diagonal top and bottom steel bars are placed close to and around the failed column to be effective. The length of the diagonal bars does not exceed one-sixth of the longest beam span (S/6) between the longitudinal and transvers beams. As the vertical displacement at the location of failed column increases, these diagonal top and bottom steel bars act as ties with tension forces that generate additional axial compressive forces in the orthogonal beams leading to enhancement in the beam load-carrying capacities, bending capacities, catenary action capacities, and energy absorption.

Due to relative vertical displacement between the orthogonal floor beams and hence, between the two ends of the diagonal bars connected to these beams, the diagonal bars in each slab panel behave as links/ties that push on the floor beams at the location of the connection causing generation of axial compressive forces within the beam segments confined by the diagonal steel bars placed around the failed column. The role of the added diagonal bars is to connect the orthogonal floor beams around the potential failed column together and to act as links/ties between the beams when the column fails. Development length is maintained to ensure adequate anchorage between the added bars and floor beams. Since the structural system in the vicinity of the failed column houses the largest deformations, the added diagonal top and bottom steel bars should be located close to and around the failed column to be effective. In this invention ductility and continuity of the structure is achieved by tying the orthogonal beams together, i.e., beams in two perpendicular directions: the longitudinal direction and transverse direction to ensure that the orthogonal beams act as one unit. This is done by placing diagonal steel bars in the each of the four slab panels surrounding the failed column and tying up the orthogonal beams bridging over the failed column (the structure considered is a space or three-dimensional structure).

This proposed invention computes the vertical displacement at the location of the failed column using the validated numerical three-dimensional nonlinear finite element model results. This proposed invention the structure is simulated numerically with the considered boundary conditions of the whole structure. The axial horizontal restraint for the beams bridging over the failed column are provided in this proposed invention by the diagonal steel bars embedded in the slab of each of the four slab panels around the failed column. This can be applied to all beams crossing over all columns, not only the potential failed one. To simulate the removal of the failed column and predict the progressive collapse of the 3D specimens detailed above, displacement-controlled nonlinear static push-down was applied at the position of removed column. The load was incrementally applied and the calculated stresses and strains in each element were compared to a set of predefined material performance criteria to tract the damage sequence in the frame. The sum of all column support reactions in the 3D floor system as a result of applied downward displacement equals to the applied load at the position of the remove column.

In the proposed invention the developed numerical model simulates the behavior of a three-dimensional floor system with four-span longitudinal beams, four-span transverse beams, sixteen slab panels, and twenty-five columns above and twenty-five columns underneath the floor with the center column underneath the floor being potential failed column, and the developed numerical model is already validated with thirty-four benchmark two and three-dimensional test data (to investigate the progressive collapse resistance of structures prone to interior column failure).

Single or double links, with top and bottom steel bars, are installed in each slab panel around the failed column. The diagonal steel bars, installed in each slab panels around failed column, are short bars of length not exceeding one-sixth the span of the longitudinal beam (span/6). These installed top and bottom steel bars in each slab panel around the failed column provide additional horizontal load paths to increase the building redundancy, robustness, ductility, and energy absorption capacity that can prevent the building progressive collapse due to column failure.

This invention shows that the increase in the beam compressive forces in the mitigated floors is credited primarily to the relative vertical displacement between the orthogonal beams which triggered self-generated axial tensile forces in the diagonal bars. Accordingly, the added diagonal bars are providing additional restraints to the horizontal movements and elongation of the beams. This led to an increase in the energy absorption by the arch action and catenary action. In addition, this invention demonstrates the effect of slab on the load-displacement behavior as it enhanced the capacities of the arch action and catenary action and reduced the maximum vertical displacements at failure of the systems with floor slabs as opposed to those with no slabs. The enhancement in arch action and catenary action capacities and the reduction in maximum displacement are attributed to the tensile membrane action in the floor slab due to the addition of the diagonal bars. This invention also shows that the increase in the beam compressive forces in the mitigated floors is credited primarily to the relative vertical displacement between the orthogonal beams which triggered self-generated axial tensile forces in the diagonal bars. Accordingly, the added diagonal bars are providing additional restraints to the horizontal movements and elongation of the beams. This led to an increase in the energy absorption by the arch action and catenary action. In addition, this proposed invention demonstrates the effect of slab on the load-displacement behavior as it enhanced the capacities of the arch action and catenary action and reduced the maximum vertical displacements at failure of the systems with floor slabs as opposed to those with no slabs. The enhancement in arch action and catenary action capacities and the reduction in maximum displacement are attributed to the tensile membrane action in the floor slab due to the addition of the diagonal bars.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents. The disclosures and the description herein are intended to be illustrative and are not in any sense limiting the invention, defined in scope by the following claims.

Many changes, modifications, variations and other uses and applications of the subject invention will become apparent to those skilled in the art after considering this specification and the accompanying drawings, which disclose the preferred embodiments thereof. All such changes, modifications, variations and other uses and applications, which do not depart from the spirit and scope of the invention, are deemed to be covered by the invention, which is to be limited only by the claims which follow.

The invention claimed is:

1. A method of enhancing progressive collapse resistance of a reinforced concrete floor system, the method comprising:

adding a plurality of diagonal top and bottom reinforcing bars within floor slab panels in a vicinity of a potentially failed column;

wherein the added diagonal top and bottom reinforcing bars connect orthogonal floor beams bridging over the potentially failed column and act as links/ties between the orthogonal floor beams when the column fails, and each of the diagonal reinforcing bars comprises a length not exceeding one-sixth a span of the longitudinal floor beam measured from a centerline of the potentially failed column.

2. The method of claim 1, wherein the method is applied to one or more potentially failed columns on a same floor or on different floors.

3. The method of claim 1, wherein adding a plurality of diagonal top and bottom reinforcing bars within floor slab panels develops self-generated post-tensioning axial compressive forces in the orthogonal floor beams and allows for responsive accommodation of large vertical displacements.

4. The method of claim 1, wherein steel bars left over from same construction sites are used as the diagonal top and bottom reinforcing bars.

5. The method of claim 1, wherein the plurality of diagonal top and bottom reinforcing bars are embedded within the floor slab thickness of the reinforced concrete floor system.

6. The method of claim 1, wherein the plurality of diagonal top and bottom reinforcing bars comprise two sets of diagonal links parallel to each other, wherein the diagonal links comprise top and bottom steel bars embedded within the floor slab thickness.

7. The method of claim 1, wherein the added diagonal top and bottom reinforcing bars are single or double links installed within each floor slab panel in the vicinity of the potentially failed column.

8. The method of claim 1, wherein the top and bottom steel bars in each floor slab panel provide additional horizontal load paths to increase building redundancy, robustness, ductility, and energy absorption capacity which prevents progressive collapse of the building due to column failure.

9. The method of claim 1, wherein the method uses left-over bars or reinforcing bars from a same construction site and does not require external accessories to attach the same to beams, columns, or components of the building.

* * * * *